US007395677B2

(12) United States Patent
Fujiyoshi et al.

(10) Patent No.: US 7,395,677 B2
(45) Date of Patent: Jul. 8, 2008

(54) AIR CONDITIONING SYSTEM

(75) Inventors: Ryusuke Fujiyoshi, Sakai (JP); Tomohiro Yabu, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 160 days.

(21) Appl. No.: 10/591,055

(22) PCT Filed: Mar. 23, 2005

(86) PCT No.: PCT/JP2005/005266

§ 371 (c)(1),
(2), (4) Date: Aug. 30, 2006

(87) PCT Pub. No.: WO2005/098321

PCT Pub. Date: Oct. 20, 2005

(65) Prior Publication Data

US 2007/0180844 A1 Aug. 9, 2007

(30) Foreign Application Priority Data

Mar. 31, 2004 (JP) ..... 2004-105174

(51) Int. Cl.
*F25B 13/00* (2006.01)

(52) U.S. Cl. ..... 62/324.1; 62/94; 62/480

(58) Field of Classification Search ..... 62/94, 62/271, 324.1, 480
See application file for complete search history.

(56) References Cited

U.S. PATENT DOCUMENTS 4,610,148 A * 9/1986 Shelton ..... 62/480
5,295,358 A * 3/1994 Rockenfeller et al. ..... 62/106
6,324,860 B1 * 12/2001 Maeda et al. ..... 62/271

FOREIGN PATENT DOCUMENTS

| | | | |
|---|---|---|---|
| EP | 1 450 113 | A1 | 8/2004 |
| JP | 59-079744 | U | 5/1984 |
| JP | 05-286353 | A | 11/1993 |
| JP | 06-101894 | A | 4/1994 |
| JP | 06-347107 | A | 12/1994 |
| JP | 07-186947 | A | 7/1995 |
| JP | 07-265649 | A | 10/1995 |
| JP | 08-261517 | A | 10/1996 |
| JP | 09-145206 | A | 6/1997 |
| JP | 10-259944 | A | 9/1998 |
| JP | 2001-193966 | A | 7/2001 |
| JP | 2002-081688 | A | 3/2002 |
| JP | 2003-130402 | A | 5/2003 |
| JP | 2003-161465 | | 6/2003 |
| JP | 2004-012127 | A | 1/2004 |
| WO | WO-03-029728 | | 4/2003 |
| WO | WO-03-046441 | | 6/2003 |

* cited by examiner

*Primary Examiner*—Melvin Jones
(74) *Attorney, Agent, or Firm*—Global IP Counselors

(57) ABSTRACT

An air conditioning system to treat a latent heat load and a sensible heat load in a room includes a plurality of utilization units, a heat source unit, and connection pipes that connect between the units. The utilization units include adsorbent heat exchangers provided with an adsorbent on the surface of each. The utilization units are configured to alternate between an adsorption process and a regeneration process. The heat source unit includes a compression mechanism and an accumulator.

24 Claims, 49 Drawing Sheets

101
301
364
310c
306
307
368
363
201
206
210c
362b
362
264
362c
362d
362a
262
261
367
263
361
365
366
265
221c
221
308
111
208
221b
202
228
310
207
210a
310a
328
221a
324
222
221d
210
322
225
302
321
323
325
227
224
226
223
231b
231
238
112
310b
210b
231c
338
231a
334
232
231d
233
332
235
303
331
333
335
203
237
234
236

401
501
564
510c
506
507
201
568
563
206
210c
562b
562
264
562c
562d
562a
262
261
567
263
561
565
566
265
508
411
221c
221
208
221b
202
228
510
207
210a
510a
528
222
221a
221d
524
526
210
EA
RA
OA
SA
522
225
502
224
226
223
227
521
523
525
412
231b
231
238
510b
538
210b
231c
534
232
231a
231d
233
536
EA
RA
OA
SA
532
235
503
203
237
234
236
531
533
535

401
501
564
510c
506
507
201
568
563
206
210c
562b
562
264
562c
562d
562a
262
261
567
263
561
565
566
265
508
221c
221
411
208
221b
202
228
510
207
210a
510a
528
222
221a
221d
524
526
210
SA
RA
OA
EA
522
225
502
521
523
525
227
224
226
223
412
231b
231
238
510b
538
210b
231c
231a
534
232
231d
233
536
SA
RA
OA
EA
532
235
503
203
531
533
535
237
234
236

601
701
764
710c
706
707
768
763
762b
762
762c
762d
762a
767
761
766
765
201
206
210c
264
262
261
263
265
708
710
611
744
728
724
743
726
742
741
710a
722
702
721
723
725
221c
221
202
228
208
221b
207
210a
221a
221d
222
210
225
227
224
226
223
754
612
231b
231
238
210b
231c
231a
231d
232
233
738
734
753
736
752
751
710b
732
235
237
234
236
203
703
731
733
735

601
701
764
710c
706
707
768
763
762b
762
762c
762d
762a
767
761
766
765
201
210c
206
264
262
261
263
265
708
710
611
221c
221
208
221b
202
228
744
207
210a
728
222
221d
221d
743
724
210
EA
RA
OA
SA
742
726
RA
SA
741
710a
722
225
702
721
723
725
227
224
226
223
754
612
231b
231
238
210b
231c
738
232
231d
231d
233
753
734
EA
RA
OA
SA
752
736
RA
SA
751
710b
732
235
703
731
733
735
237
234
236
203

601
701
764
710c
706
707
768
763
762b
762
762c
762d
762a
767
761
766
765
201
206
210c
264
262
261
263
265
708
710
611
221c
221
202
228
208
221b
702
207
210a
728
743
724
222
221a
221d
726
210
742
722
225
227
224
226
223
721
723
725
710a
612
231b
231
238
703
210b
231c
738
753
734
232
231a
231d
233
736
752
732
235
237
234
236
203
731
733
735
710b

AIR CONDITIONING SYSTEM

CROSS-REFERENCE TO RELATED APPLICATIONS

This U.S. National stage application claims priority under 35 U.S.C. §119(a) to Japanese Patent Application No. 2004-105174, filed in Japan on Mar. 31, 2004, the entire contents of which are hereby incorporated herein by reference.

1. Technical Field

The present invention relates to an air conditioning system. More specifically, the present invention relates to an air conditioning system in which the latent heat load and the sensible heat load in the room are treated by operating a vapor compression refrigeration cycle.

2. Background Art

Conventionally, air conditioners that cool and dehumidify the room are known (for example, see International Publication WO 03/029728). This type of air conditioner comprises a vapor compression refrigerant circuit having an outdoor heat exchanger as a heat source side heat exchanger and an indoor heat exchanger as an air heat exchanger, and a refrigerant is circulated in this refrigerant circuit to operate a refrigeration cycle. This air conditioner dehumidifies the room by setting the evaporation temperature of the refrigerant in the indoor heat exchanger lower than the dew point temperature of the room air and thus condensing moisture in the room air.

Also, dehumidifiers comprising a heat exchanger provided with an adsorbent on the surface thereof are also known (for example, see Japanese Patent Application Publication No. 07-265649). This type of dehumidifier comprises two heat exchangers each provided with an adsorbent. An adsorption process in which moisture in the air is adsorbed so as to dehumidify the air is performed in one of the two heat exchangers, while a regeneration process in which the moisture adsorbed is desorbed in performed in the other one of the two heat exchangers. During these processes, water that is cooled by a cooling tower is supplied to one heat exchanger that adsorbs the moisture, while heated wastewater is supplied to the other heat exchanger that regenerates water. Further, this dehumidifier is configured to supply the room with air that is dehumidified through the adsorption process and the regeneration process.

SUMMARY OF THE INVENTION

With the first described air conditioner, the latent heat load in the room is treated by setting the evaporation temperature of the refrigerant in the indoor heat exchanger lower than the dew point temperature of the room air and thus condensing moisture in the air. Specifically, although the sensible heat load can be treated even when the evaporation temperature of refrigerant in the indoor heat exchanger is higher than the dew point temperature of the room air, the evaporation temperature of refrigerant in the indoor heat exchanger must be set lower accordingly in order to treat the latent heat load. Consequently, the difference between high and low pressures in the vapor compression refrigeration cycle increases and so does the power consumption of the compressor, resulting in a reduced coefficient of performance (COP).

In addition, with the second described dehumidifier, the cooling water cooled by the cooling tower, i.e., the cooling water whose temperature is not so much lower than the room temperature is supplied to the heat exchanger. Therefore, this dehumidifier can treat the latent heat load in the room but not the sensible heat load, which has been a problem.

In order to solve such a problem, the inventors of the present invention have developed an air conditioner that comprises a vapor compression refrigerant circuit having a heat source side heat exchanger and an adsorbent heat exchanger as a utilization side heat exchanger (for example, see Patent Application No. 2003-351268). This air conditioner can treat the sensible heat load and the latent heat load in the room by alternating between the adsorption process in which moisture in the air is adsorbed onto an adsorbent heat exchanger having an adsorbent on the surface thereof and the regeneration process in which moisture in the air is desorbed from the adsorbent heat exchanger, and by supplying the room with air that passed through the adsorbent heat exchanger. Specifically, unlike the first described air conditioner that dehumidifies air by condensing moisture in the air, the air conditioner just described dehumidifies air by adsorbing moisture in the air onto the adsorbent, so that the evaporation temperature of the refrigerant does not need to be set lower than the air dew point temperature, and the air can be dehumidified even when the evaporation temperature of the refrigerant is set higher than the air dew point temperature. Consequently, compared to conventional air conditioners, this air conditioner allows the evaporation temperature of the refrigerant to be set high even when dehumidifying air, which consequently reduces the difference between high and low pressures in the refrigeration cycle. As a result, the power consumption of the compressor can be reduced, and the COP can be improved. In addition, this air conditioner is capable of treating the sensible heat load in the room at the same time when dehumidifying air, by setting the evaporation temperature of the refrigerant lower than the required evaporation temperature in the adsorbent heat exchanger.

Then, the inventors of the present invention intend to apply the above-described air conditioner that uses the above-described the adsorbent heat exchanger to an air conditioning system (so-called multi air conditioning system) that is installed in buildings and other facilities. However, in such a large scale air conditioning system, a plurality of air conditioners each comprising an adsorbent heat exchanger are needed, so that several compressors and the like to be used as heat sources may need to be installed according to the number of the adsorbent heat exchangers, which consequently creates problems such as an increase in cost and an increase in the number of parts to be maintained. Further, since excessive refrigerant is produced in the refrigerant circuits of each air conditioner because of the increase or decrease in the amount of circulating refrigerant along with a change in the operating load of the air conditioning system, receivers to accumulate excessive refrigerant that is produced along with the decrease in the amount of circulating refrigerant need to be connected according to the number of adsorbent heat exchangers, which causes further increase in cost and in size of an unit into which the adsorbent heat exchanger is built.

It is therefore an object of the present invention is to prevent problems such as an increase in cost and increase in size of an unit into which an adsorbent heat exchanger is built, which arise when a plurality of air conditioners that use the adsorbent heat exchangers are installed.

An air conditioning system according to a first aspect of the present invention is an air conditioning system that treats the latent heat load and the sensible heat load in the room by operating a vapor compression type refrigeration cycle, and comprises a plurality of utilization side refrigerant circuits; a heat source side refrigerant circuit; a discharge gas connection pipe; and an inlet gas connection pipe. The utilization side refrigerant circuits include two adsorbent heat exchangers provided with an adsorbent on the surface each thereof, and are capable of dehumidifying or humidifying air by alternating between an adsorption process in which moisture in the air is adsorbed onto the adsorbent by causing one of the two adsorbent heat exchangers to function as an evaporator that evaporates the refrigerant, and a regeneration process in which moisture is desorbed from the adsorbent by causing the other one of the two adsorbent heat exchangers to function as a condenser that condenses the refrigerant. The heat source side refrigerant circuit includes a compression mechanism and a liquid container that is connected to an inlet side of the compression mechanism. The discharge gas connection pipe is connected to a discharge side of the compression mechanism, and connects the utilization side refrigerant circuits to the heat source side refrigerant circuit. The inlet gas connection pipe is connected to the inlet side of the compression mechanism. The air conditioning system is capable of supplying the room with air that passed through the adsorbent heat exchangers.

In this air conditioning system, the plurality of utilization side refrigerant circuits capable of mainly treating the latent heat load in the room by alternating between the adsorption process and the regeneration process in the adsorbent heat exchangers so as to dehumidify or humidify air that passes through the adsorbent heat exchangers are connected to the heat source side refrigerant circuit through the discharge gas connection pipe and the inlet gas connection pipe, thus constituting so-called multi-type air conditioning system. Specifically, heat sources to be used to operate a vapor compression refrigeration cycle between the utilization side refrigerant circuits are collected together as one heat source that is shared by the plurality of utilization side refrigerant circuits. In this way, it is possible to prevent problems such as an increase in cost and an increase in the number of parts to be maintained, which occur when a plurality of air conditioners that use the adsorbent heat exchangers are installed.

Further, the heat source side refrigerant circuit includes a liquid container connected to the inlet side of the compression mechanism. The liquid container can accumulate excessive refrigerant which increases when the amount of circulating refrigerant decreases along with a change in the operating load of this air conditioning system. Consequently, receivers to accumulate excessive refrigerant that is produced along with the decrease in the amount of circulating refrigerant do not need to be connected according to the number of utilization side refrigerant circuits i.e. the adsorbent heat exchangers, and thus problems such as an increase in cost and an increase in size of an unit into which the adsorbent heat exchangers is built can be prevented.

An air conditioning system according to a second aspect of the present invention is the air conditioning system of the first aspect of the present invention, in which the heat source side refrigerant circuit comprises a supplementary condenser that is connected to the discharge side of the compression mechanism.

With this air conditioning system, a portion of the refrigerant that flows on the discharge side of the compression mechanism is condensed by the supplementary condenser, and thus the pressure of the refrigerant on the discharge side of the compression mechanism can be reduced. Accordingly, even when the pressure changes, such as in a way that the pressure of refrigerant on the discharge side of the compression mechanism temporarily increases due to the increase or decrease in the amount of circulating refrigerant along with a change in the operating load of the air conditioning system, a multi air conditioning system that uses adsorbent heat exchangers can be operated in a stable manner.

An air conditioning system according to a third aspect of the present invention is the air conditioning system of the first or the second aspect of the present invention, in which the air conditioning system comprises a plurality of second utilization side refrigerant circuits; and a second heat source side refrigerant circuit. The plurality of second utilization side refrigerant circuits include an air heat exchanger, and are capable of exchanging heat between refrigerant and air. The second heat source side refrigerant circuits include a second compression mechanism and a heat source side heat exchanger. The air conditioning system is capable of supplying the room with air that passed through the air heat exchangers.

This air conditioning system comprises a system including the plurality of second utilization side refrigerant circuits capable of mainly treating the sensible heat load in the room by exchanging heat between refrigerant and air that passes through the air heat exchanger and the second heat source side refrigerant circuit, in addition to a system including the plurality of first utilization side refrigerant circuits having the adsorbent heat exchanger, and the first heat source side heat exchanger. Accordingly, it is possible to constitute an air conditioning system, in which the system including the plurality of first utilization side refrigerant circuits having the adsorbent heat exchangers and the first heat source side refrigerant circuit is used as a latent heat load treatment system that mainly treats the latent heat load in the room, and the system including the plurality of second utilization side refrigerant circuits having the air heat exchangers and the second heat source side refrigerant circuit is used as a sensible heat load treatment system. Consequently, it is possible to treat the latent heat load and sensible heat load in the room separately by the two treatment systems.

An air conditioning system according to a fourth aspect of the present invention is the air conditioning system of the third aspect of the present invention, in which the air conditioning system calculates a generated sensible heat treatment capacity value that corresponds to the capacity of the sensible heat treatment that is performed along with the latent heat load treatment in the room in the first utilization side refrigerant circuits through the adsorption process or the regeneration process in the adsorbent heat exchangers, then controls the operational capacity of the second compression mechanism in view of the generated sensible heat treatment capacity value.

This air conditioning system calculates the generated sensible heat treatment capacity value, which corresponds to the capacity of the sensible heat treatment that is performed along with the latent heat treatment in the first utilization side refrigerant circuits through the adsorption process or the regeneration process in the adsorbent heat exchangers, and controls the operational capacity of the second compression mechanism based on this generated sensible heat treatment capacity value, so that the sensible heat treatment capacity in the second utilization side refrigerant circuits will not be excessive. Consequently, convergence to the target temperature of the room air can be improved.

An air conditioning system according to a fifth aspect of the present invention is the air conditioning system of the fourth aspect of the present invention, in which the air conditioning system comprises a supply air temperature detection mechanism configured to detect the temperature of air to be supplied to the room after passing through the adsorbent heat exchangers. The air conditioning system calculates the generated sensible heat treatment capacity value, based on the supply air temperature detected by the supply air temperature detection mechanism and the temperature of the room air.

This air conditioning system comprises the supply air temperature detection mechanism that detects the temperature of the air that is supplied to the room after passing through the adsorbent heat exchanger, and this air conditioning system calculates a latent heat sensible heat treatment capacity value based on the supply air temperature detected by the supply air temperature detection mechanism and the temperature of the room air, so that latent heat sensible heat treatment capacity value can be accurately calculated. Consequently, convergence to the target temperature of the room air can be further improved.

An air conditioning system according to a sixth aspect of the present invention is the air conditioning system of the fourth or the fifth aspect of the present invention, in which, at system startup, air that has been heat-exchanged in the air heat exchanger is supplied to the room, and outdoor air is prevented from passing through the adsorbent heat exchangers.

In this air conditioning system, at system startup, mainly the sensible heat is treated by supplying the room with air that has been heat-exchanged in the heat exchanger, and also outdoor air is prevented from passing through the adsorbent heat exchanger in order to prevent introduction of outdoor air. Accordingly, at system startup, the introduction of heat load from outdoor air can be prevented when the air conditioning capacity of the latent heat load treatment system is not operating at full capacity, and thus the target temperature of the room air can be quickly obtained. Consequently, in the air conditioning system comprising the latent heat load treatment system having the adsorbent heat exchanger and configured to mainly treat the latent heat load in the room and the sensible heat load treatment system having the air heat exchanger and configured to mainly treat the sensible heat load in the room, it will be possible to quickly cool or heat the room at system startup.

An air conditioning system according to a seventh aspect of the present invention is the air conditioning system of the fourth or the fifth aspect of the present invention, in which, at system startup, in a state in which switching between the adsorption process and the regeneration process in a plurality of adsorbent heat exchangers is stopped, outdoor air is passed through one of the plurality of adsorbent heat exchangers, and then is exhausted to the outside; also, room air is passed through an adsorbent heat exchanger besides the one through which the outdoor air passed among the plurality of adsorbent heat exchangers, and then is supplied to the room again.

In this air conditioning system, at system startup, mainly the sensible heat is treated by supplying the room with air that has been heat-exchanged in the heat exchanger, and also mainly the sensible heat is treated by passing outdoor air through the adsorbent heat exchanger and then exhausting the air to the outside in a state in which the switching operation between the adsorption process and the regeneration process in the adsorbent heat exchanger is stopped. As a result, at system startup, the sensible heat treatment in the room can be facilitated and the target temperature of the room air can be quickly obtained. Consequently, in the air conditioning system comprising the latent heat load treatment system having the adsorbent heat exchanger and configured to mainly treat the latent heat load in the room, and the sensible heat load treatment system having the air heat exchanger and configured to mainly treat the sensible heat load in the room, it will be possible to quickly cool or heat the room at system startup.

An air conditioning system according to a eighth aspect of the present invention is the air conditioning system of the fourth or the fifth aspect of the present invention, in which, at system startup, a switching time interval between the adsorption process and the regeneration process in the adsorbent heat exchanger is made longer than that during normal operation.

In this air conditioning system, at system startup, the switching time interval in the adsorbent heat exchanger is made longer than that during normal operation to mainly treat the sensible heat. In this way, the target temperature of the room air can be quickly obtained. Consequently, in the air conditioning system comprising the latent heat load treatment system having the adsorbent heat exchanger and configured to mainly treat the latent heat load in the room, and the sensible heat load treatment system having the air heat exchanger and configured to mainly treat the sensible heat load in the room, it will be possible to quickly cool or heat the room at system startup.

An air conditioning system according to a ninth aspect of the present invention is the air conditioning system of any one of the sixth to the eighth aspects of the present invention, in which a system startup operation will be terminated after a predetermined period of time elapsed since system startup.

After a period of time enough to treat the sensible heat elapsed since system startup, this air conditioning system passes outdoor air through the adsorbent heat exchanger to treat the latent heat, starts switching between the adsorption process and the regeneration process in the adsorbent heat exchanger, and shortens the switching time interval in the adsorbent heat exchanger. In this way, the normal operation in which the latent heat load and the sensible heat load in the room are treated can be initiated as soon as possible.

An air conditioning system according to a tenth aspect of the present invention is the air conditioning system of any one of the sixth to the eighth aspects of the present invention, in which the system startup operation will be terminated after a temperature difference between the target temperature of the room air and the temperature of the room air is equal to or below a predetermined temperature difference.

After the temperature difference between the target temperature of the room air and the temperature of the room air is equal to or below a predetermined temperature difference and the sensible heat is treated sufficiently, this air conditioning system passes outdoor air through the adsorbent heat exchanger to treat the latent heat, starts switching between the adsorption process and the regeneration process in the adsorbent heat exchangers, and shortens the switching time interval in the adsorbent heat exchanger. In this way, the normal operation in which the latent heat load and the sensible heat load in the room are treated can be initiated as soon as possible.

An air conditioning system according to an eleventh aspect of the present invention is the air conditioning system of any one of the sixth to the tenth aspects, in which, before the system startup operation starts, whether or not the temperature difference between the target temperature of the room air and the temperature of the room air is equal to or below a predetermined temperature difference is determined, and when the temperature difference between the target temperature of the room air and the temperature of the room air is equal to or below a predetermined temperature, the system startup operation is prevented from being performed.

In this air conditioning system, at system startup, before starting an operation in which the sensible heat load in the room is preferentially treated according to any one of the sixth to the tenth aspects of the present invention, the necessity to start such an operation is determined based on the temperature of the room air. Accordingly, at system startup, the operation in which the sensible heat load in the room is preferentially treated is prevented from being unnecessarily performed, and therefore the normal operation in which the latent heat load and the sensible heat load in the room are treated can be initiated as soon as possible.

An air conditioning system according to a twelfth aspect of the present invention is the air conditioning system of the third aspect of the present invention, in which the air conditioning system comprises a pressure control mechanism that is connected to a gas side of the air heat exchanger and configured to control the evaporation pressure of the refrigerant in the air heat exchanger when the air heat exchanger is caused to function as an evaporator that evaporates the refrigerant.

An air conditioning system according to a thirteenth aspect of the present invention is the air conditioning system of the twelfth aspect of the present invention, in which the pressure control mechanism controls the evaporation pressure of the refrigerant, based on the dew point temperature of the room air, when the air heat exchanger is caused to function as an evaporator.

This air conditioning system controls the pressure control mechanism based on the dew point temperature of the room air such that, for example, the evaporation temperature of the refrigerant in the air heat exchanger does not drop below the dew point temperature of the room air. In this way, moisture in the air is prevented from being condensed on the surface of the air heat exchanger, and drain water is prevented from being generated in the air heat exchanger. Consequently, a drain pipe will not be needed in the unit having the second utilization side refrigerant circuits, and thus the laborsaving installation of the unit having the second utilization side refrigerant circuits can be achieved.

Here, the dew point temperature of the room air may be obtained, for example, by using a dew point sensor provided in the unit having the air heat exchanger to measure the dew point temperature of the room air to be drawn into this unit, or by using a temperature/humidity sensor provided in the unit having the air heat exchanger to measure the temperature and humidity of the room air to be drawn into this unit, and by performing calculation based on these measured values. In addition, when the unit having the air heat exchanger is not provided with the dew point sensor or the temperature/humidity sensor, measured values obtained by the dew point sensor or the temperature/humidity sensor provided in the unit having the adsorbent heat exchanger may be used.

An air conditioning system according to a fourteenth aspect of the present invention is the air conditioning system of the thirteenth aspect of the present invention, in which the air conditioning system comprises a pressure detection mechanism that detects the refrigerant pressure in the air heat exchanger. This air conditioning system calculates the target evaporation pressure based on the dew point temperature of the room air, and the pressure control mechanism controls the evaporation pressure of the refrigerant detected by the pressure detection mechanism to be equal to or higher than the target evaporation pressure.

In this air conditioning system, instead of the dew point temperature, the evaporation pressure of the refrigerant in the air heat exchanger measured by the pressure detection mechanism is used as a control value for the pressure control mechanism for controlling the evaporation pressure of the refrigerant in the air heat exchanger. Therefore, the control responsiveness is improved, compared to a case where the evaporation pressure of the refrigerant is controlled by using the dew point temperature.

An air conditioning system according to a fifteenth aspect of the present invention is the air conditioning system of the fourteenth aspect of the present invention, in which the air conditioning system comprises a condensation detection mechanism that detects the presence of condensation in the air heat exchanger. This air conditioning system changes the target evaporation pressure when condensation is detected by the condensation detection mechanism.

In this air conditioning system, the condensation detection mechanism reliably detects condensation in the air heat exchanger, and also, when condensation is detected, the evaporation temperature of the refrigerant in the air heat exchanger is raised, for example, by increasing the target evaporation pressure, consequently, condensation in the air heat exchanger can be reliably prevented.

An air conditioning system according to a sixteenth aspect of the present invention is the air conditioning system of any one of the third, and the twelfth to the fifteenth aspects of the present invention, in which the air conditioning system comprises a condensation detection mechanism that detects the presence of condensation in the air heat exchanger. This air conditioning system stops the second compression mechanism when condensation is detected by the condensation detection mechanism.

In this air conditioning system, the condensation detection mechanism reliably detects condensation in the air heat exchanger, and also, the second compression mechanism is configured to be stopped when condensation is detected; therefore, condensation in the air heat exchanger can be reliably prevented.

An air conditioning system according to a seventeenth aspect of the present invention is the air conditioning system of any of the third, and the twelfth to the sixteenth aspects of the present invention, in which the air conditioning system comprises the condensation detection mechanism that detects the presence of condensation in the air heat exchanger. The second utilization side refrigerant circuit comprises a utilization side expansion valve that is connected to the liquid side of the air heat exchanger. The air conditioning system closes the utilization side expansion valve when condensation is detected by the condensation detection mechanism.

In this air conditioning system, the condensation detection mechanism reliably detects condensation in the air heat exchanger, and also, the utilization side expansion valve is configured to be closed when condensation is detected. Therefore, condensation in the air heat exchanger can be reliably prevented.

An air conditioning system according to a eighteenth aspect of the present invention is the air conditioning system of any one of the first to the third and the twelfth to the seventeenth aspects of the present invention, in which the switching time interval between the adsorption process and the regeneration process in the adsorbent heat exchanger can be changed.

In this air conditioning system, by changing the switching time interval between the adsorption process and the regeneration process in the adsorbent heat exchanger, the ratio of the sensible heat treatment capacity to the latent heat treatment capacity in the adsorbent heat exchanger (hereinafter referred to as a sensible heat treatment capacity ratio) can be changed. Accordingly, when the required sensible heat treatment capacity increases and the sensible heat treatment capacity in the second utilization side refrigerant circuits needs to be increased, the switching time interval between the adsorption process and the regeneration process in the adsorbent heat exchanger is made longer than that during normal operation. By so doing, the sensible heat treatment capacity ratio in the first utilization side refrigerant circuits can be increased.

Consequently, even when the required sensible heat treatment capacity increases, the air conditioning system can follow a change in the sensible heat treatment capacity while being operated so as to prevent moisture in the air from being condensed in the second utilization side refrigerant circuits and treat only the sensible heat load in the room.

An air conditioning system according to a nineteenth aspect of the present invention is the air conditioning system of the twelfth to the eighteenth aspects of the present invention, in which, at system startup, treatment of the latent heat load in the room by the first utilization side refrigerant circuits is given priority over treatment of the sensible heat load in the room by the second utilization side refrigerant circuits.

In this air conditioning system, at system startup, treatment of the latent heat load in the room by the first utilization side refrigerant circuits is given priority over treatment of the sensible heat load in the room by the second utilization side refrigerant circuits. Therefore, it is possible to treat the sensible heat by the sensible heat load treatment system after sufficiently lowering the humidity of the room air by treating the latent heat by the latent heat load treatment system. Consequently, in the air conditioning system comprising the latent heat load treatment system having the adsorbent heat exchanger and configured to mainly treat the latent heat load in the room, and the sensible heat load treatment system having the air heat exchanger and configured to operate such that moisture in the air is prevented from being condensed in the air heat exchanger and treat only the sensible heat load in the room, it will be possible to quickly treat the sensible heat load while being operated so as to prevent condensation in the air heat exchanger even when the system starts under a condition in which the dew point temperature of the room air is high.

An air conditioning system according to a twentieth aspect of the present invention is the air conditioning system of the nineteenth aspect of the present invention, in which, at system startup, treatment of the sensible heat load in the room by the second utilization side refrigerant circuits is stopped until the dew point temperature of the room air is equal to or below the target dew point temperature.

In this air conditioning system, at system startup, treatment of the sensible heat load by the sensible heat load treatment system is stopped and only the latent heat load is treated by the latent heat load treatment system until the dew point temperature of the room air is equal to or below the target dew point temperature. In this way, treatment of the sensible heat load by the sensible heat load treatment system can be initiated as soon as possible.

An air conditioning system according to a twenty-first aspect of the present invention is the air conditioning system of the nineteenth aspect of the present invention, in which, at system startup, treatment of the sensible heat load in the room by the second utilization side refrigerant circuits is stopped until the absolute humidity of the room air is equal to or below the target absolute humidity.

In this air conditioning system, at system startup, treatment of the sensible heat load by the sensible heat load treatment system is stopped and only the latent heat is treated by the latent heat load treatment system until the absolute humidity is equal to or below the target absolute humidity. In this way, treatment of the sensible heat load by the sensible heat load treatment system can be initiated as soon as possible.

An air conditioning system according to a twenty-second aspect of the present invention is the air conditioning system of any one of the nineteenth to the twenty-first aspects of the present invention, in which, at system startup, outdoor air is passed through an adsorbent heat exchanger that is performing the regeneration process among the plurality of adsorbent heat exchangers and then is exhausted to the outside, and also the room air is passed through an adsorbent heat exchanger that is performing the adsorption process among the plurality of adsorbent heat exchangers and then is supplied to the room again.

At system startup, this air conditioning system performs a dehumidifying operation while circulating room air. In this way, treatment of the sensible heat load by the sensible heat load treatment system can be initiated as soon as possible.

An air conditioning system according to a twenty-third aspect of the present invention is the air conditioning system of any one of the nineteenth to the twenty-second aspect of the present invention, in which, before starting the system startup operation, whether or not the dew point temperature difference between the target dew point temperature of the room air and the dew point temperature of the room air is equal to or below a predetermined dew point temperature difference is determined, and when the dew point temperature difference between the target dew point temperature of the room air and the dew point temperature of the room air is equal to or below the predetermined dew point temperature difference, the system startup operation is prevented from being performed.

In this air conditioning system, at system startup, before starting an operation in which the latent heat load in the room is preferentially treated according to any one of the nineteenth to the twenty-second aspects of the present invention, the necessity to start such an operation is determined based on the dew point temperature of the room air. Accordingly, at system startup, the operation in which the latent heat load in the room is preferentially treated is prevented from being unnecessarily performed, and therefore the normal operation in which the latent heat load and the sensible heat load in the room are treated can be initiated as soon as possible.

An air conditioning system according to a twenty-fourth aspect of the present invention is the air conditioning system of any one of the nineteenth to the twenty-second aspects of the present invention, in which, before starting the system startup operation, whether or not the humidity difference between the target absolute humidity of the room air and the absolute humidity of the room air is equal to or below a predetermined absolute humidity difference is determined, and when the humidity difference between the target absolute humidity of the room air and the absolute humidity of the room air is equal to or below the predetermined absolute humidity difference, the system startup operation is prevented from being performed.

In this air conditioning system, at system startup, before starting the operation in which the latent heat load in the room is preferentially treated according to any one of the nineteenth to the twenty-second aspects of the present invention, the necessity to start such an operation is determined based on the absolute humidity of the room air. Accordingly, at system startup, the operation in which the latent heat load in the room is preferentially treated is prevented from being unnecessarily performed, and therefore the normal operation in which the latent heat load and the sensible heat load in the room are treated can be initiated as soon as possible.

DETAILED DESCRIPTION OF THE INVENTION

Embodiments of an air conditioning system according to the present invention will be described below with reference to the drawings.

First Embodiment (1) Configuration of the Air Conditioning System

Figure 1:
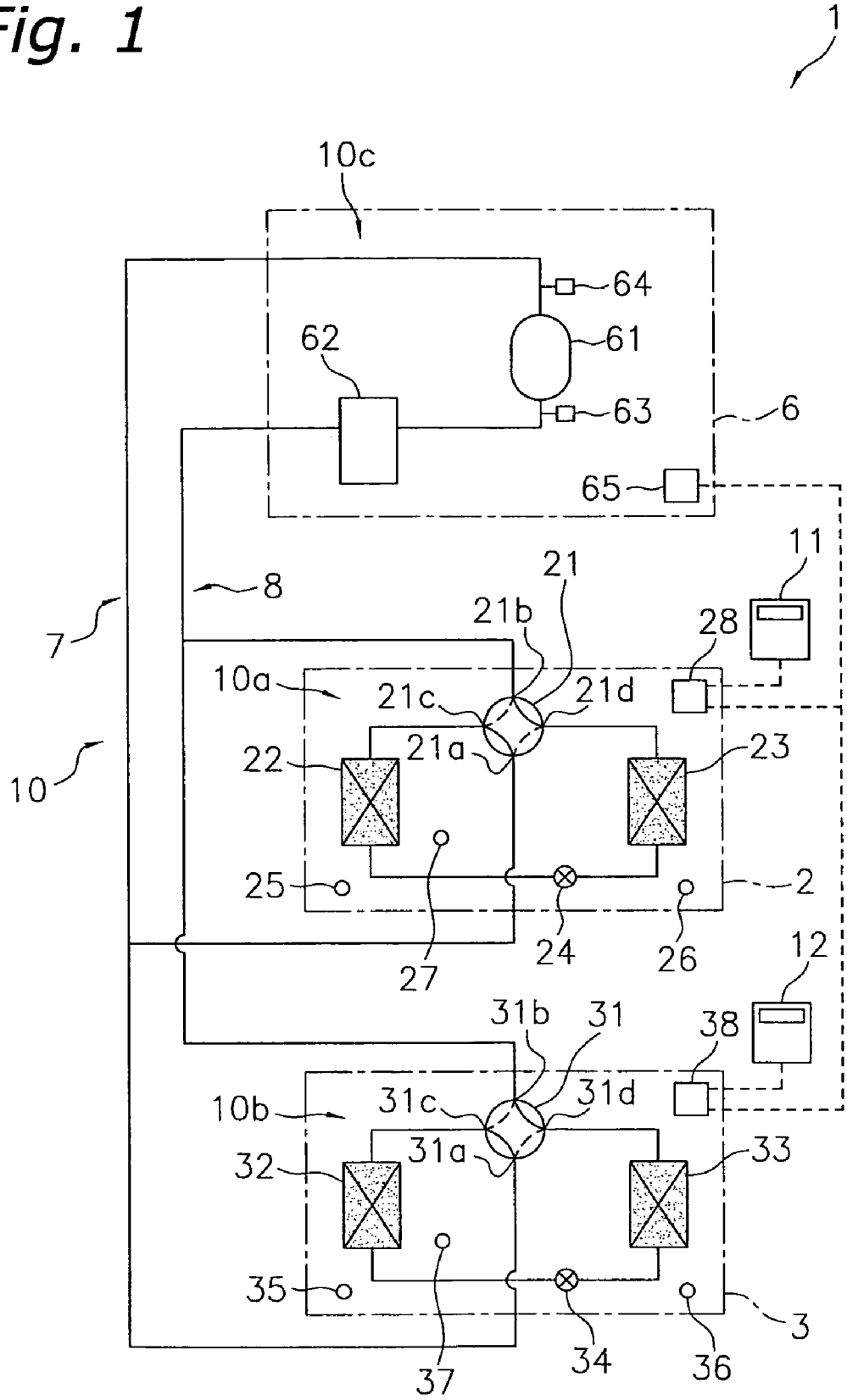
FIG. 1 is a schematic diagram of a refrigerant circuit of an air conditioning system of a first embodiment according to the present invention.

FIG. 1 a schematic diagram of a refrigerant circuit of an air conditioning system 1 of a first embodiment according to the present invention. The air conditioning system 1 is an air conditioning system that treats the latent heat load and the sensible heat load in the room of a building and the like by operating a vapor compression type refrigeration cycle. The air conditioning system 1 is so-called separate type multi air conditioning system, and mainly comprises: a plurality (two in this embodiment) of utilization units 2, 3; a heat source unit 6; and connection pipes 7, 8, which connect the utilization units 2, 3 to the heat source unit 6. In the present embodiment, the heat source unit 6 functions as a heat source that is shared by the utilization units 2, 3. In addition, although the present embodiment has only one heat source unit 6, a plurality of heat source units 6 may be connected in parallel when there are many utilization units 2, 3.

<Utilization Unit>

The utilization units 2, 3 are disposed such by being embedded in or hung from an indoor ceiling of a building or the like, or by being mounted in a space in above a ceiling. The utilization units 2, 3 are connected to the heat source unit 6 through the connection pipes 7, 8, and constitute part of a refrigerant circuit 10 in a space between the utilization units 2, 3 and the heat source unit 6. The utilization units 2, 3 can treat the sensible heat load and the latent heat load in the room by circulating refrigerant in the refrigerant circuit 10 and operating a vapor compression type refrigeration cycle.

Next, the configuration of the utilization units 2, 3 will be described. Note that the utilization unit 2 and the utilization unit 3 have the same configuration, so that only the configuration of the utilization unit 2 will be described here, and in regard to the configuration of the utilization unit 3, reference numerals in the 30s will be used instead of reference numerals in the 20s representing each component of the utilization unit 2, and a description of each component will be omitted.

The utilization unit 2 mainly constitutes part of the refrigerant circuit 10, and comprises a utilization side refrigerant circuit 10*a* capable of dehumidifying or humidifying air. This utilization side refrigerant circuit 10*a* mainly comprises: a utilization side four-way directional control valve 21; a first adsorbent heat exchanger 22; a second adsorbent heat exchanger 23; and a utilization side expansion valve 24.

The utilization side four-way directional control valve 21 is a valve used to switch a passage of refrigerant that flows into the utilization side refrigerant circuit 10*a*. A first port 21*a* of the valve 21 is connected to a discharge side of a compression mechanism 61 (to be described below) in the heat source unit 6 through the discharge gas connection pipe 7, a second port 21*b* thereof is connected to an inlet side of the compression mechanism 61 in the heat source unit 6 through the inlet gas connection pipe 8, and a third port 21*c* thereof is connected to a gas side end of the first adsorbent heat exchanger 22, and the fourth port 21*d* thereof is connected to a gas side end of the second adsorbent heat exchanger 23. Further, the utilization side four-way directional control valve 21 is capable of switching between a state in which the first port 21*a* is connected to the third port 21*c* while the second port 21*b* is connected to the fourth port 21*d* (a first state; see the solid lines in the utilization side four-way directional control valve 21 in FIG. 1) and a state in which the first port 21*a* is connected to the fourth port 21*d* while the second port 21*b* is connected to the third port 21*c* (a second state; see the broken lines in the utilization side four-way directional control valve 21 in FIG. 1).

The first adsorbent heat exchanger 22 and the second adsorbent heat exchanger 23 are fin and tube type heat exchangers of the cross fin type, which are formed with a heat transfer tube and a number of fins. Specifically, the first adsorbent heat exchanger 22 and the second adsorbent heat exchanger 23 include a number of rectangular plate shaped fins made of aluminum, and a heat transfer tube made of copper, which penetrates the fins. Note that the first adsorbent heat exchanger 22 and the second adsorbent heat exchanger 23 are not limited to the fin and tube type heat exchangers of the cross fin type. Other types of heat exchangers, such as corrugated fin type heat exchangers may be used.

The first adsorbent heat exchanger 22 and the second adsorbent heat exchanger 23 each have an adsorbent that is supported on the surface of the fins by dip molding (dipping mold). A method for supporting an adsorbent on the surface of a fin and a heat exchanger tube is not limited to the method that uses dip molding. An adsorbent may be supported on the surface in any method as long as adsorbing capacity of the adsorbent is not impaired. An adsorbent to be used here may include: zeolite, silica gel, activated carbon, organic polymer system material having a hydrophilic property or a water-absorbing property, ion exchange resin system material having a carboxylic acid group or a sulfonic acid group, functional polymer material such as temperature-sensitive polymers, and the like.

The first adsorbent heat exchanger 22 and the second adsorbent heat exchanger 23 allow moisture in the air to be adsorbed onto the adsorbent supported on the surface thereof, by being caused to function as evaporators that evaporate the refrigerant while allowing air to pass through the outside thereof. In addition, the first adsorbent heat exchanger 22 and the second adsorbent heat exchanger 23 allow the moisture adsorbed onto the adsorbent supported on the surface thereof to be desorbed, by being caused to function as condensers that condense the refrigerant while allowing air to pass through the outside thereof.

The utilization side expansion valve 24 is an electric expansion valve connected between the liquid side end of the first adsorbent heat exchanger 22 and the liquid side end of the second adsorbent heat exchanger 23, and is capable of reducing the pressure of the refrigerant that is sent from one of the first adsorbent heat exchanger 22 and the second adsorbent heat exchanger 23, whichever is acting as a condenser, to the other one of the first adsorbent heat exchanger 22 and the second adsorbent heat exchanger 23, whichever is acting as an evaporator.

In addition, although the detail is not shown, the utilization unit 2 comprises: an outside air inlet for drawing outdoor air (hereinafter referred to as outdoor air OA) into the unit; an exhaust air outlet for exhausting air from the unit to the outside; an indoor air inlet for drawing room air (hereinafter referred to as room air RA) into the unit; a supply air outlet for supplying air that is blown out from the unit to the room (hereinafter referred to as supply air SA); an exhaust fan that is disposed in the unit so as to communicate with the exhaust air outlet; an air supply fan that is disposed in the unit so as to communicate with the supply air outlet; and a switching mechanism comprising a damper and the like for switching an air passage. Accordingly, the utilization unit 2 can do the following actions: draw outdoor air OA from the outside air inlet into the unit, pass the air through one of the first and second adsorbent heat exchangers 22, 23, and then supply the air as the supply air SA to the room from the supply air outlet; draw outdoor air OA from the outside air inlet into the unit, pass the air through one of the first and second adsorbent heat exchangers 22, 23, and then exhaust the air as the exhaust air EA to the outside from the exhaust air outlet; draw the room air RA from the indoor air inlet into the unit, pass the air through one of the first and second adsorbent heat exchangers 22, 23, and then supply the air as the supply air SA to the room from the supply air outlet; and draw the room air RA from the indoor air inlet into the unit, pass the air through one of the first or second adsorbent heat exchangers 22, 23, and then exhaust the air as the exhaust air EA to the outside from the exhaust air outlet.

Further, the utilization unit 2 comprises: an RA inlet temperature/humidity sensor 25 that detects the temperature and the relative humidity of the room air RA to be drawn into the unit; an OA inlet temperature/humidity sensor 26 that detects the temperature and the relative humidity of the outdoor air OA to be drawn into the unit; an SA supply temperature sensor 27 that detects the temperature of the supply air SA to be supplied to the room from the unit; and a utilization side controller 28 that controls the operation of each component that constitutes the utilization unit 2. The utilization side controller 28 includes a microcomputer and a memory device provided for controlling the utilization unit 2. Through a remote control 11 and a heat source side controller 65 of the heat source unit 6, which will be described below, the utilization side controller 28 can send and receive input signals of the target temperature and the target humidity of the room air, and also can exchange control signals and other signals with the heat source unit 6.

<Heat Source Unit>

The heat source unit 6 is disposed on the roof of a building and the like, and is connected to the utilization units 2, 3 through the connection pipes 7, 8, and constitutes the refrigerant circuit 10 in a space between the heat source unit 6 and the utilization units 2, 3.

Next, the configuration of the heat source unit 6 will be described. The heat source unit 6 mainly constitutes part of the refrigerant circuit 10, and comprises a heat source side refrigerant circuit 10*c*. This heat source side refrigerant circuit 10*c* mainly comprises the compression mechanism 61; and an accumulator 62 that is connected to an inlet side of the compression mechanism 61.

In the present embodiment, the compression mechanism 61 is a positive-displacement compressor whose operational capacity can be changed by the inverter control. In the present embodiment, the compression mechanism 61 only has one compressor but is not limited thereto, and may also be one where two or more compressors are connected in parallel in accordance with the number of utilization units to be connected.

The accumulator 62 is a container to accumulate excessive refrigerant that is produced because of the increase or decreased in the amount of refrigerant along with a change in the operating load of the utilization side refrigerant circuits 10*a*, 10*b*.

In addition, the heat source unit 6 comprises: an inlet pressure sensor 63 that detects the inlet pressure of the compression mechanism 61; a discharge pressure sensor 64 that detects the discharge pressure of the compression mechanism 61; and a heat source side controller 65 that controls the operation of each component that constitutes the heat source unit 6. The heat source side controller 65 includes a microcomputer and a memory device provided for controlling the utilization unit 2, and is capable of exchanging a control signal and the like with the utilization side controllers 28, 38 of the utilization units 2, 3 via the heat source side controller 65.

(2) Operation of the Air Conditioning System

Next, the operation of the air conditioning system 1 of the present embodiment will be described. The air conditioning system 1 can perform various types of dehumidifying operations and humidifying operations as described below.

<Full Ventilation Mode>

First, a dehumidifying operation and a humidifying operation in a full ventilation mode will be described. In the full ventilation mode, when the air supply fan and the exhaust fan of the utilization units 2, 3 are operated, outdoor air OA is drawn through the outside air inlets into the units, and is supplied as the supply air SA through the supply air outlets to the room, while the room air RA is drawn through the indoor air inlets into the units, and is exhausted as the exhaust air EA through the exhaust air outlets to the outside.

Figure 2:
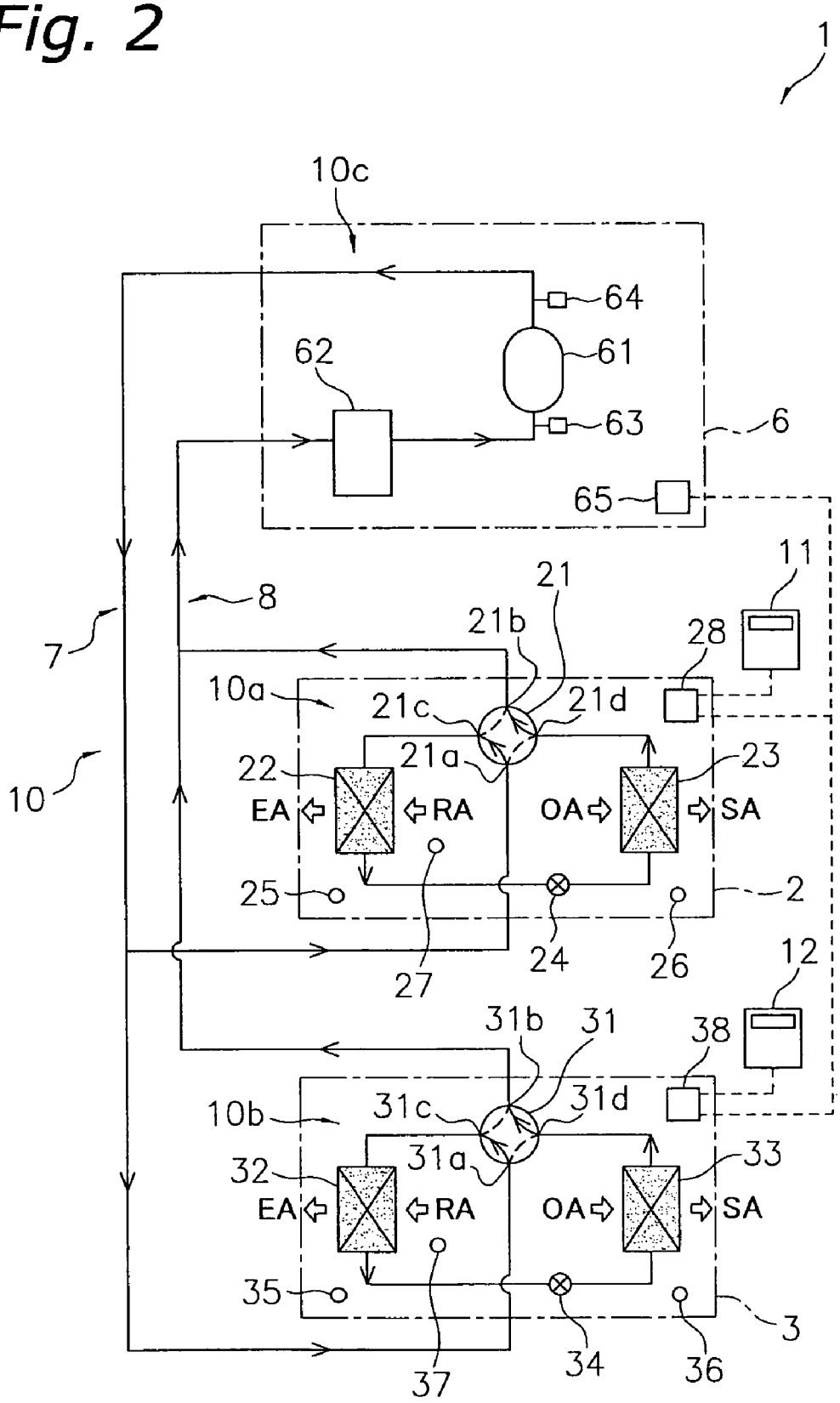
FIG. 2 is a schematic diagram of a refrigerant circuit showing the operation during a dehumidifying operation in a full ventilation mode in the air conditioning system of the first embodiment.
Figure 3:
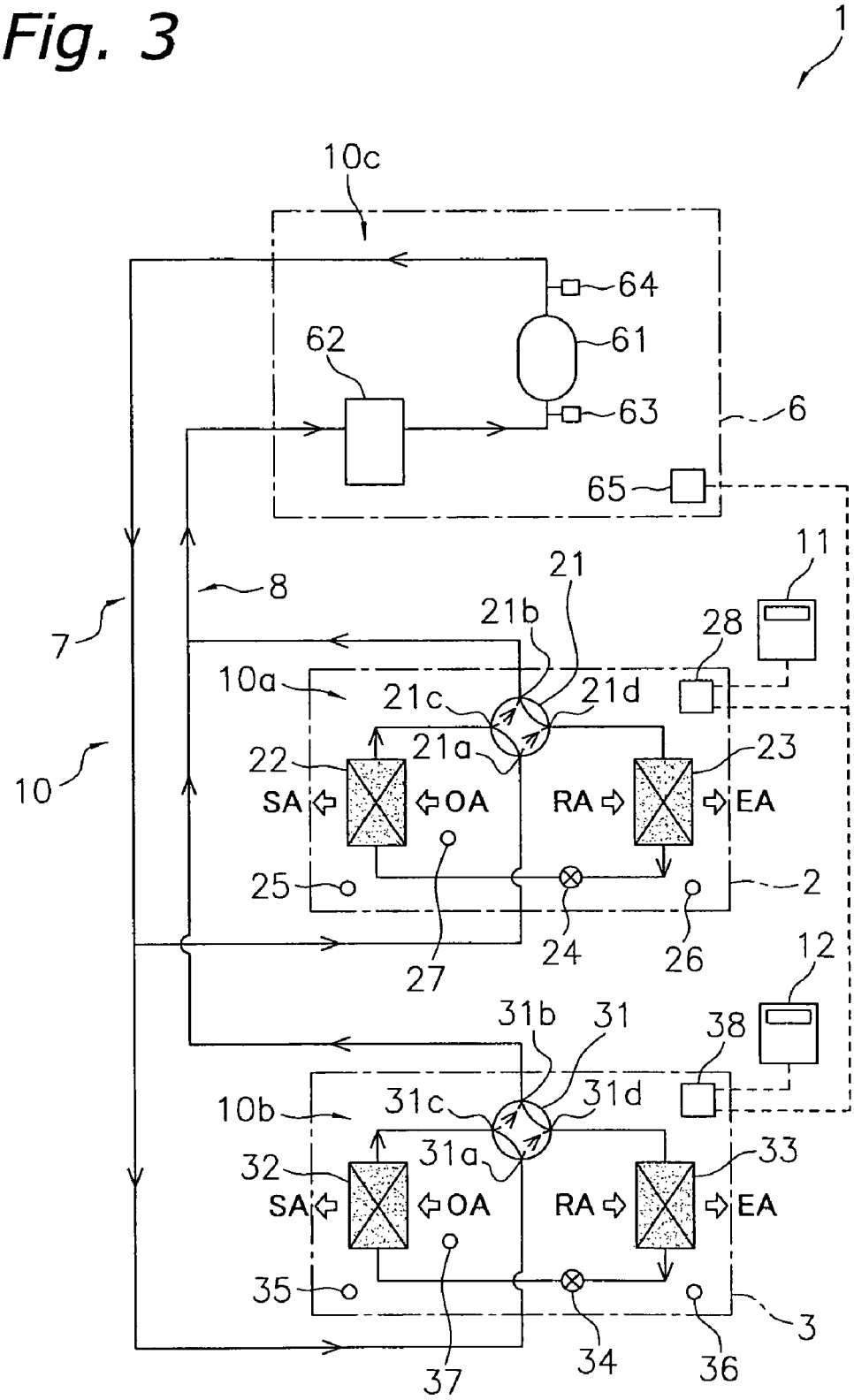
FIG. 3 is a schematic diagram of a refrigerant circuit showing the operation during the dehumidifying operation in the full ventilation mode in the air conditioning system of the first embodiment.
Figure 4:
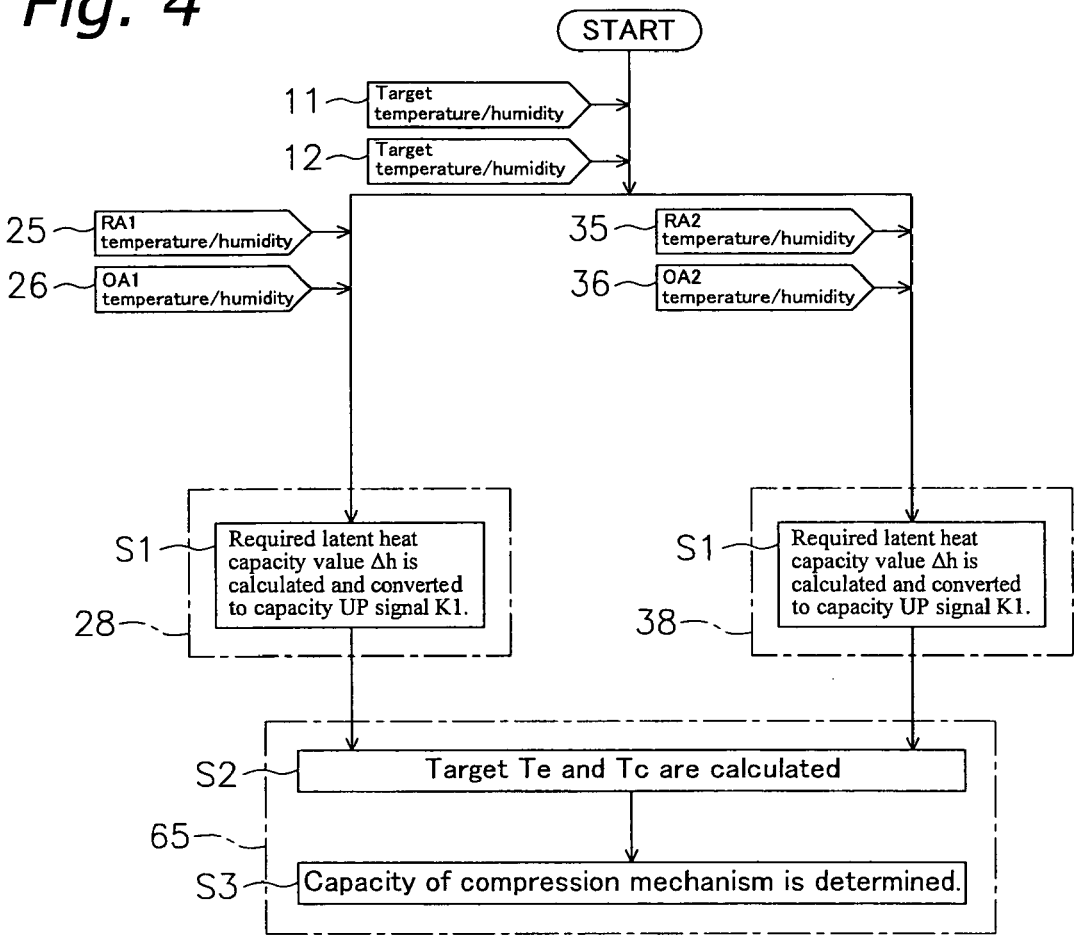
FIG. 4 is a diagram of control flow when the air conditioning system of the first embodiment is operated.

The operation of the dehumidifying operation during the full ventilation mode will be described with reference to FIGS. 2, 3, and 4. Here, FIGS. 2 and 3 are schematic diagrams of a refrigerant circuit showing the operation during the dehumidifying operation in the full ventilation mode in the air conditioning system 1. FIG. 4 is a diagram of control flow when the air conditioning system 1 is operated.

During the dehumidifying operation, as shown in FIGS. 2 and 3, for example, the utilization unit 2 alternately repeats a first operation in which the first adsorbent heat exchanger 22 functions as a condenser and the second adsorbent heat exchanger 23 functions as an evaporator, and a second operation in which that second adsorbent heat exchanger 23 functions as a condenser and the first adsorbent heat exchanger 22 functions as an evaporator. Likewise, the utilization unit 3 alternately repeats a first operation in which a first adsorbent heat exchanger 32 functions as a condenser and a second adsorbent heat exchanger 33 functions as an evaporator and, a second operation in which the second adsorbent heat exchanger 33 functions as a condenser and the first adsorbent heat exchanger 32 functions as an evaporator.

The operation of the two utilization units 2 and 3 will be described together below.

In the first operation, a regeneration process in the first adsorbent heat exchangers 22, 32 and an adsorption process in the second adsorbent heat exchangers 23, 33 are performed in parallel. During the first operation, as shown in FIG. 2, the utilization side four-way directional control valves 21, 31 are set to a first state (see the solid lines in the utilization side four-way directional control valves 21, 31 in FIG. 2). In this state, high-pressure gas refrigerant discharged from the compression mechanism 61 flows into the first adsorbent heat exchangers 22, 32 through the discharge gas connection pipe 7 and the utilization side four-way directional control valves 21, 31, and is condensed while passing through the first adsorbent heat exchangers 22, 32. The condensed refrigerant is pressure-reduced by the utilization side expansion valves 24, 34, and is subsequently evaporated while passing through the second adsorbent heat exchangers 23, 33. Then, the refrigerant is again drawn into the compression mechanism 61 through the utilization side four-way directional control valves 21, 31, the inlet gas connection pipe 8, and the accumulator 62 (see the arrows shown on the refrigerant circuit 10 in FIG. 2).

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is exhausted as the exhaust air EA through the exhaust air outlet to the outside. In the second adsorbent heat exchangers 23, 33, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the supply air outlet and is supplied as the supply air SA to the room (see the arrows shown on the both sides of the adsorbent heat exchangers 22, 23, 32, 33 in FIG. 2).

In the second operation, the adsorption process in the first adsorbent heat exchangers 22, 32 and the regeneration process in the second adsorbent heat exchangers 23, 33 are performed in parallel. During the second operation, as shown in FIG. 3, the utilization side four-way directional control valves 21, 31 are set to a second state (see the broken lines in the utilization side four-way directional control valves 21, 31 in FIG. 3). In this state, high-pressure gas refrigerant discharged from the compression mechanism 61 flows into the second adsorbent heat exchangers 23, 33 through the discharge gas connection pipe 7 and the utilization side four-way directional control valves 21, 31, and is condensed while passing through the second adsorbent heat exchangers 23, 33. The condensed refrigerant is pressure-reduced by the utilization side expansion valves 24, 34, and is subsequently evaporated while passing through the first adsorbent heat exchangers 22, 32. Then, the refrigerant is again drawn into the compression mechanism 61 through the utilization side four-way directional control valves 21, 31, the inlet gas connection pipe 8, and the accumulator 62 (see the arrows shown on the refrigerant circuit 10 in FIG. 3).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is exhausted as the exhaust air EA through the exhaust air outlet to the outside. In the first adsorbent heat exchangers 22, 32, the moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 3).

Here, the system control for the single operation performed in the air conditioning system 1 will be described.

First, when the target temperature and target relative humidity of the room air are set by remote controls 11, 12, the following information will be input into the utilization side controllers 28, 38 of the utilization units 2, 3, respectively, along with these target temperature and target relative humidity: the temperature and the relative humidity of the room air to be drawn into the units, which were detected by RA inlet temperature/humidity sensors 25, 35; and the temperature and the relative humidity of outdoor air to be drawn into the units, which were detected by OA inlet temperature/humidity sensors 26, 36.

Then, in step S1, the utilization side controllers 28, 38 calculate the target value of the enthalpy or the target absolute humidity based on the target temperature and target relative humidity of the room air; calculate the current value of the enthalpy or the current absolute humidity of the air to be drawn into the unit from the room based on the temperature and the relative humidity detected by the RA inlet temperature/humidity sensors 25, 35; and then calculate the difference between the two calculated values (hereinafter referred to as the required latent heat capacity value $\Delta h$). Here, as described above, the required latent heat capacity value $\Delta h$ is the difference between the target value of the enthalpy or target absolute humidity of the room air and the current value of the enthalpy or current absolute humidity of the room air, so that the required latent heat capacity value $\Delta h$ corresponds to the latent heat load that must be treated in the air conditioning system 1. Then, this required latent heat capacity value $\Delta h$ is converted to a capacity UP signal K1 that informs the heat source side controller 65 whether or not it is necessary to increase the treatment capacity of the utilization units 2, 3. For example, when the absolute value of $\Delta h$ is lower than a predetermined value (in other words, when the humidity of the room air is close to the target humidity and the treatment capacity does not need to be increased or decreased), the capacity UP signal K1 will be "0." When the absolute value of $\Delta h$ is higher than a predetermined value in a way that the treatment capacity needs to be increased (in other words, the humidity of the room air is higher than the target humidity during the dehumidifying operation and the treatment capacity needs to be increased), the capacity UP signal K1 will be "A," and when the absolute value of Δh is higher than a predetermined value in a way that the treatment capacity needs to be decreased (in other words, the humidity of the room air is lower than the target humidity during the dehumidifying operation, and the treatment capacity needs to be decreased), the capacity UP signal K1 will be "B."

Next, in step S2, the heat source side controller 65 calculates the target condensation temperature TcS1 and the target evaporation temperature TeS1, by using the capacity UP signal K1 of the utilization units 2, 3 transmitted from the utilization side controllers 28, 38. For example, the target condensation temperature TcS1 is calculated by adding the capacity UP signal K1 of the utilization units 2, 3 to the current target condensation temperature. In addition, the target evaporation temperature TeS1 is calculated by subtracting the capacity UP signal K1 of the utilization units 2, 3 from the current target evaporation temperature. Accordingly, when a value of the capacity UP signal K1 is "A," the target condensation temperature TcS1 will be high and the target evaporation temperature TeS1 will be low.

Next in step S3, a system condensation temperature Tc1 and a system evaporation temperature Te1, which respectively correspond to measured values of the condensation temperature and the evaporation temperature of the entire air conditioning system 1, are calculated. For example, the system condensation temperature Tc1 and the system evaporation temperature Te1 are calculated by converting the inlet pressure of the compression mechanism 61 detected by the inlet pressure sensor 63 and the discharge pressure of the compression mechanism 61 detected by the discharge pressure sensor 64 to the saturation temperatures of the refrigerant at these pressures. Then, the temperature difference ΔTc1 between the system condensation temperature Tc1 and the target condensation temperature TcS1 and the temperature difference ΔTe1 between the system evaporation temperature Te1 and the target evaporation temperature TeS1 are calculated. Then, based on the subtraction between these temperature differences, the necessity and amount of the increase or decrease in the operational capacity of the compression mechanism 61 will be determined.

By using thus determined operational capacity of the compression mechanism 61 to control the operational capacity of the compression mechanism 61, the system control to aim the target temperature and target relative humidity of the room air is performed. The system control is performed such that, for example, when a value determined by subtracting the temperature difference ΔTe1 from the temperature difference ΔTc1 is a positive value, the operational capacity of the compression mechanism 61 is increased, whereas when a value determined by subtracting the temperature difference ΔTe1 from the temperature difference ΔTc1 is a negative value, the operational capacity of the compression mechanism 61 is decreased.

Figure 5:
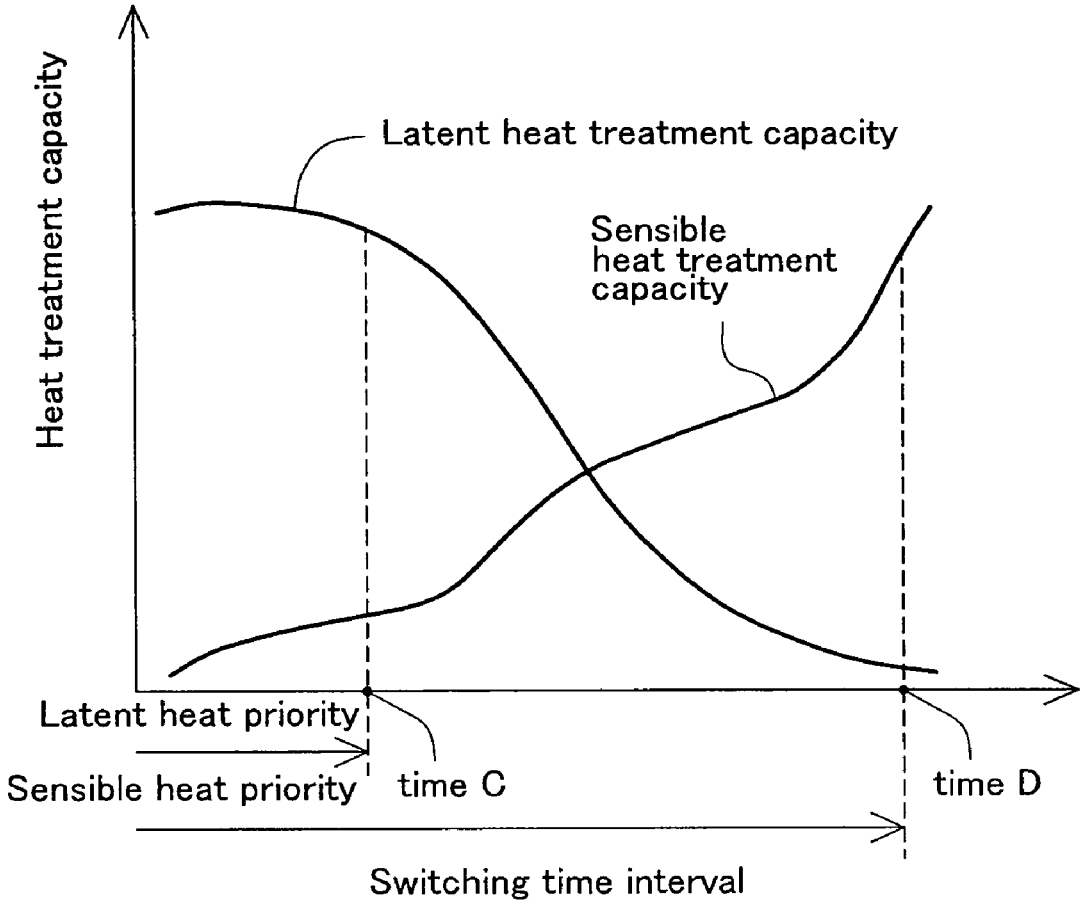
FIG. 5 is a graph indicating a latent heat treatment capacity and a sensible heat treatment capacity in adsorbent heat exchanger, with a switching time interval between an adsorption process and a regeneration process as a horizontal axis.

Here, through these adsorption process and regeneration process, the first adsorbent heat exchangers 22, 32 and the second adsorbent heat exchangers 23, 33 perform not only a treatment to adsorb moisture in the air and desorb the adsorbed moisture back into the air (hereinafter referred to as the latent heat treatment) but also a treatment to cool or heat the passing air to change the temperature thereof (hereinafter referred to as the sensible heat treatment). The graph in FIG. 5 shows the latent heat treatment capacity and the sensible heat treatment capacity which are obtained in the adsorbent heat exchanger, with the switching time interval between the first operation and the second operation, i.e., the adsorption process and the regeneration process as a horizontal axis. This graph shows that, when the switching time interval is made shorter (time C in FIG. 5, referred to as the latent heat priority mode), the latent heat treatment, i.e., a treatment to adsorb moisture in the air and desorb the moisture back into the air, is preferentially performed. On the other hand, when the switching time interval is made longer (time D in FIG. 5, referred to as the sensible heat priority mode), the sensible heat treatment, i.e., a treatment to heat or cool the air to change the temperature thereof, is preferentially performed. This is because, for example, when air is contacted with one of the first adsorbent heat exchangers 22, 32 and one of the second adsorbent heat exchangers 23, 33, whichever are acting as evaporators, at first, mainly moisture is adsorbed by the adsorbent provided on the surface of these heat exchangers, so that the absorption heat thus generated will be treated; however, once an amount of moisture close to the maximum moisture adsorption capacity of the adsorbent is adsorbed, then mainly, air will be cooled. This is also because when air is contacted with one of the first adsorbent heat exchangers 22, 32 and one of the second adsorbent heat exchangers 23, 33, whichever are acting as condensers, at first, mainly the moisture that was adsorbed onto the adsorbent provided on the surface of these heat exchangers is desorbed back into the air because of the heated adsorbent; however, once almost all the moisture adsorbed onto the adsorbent is desorbed, then mainly, air will be heated. Further, by changing this switching time interval by a command from the utilization side controllers 28, 38, the ratio of the sensible heat treatment capacity to the latent heat treatment capacity (hereinafter referred to as the sensible heat treatment capacity ratio) can be changed. Note that, as described below, the switching time interval is set to time C, i.e., set in the latent heat priority mode, since the air conditioning system 1 mainly performs the latent heat treatment during normal operation.

In this way, in the dehumidifying operation in the full ventilation mode, this air conditioning system 1 can perform the cooling operation in which dehumidification of outdoor air is performed, and simultaneously cooling is performed using the sensible heat treatment capacity that is obtained according to the switching time interval and the cooled air is supplied to the room.

Figure 6:
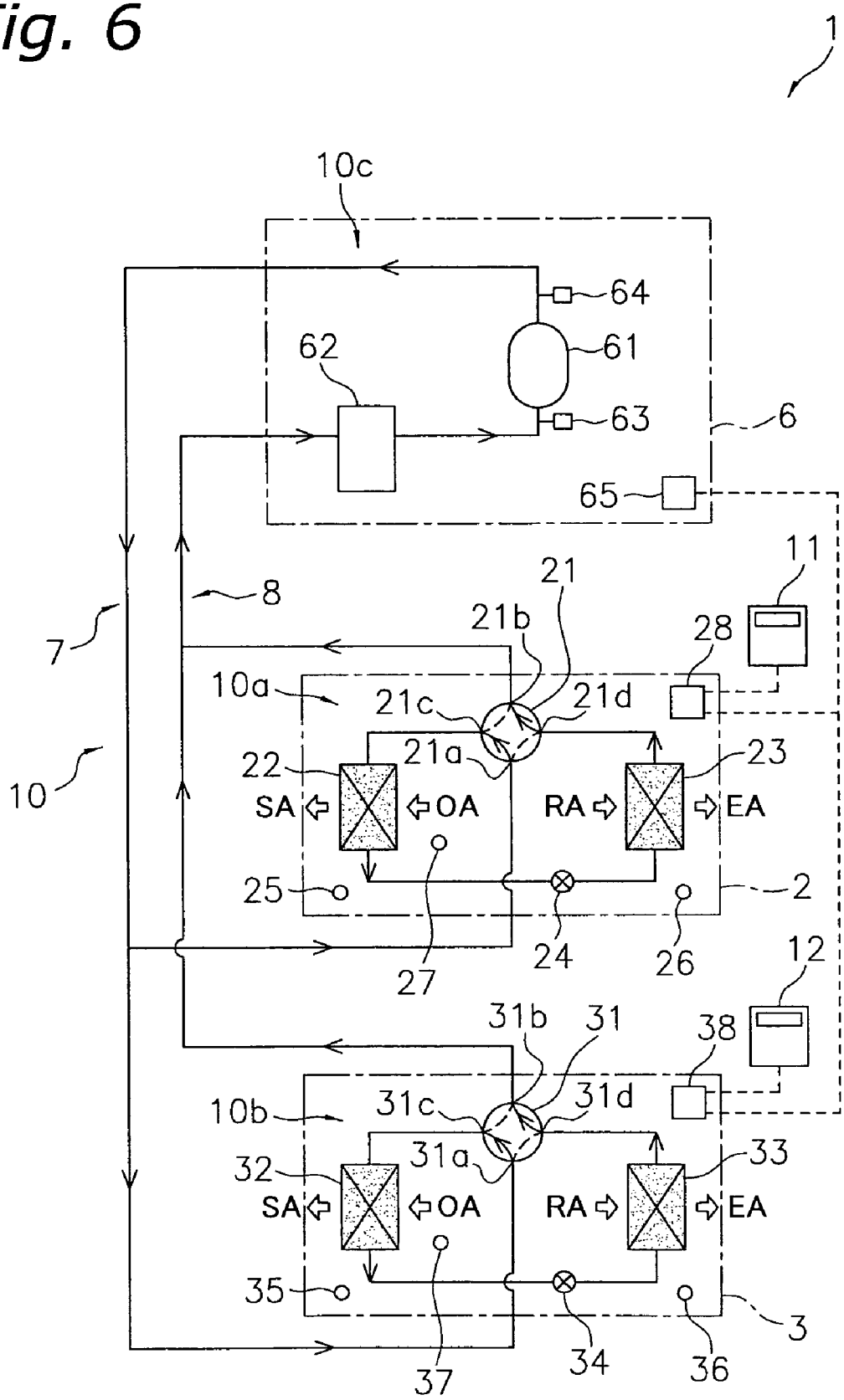
FIG. 6 is a schematic diagram of a refrigerant circuit showing the operation during a humidifying operation in the full ventilation mode in the air conditioning system of the first embodiment.
Figure 7:
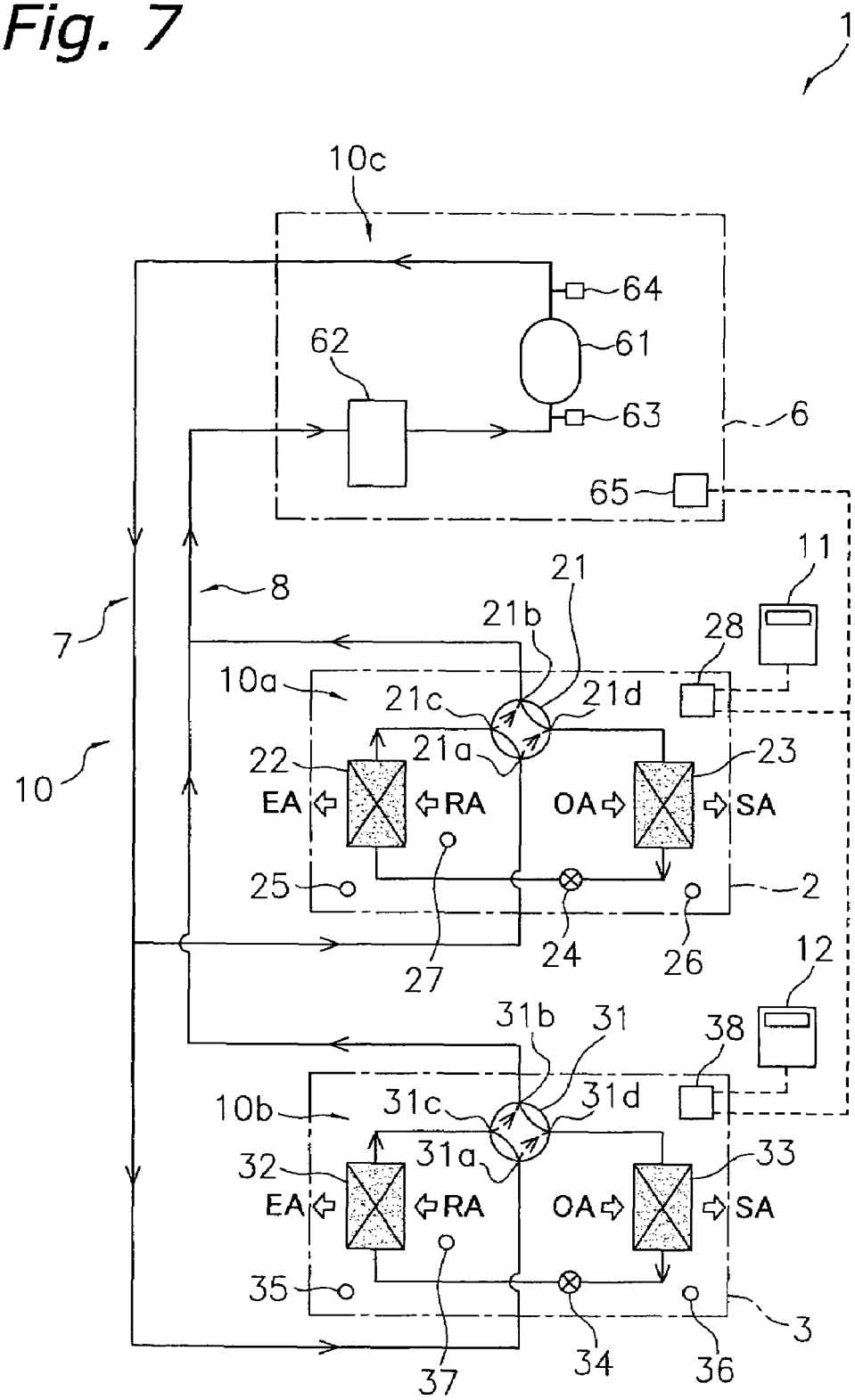
FIG. 7 is a schematic diagram of a refrigerant circuit showing the operation during the humidifying operation in the full ventilation mode in the air conditioning system of the first embodiment.

The operation during the humidifying operation in the full ventilation mode will be described with reference to FIGS. 6 and 7. Here, FIGS. 6 and 7 are schematic diagrams of a refrigerant circuit showing the operation during the humidifying operation in the full ventilation mode in the air conditioning system 1. Note that the system control that is performed in the air conditioning system 1 is the same as the system control for the above-described dehumidifying operation in the full ventilation mode, so that a description thereof will be omitted.

During the humidifying operation, as shown in FIGS. 6 and 7, for example, the utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator.

Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the outdoor air OA that was drawn from the outside air inlet. The moisture desorbed from the first adsorbent heat exchangers 22, 32 is carried with outdoor air OA and is supplied as the supply air SA through the supply air outlet to the room. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the exhaust air outlet and is exhausted as the exhaust air EA to the outside (see the arrows shown on the both sides of the adsorbent heat exchangers 22, 23, 32, 33 in FIG. 6).

During the second operation, in the second adsorbent heat exchangers 23, 33, moisture is desorbed from the adsorbent heated by condensation of the refrigerant, and this desorbed moisture is added to the outdoor air OA that was drawn from the outside air inlet. The moisture desorbed from the second adsorbent heat exchangers 23, 33 is carried with outdoor air OA and is supplied as the supply air SA through the supply air outlet to the room. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the exhaust air outlet and is exhausted as the exhaust air EA to the outside (see the arrows shown on the both sides of the adsorbent heat exchangers 22, 23, 32, 33 in FIG. 7).

Here, the first adsorbent heat exchangers 22, 32 and second adsorbent heat exchangers 23, 33 treat not only the latent heat but also the sensible heat, as in the case of the dehumidifying operation in the full ventilation mode.

In this way, in the humidifying operation in the full ventilation mode, this air conditioning system 1 can perform the humidifying operation in which humidification of outdoor air is performed, and simultaneously heating is performed using the sensible heat treatment capacity that is obtained according to the switching time interval and the heated air is supplied to the room.

<Circulation Mode>

Next, the dehumidifying operation and the humidifying operation in a circulation mode will be described. In the circulation mode, when the air supply fan and the exhaust fan of the units 2, 3 are operated, the room air RA is drawn through the indoor air inlets into the units, and is supplied as the supply air SA through the supply air outlets to the room, while outdoor air OA is drawn through the outside air inlets into the units, and is exhausted as the exhaust air EA through the exhaust air outlets to the outside.

Figure 8:
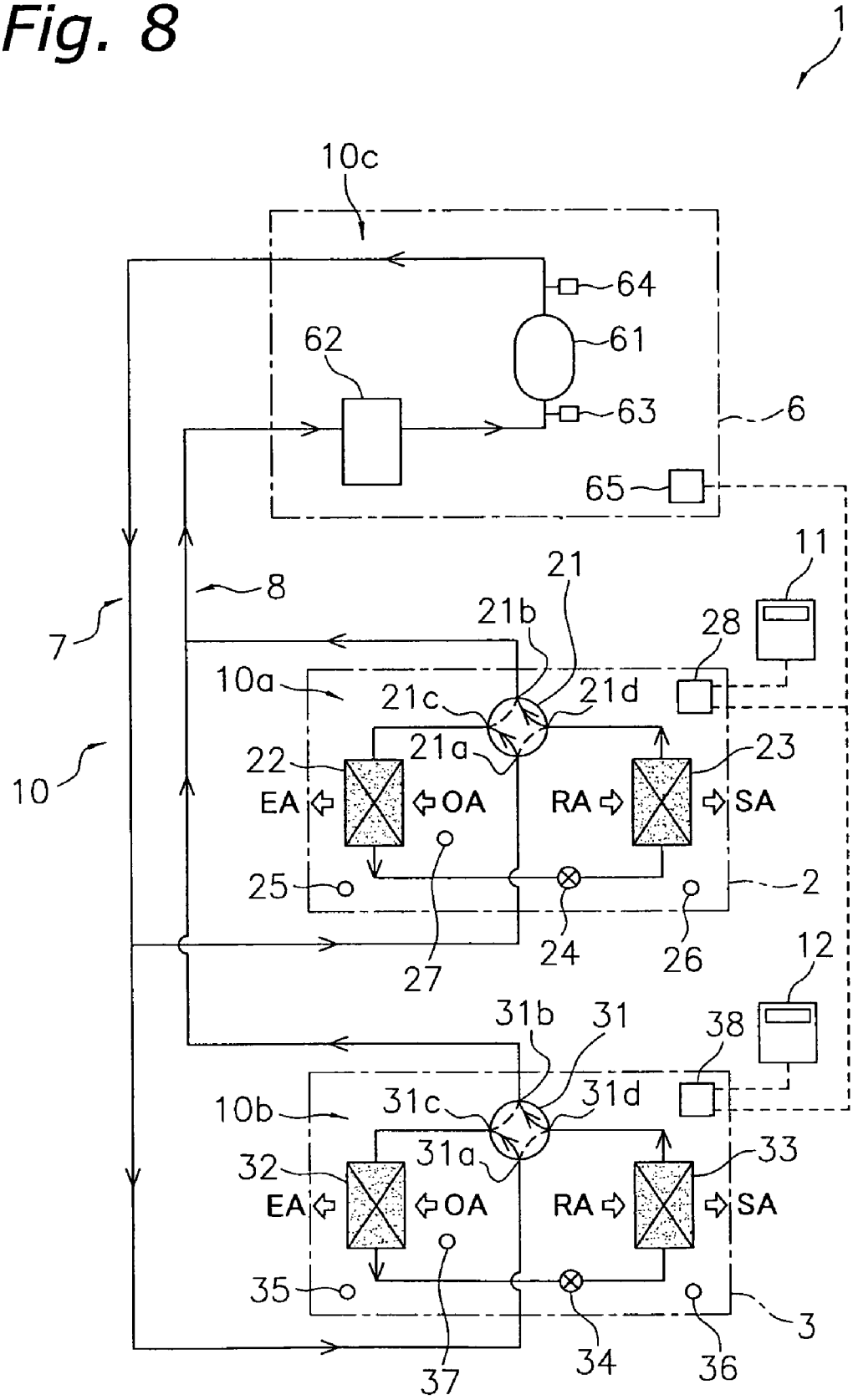
FIG. 8 is a schematic diagram of a refrigerant circuit showing the operation during the dehumidifying operation in a circulation mode in the air conditioning system of the first embodiment.
Figure 9:
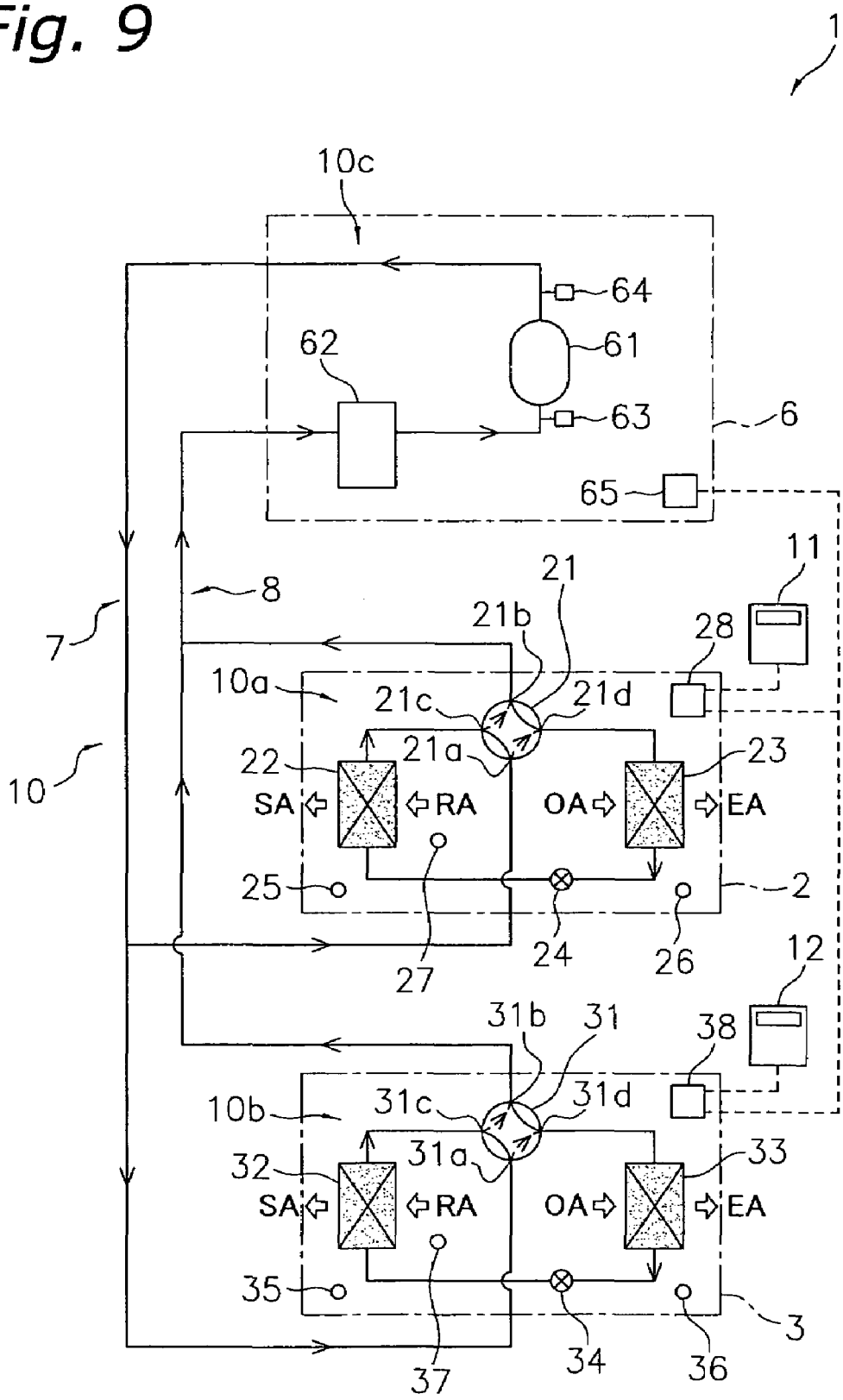
FIG. 9 is a schematic diagram of a refrigerant circuit showing the operation during the dehumidifying operation in the circulation mode in the air conditioning system of the first embodiment.

The operation during the dehumidifying operation in the circulation mode will be described with reference to FIGS. 8 and 9. Here, FIGS. 8 and 9 are schematic diagrams of a refrigerant circuit showing the operation during the dehumidifying operation in the circulation mode in the air conditioning system 1. Note that the system control that is performed in the air conditioning system 1 is the same as the system control for the above-described dehumidifying operation in the full ventilation mode, so that a description thereof will be omitted.

During the dehumidifying operation, as shown in FIGS. 8 and 9, for example, the utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the outdoor air OA that is drawn from the outside air inlet. The moisture desorbed from the first adsorbent heat exchangers 22, 32 is carried with the outdoor air OA and is exhausted as the exhaust air EA through the exhaust air outlet to the outside. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the supply air outlet and is supplied as the supply air SA to the room (see the arrows shown on the both sides of the adsorbent heat exchangers 22, 23, 32, 33 in FIG. 8).

During the second operation, in the second adsorbent heat exchangers 23, 33, moisture is desorbed from the adsorbent heated by condensation of the refrigerant, and this desorbed moisture is added to the outdoor air OA that is drawn from the outside air inlet. The moisture desorbed from the second adsorbent heat exchangers 23, 33 is carried with the outdoor air OA and is exhausted as the exhaust air EA through the exhaust air outlet to the outside. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 9).

Here, the first adsorbent heat exchangers 22, 32 and second adsorbent heat exchangers 23, 33 treat not only the latent heat but also the sensible heat.

In this way, in the dehumidifying operation in the circulation mode, this air conditioning system 1 can perform the dehumidifying operation in which dehumidification of room air, and simultaneously cooling is performed using the sensible heat treatment capacity that is obtained according to the switching time interval and the cooled air is supplied to the room.

Figure 10:
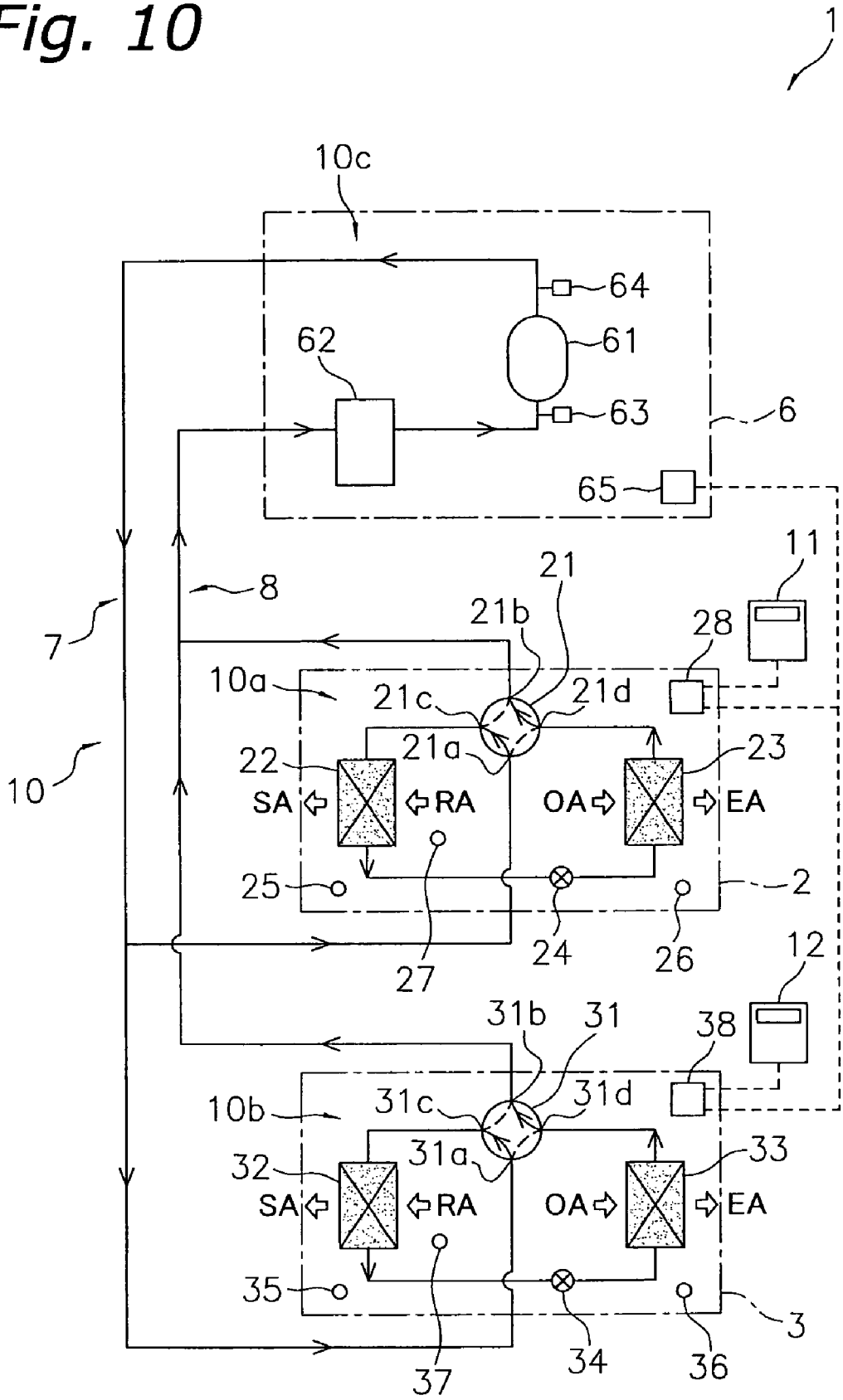
FIG. 10 is a schematic diagram of a refrigerant circuit showing the operation during the humidifying operation in the circulation mode in the air conditioning system of the first embodiment.
Figure 11:
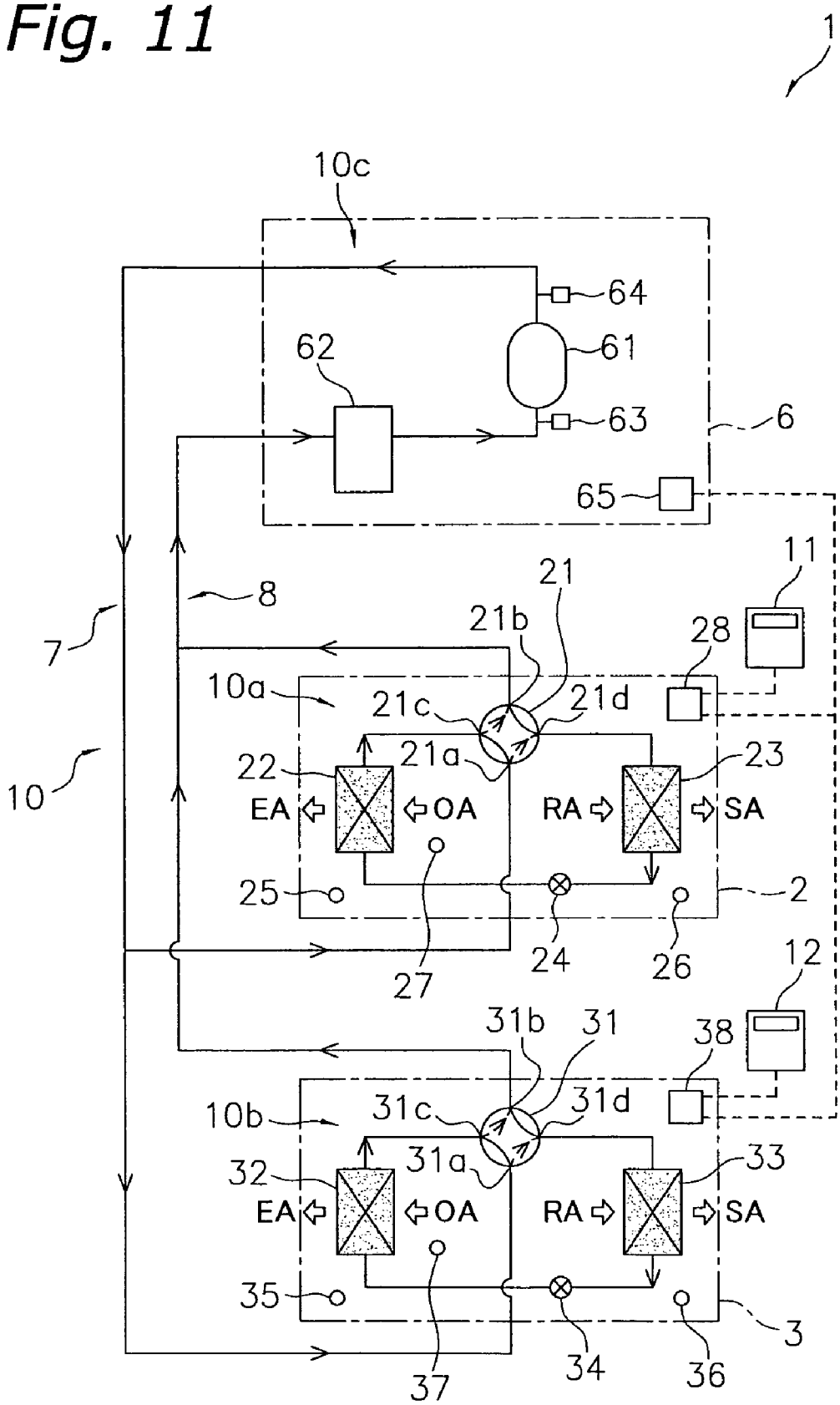
FIG. 11 is a schematic diagram of a refrigerant circuit showing the operation during the humidifying operation in the circulation mode in the air conditioning system of the first embodiment.

The operation during humidifying operation in the circulation mode will be described with reference to FIGS. 10 and 11. Here, FIGS. 10 and 11 are schematic diagrams of a refrigerant circuit showing the operation during a dehumidifying operation in the circulation mode in the air conditioning system 1. Note that the system control being performed in the air conditioning system 1 is the same as the system control for the above-described dehumidifying operation in the full ventilation mode, so that a description thereof will be omitted.

During the humidifying operation, as shown in FIGS. 10 and 11, for example, the utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is supplied as the supply air SA through the supply air outlet to the room. In the second adsorbent heat exchangers 23, 33, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the exhaust air outlet and exhausted as the exhaust air EA to the outside (see the arrows shown on the both sides of the adsorbent heat exchangers 22, 23, 32, 33 in FIG. 10).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is supplied as the supply air SA through the supply air outlet to the room. In the first adsorbent heat exchangers 22, 32, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the exhaust air outlet and is exhausted as the exhaust air EA to the outside (see the arrows shown on the both sides of the adsorbent heat exchangers 22, 23, 32, 33 in FIG. 11).

Here, the first adsorbent heat exchangers 22, 32 and second adsorbent heat exchangers 23, 33 treat not only the latent heat but also the sensible heat, as in the case of the dehumidifying operation in the full ventilation mode.

In this way, in the humidifying operation in the circulation mode, this air conditioning system 1 can perform the humidifying and heating operation in which humidification of room air is performed, and simultaneously heating is performed using the sensible heat treatment capacity that is obtained according to the switching time interval and the heated air is supplied to the room.

<Air Supply Mode>

Next, the dehumidifying operation and the humidifying operation in an air supply mode will be described. In the air supply mode, when the air supply fan and the exhaust fan of the utilization units 2, 3 are operated, outdoor air OA is drawn through the outside air inlets into the units, and is supplied as the supply air SA through the supply air outlets to the room, while outdoor air OA is drawn through the outside air inlets into the units, and is exhausted as the exhaust air EA through the exhaust air outlets to the outside.

Figure 12:
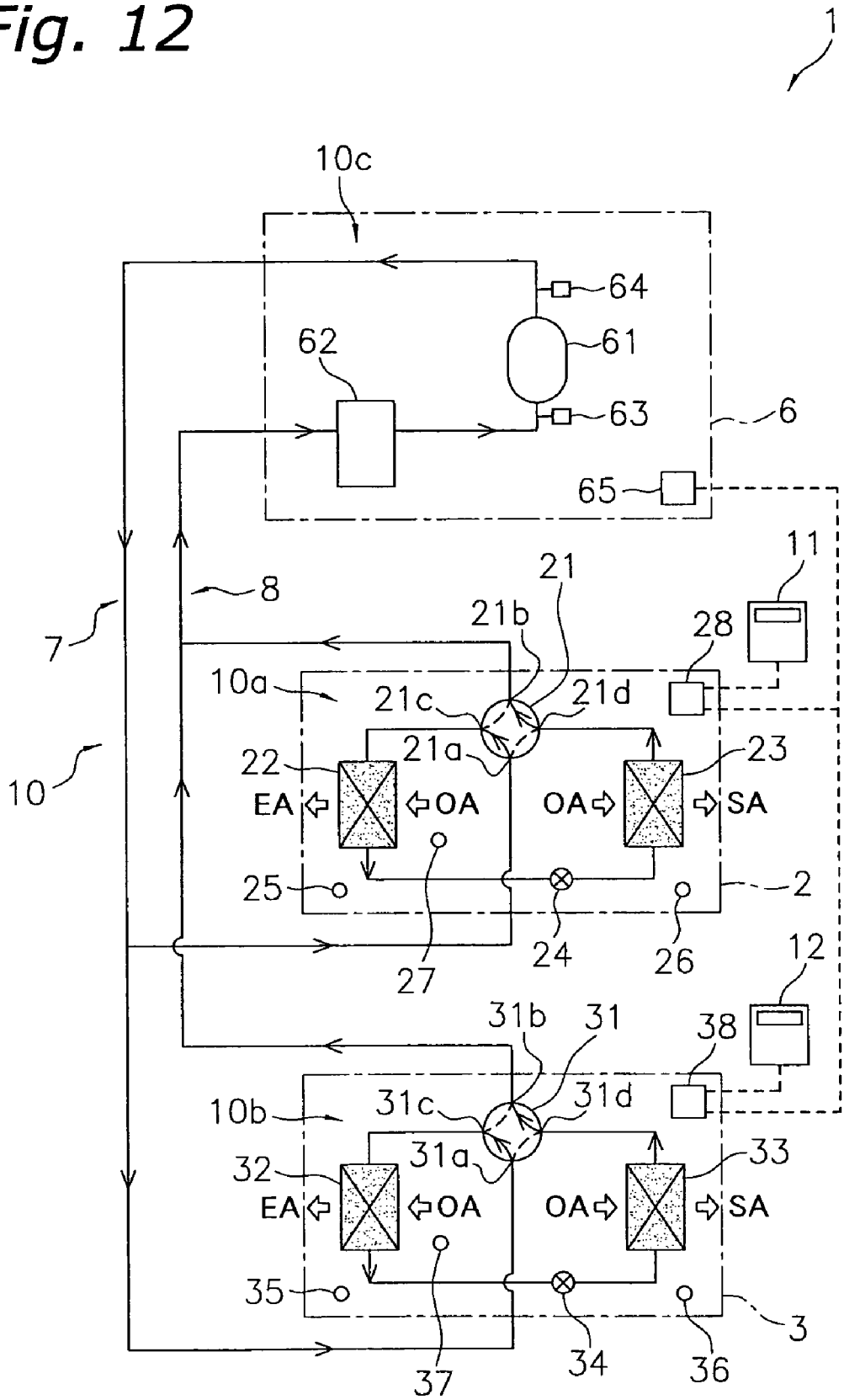
FIG. 12 is a schematic diagram of a refrigerant circuit showing the operation during the dehumidifying operation in a supply mode in the air conditioning system of the first embodiment.
Figure 13:
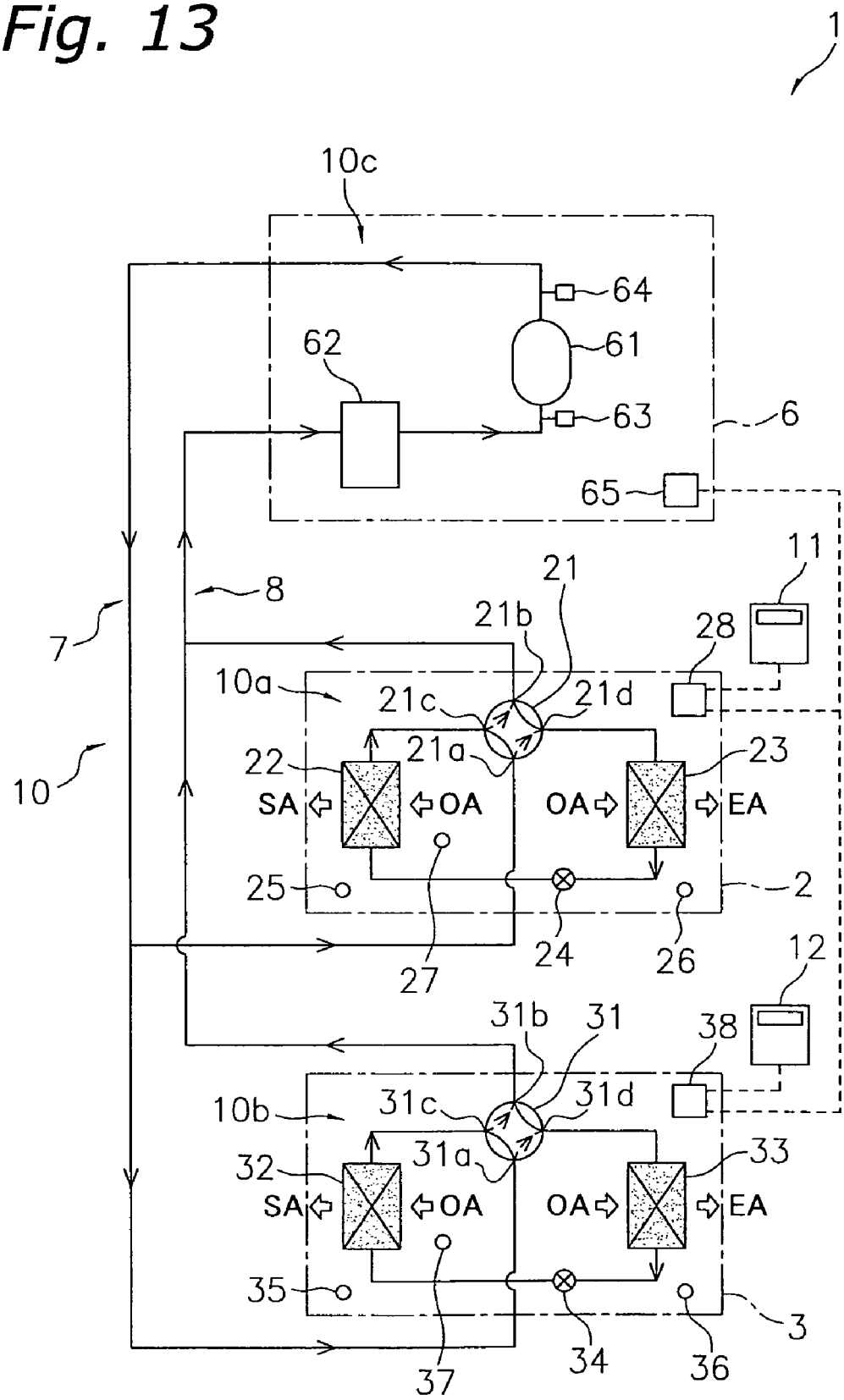
FIG. 13 is a schematic diagram of a refrigerant circuit showing the operation during the dehumidifying operation in the supply mode in the air conditioning system of the first embodiment.

The operation during the dehumidifying operation in the air supply mode will be described with reference to FIGS. 12 and 13. Here, FIGS. 12 and 13 are schematic diagrams of a refrigerant circuit showing the operation during the dehumidifying operation in the supply mode in the air conditioning system 1. Note that the system control that is performed in the air conditioning system 1 is the same as the system control for the above-described dehumidifying operation in the full ventilation mode, so that a description thereof will be omitted.

During the dehumidifying operation, as shown in FIGS. 12 and 13, for example, the utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the utilization unit 3 alternately repeats the first operation in which the first adsorbent heat exchanger 32 functions as a condenser and the second adsorbent heat exchanger 33 functions as an evaporator, and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the outdoor air OA that is drawn from the outside air inlet. The moisture desorbed from the first adsorbent heat exchangers 22, 32 is carried with the outdoor air OA and is exhausted as the exhaust air EA through the exhaust air outlet to the outside. In the second adsorbent heat exchangers 23, 33, the moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the supply air outlet and is supplied as the supply air SA to the room (see the arrows shown on the both sides of the adsorbent heat exchangers 22, 23, 32, 33 in FIG. 12).

During the second operation, in the second adsorbent heat exchangers 23, 33, moisture is desorbed from the adsorbent heated by condensation of the refrigerant, and this desorbed moisture is added to the outdoor air OA that is drawn from the outside air inlet. The moisture desorbed from the second adsorbent heat exchangers 23, 33 is carried with the outdoor air OA and is exhausted as the exhaust air EA through the exhaust air outlet to the outside. In the first adsorbent heat exchangers 22, 32, the moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 13).

Here, the first adsorbent heat exchangers 22, 32 and second adsorbent heat exchangers 23, 33 treat not only the latent heat but also the sensible heat.

In this way, in the dehumidifying operation in the air supply mode, this air conditioning system 1 can perform the dehumidifying operation in which outdoor air is dehumidified, and simultaneously cooling is performed using the sensible heat treatment capacity that is obtained according to the switching time interval and the cooled air is supplied to the room.

Figure 14:
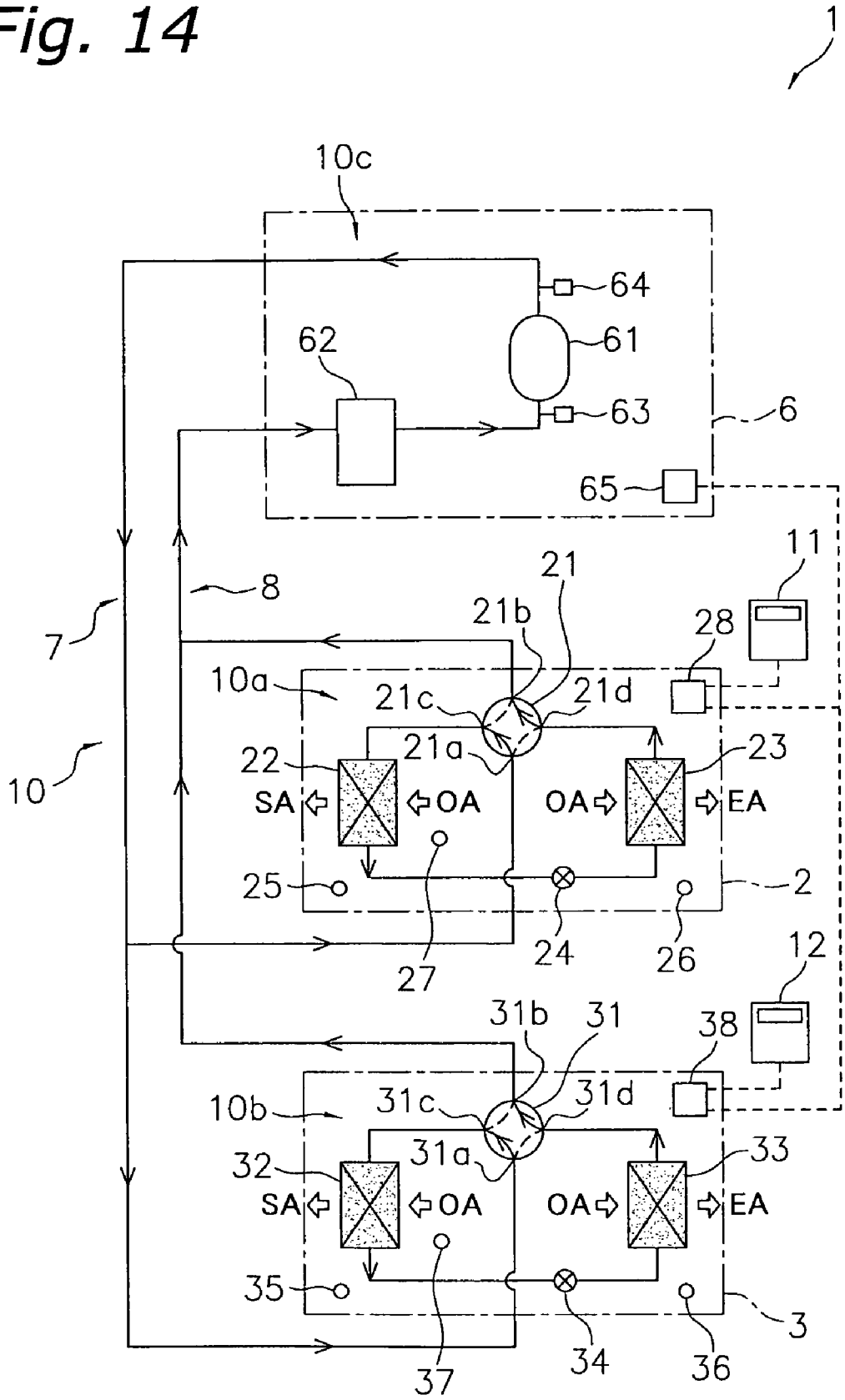
FIG. 14 is a schematic diagram of a refrigerant circuit showing the operation during the humidifying operation in the supply mode in the air conditioning system of the first embodiment.
Figure 15:
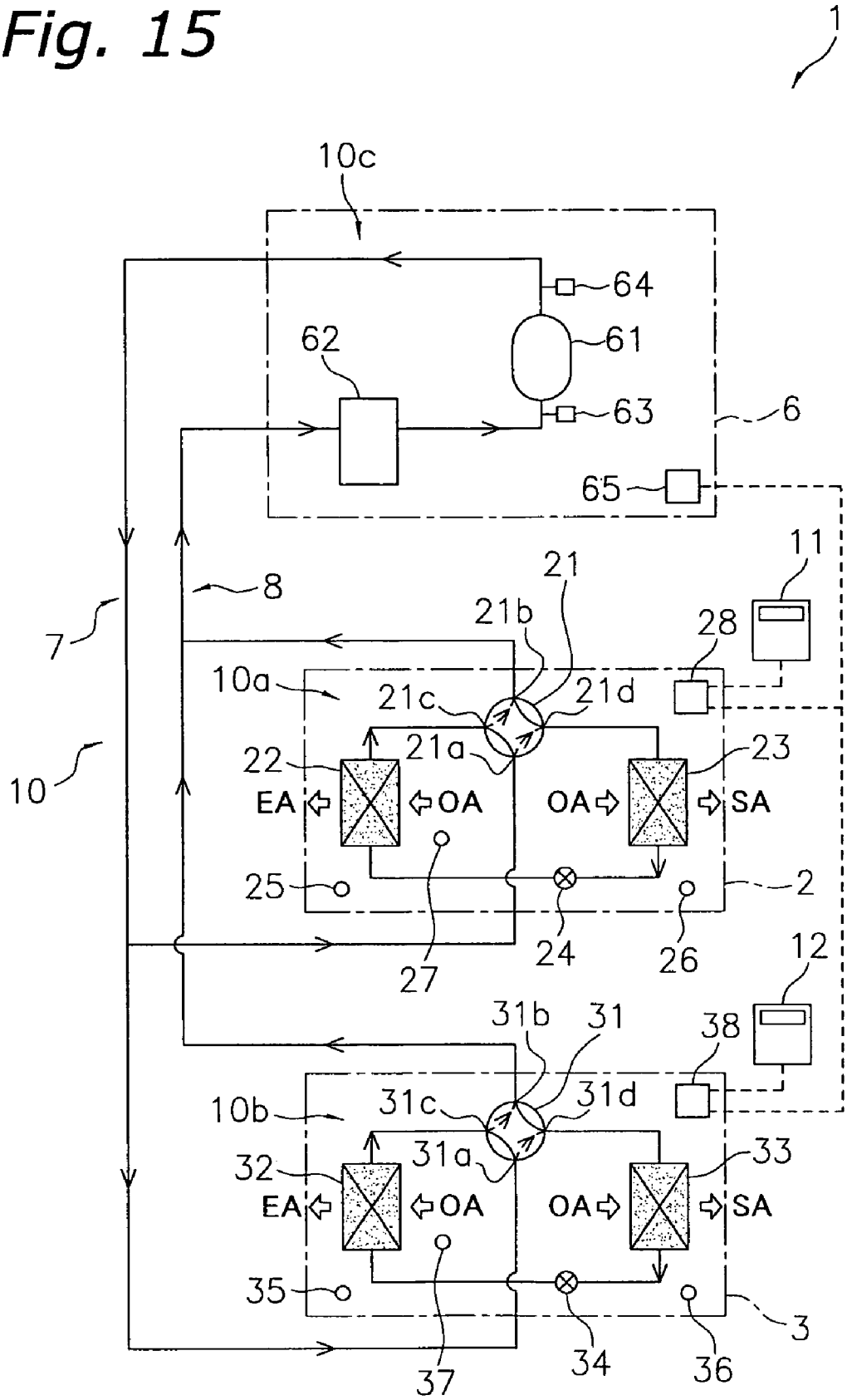
FIG. 15 is a schematic diagram of a refrigerant circuit showing the operation during the humidifying operation in the supply mode in the air conditioning system of the first embodiment.

The operation during the humidifying operation in the air supply mode will be described with reference to FIGS. 14 and 15. Here, FIGS. 14 and 15 are schematic diagrams of a refrigerant circuit showing the operation during the humidifying operation in the supply mode in the air conditioning system 1. Note that the system control that is performed in the air conditioning system 1 is the same as the system control for the above-described dehumidifying operation in the full ventilation mode, so that a description thereof will be omitted.

During the humidifying operation, as shown in FIGS. 14 and 15, for example, the utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the outdoor air OA that is drawn from the outside air inlet. The moisture desorbed from the first adsorbent heat exchangers 22, 32 is carried with outdoor air OA and is supplied as the supply air SA through the supply air outlet to the room. In the second adsorbent heat exchangers 23, 33, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 23, 33 passes through the exhaust air outlet and is exhausted as the exhaust air EA to the outside (see the arrows shown on the both sides of the adsorbent heat exchangers 22, 23, 32, 33 in FIG. 14).

During the second operation, in the second adsorbent heat exchangers 23, 33, moisture is desorbed from the adsorbent heated by condensation of the refrigerant, and this desorbed moisture is added to the outdoor air OA that was drawn from the outside air inlet. The moisture desorbed from the second adsorbent heat exchangers 23, 33 is carried with outdoor air OA and is supplied as the supply air SA through the supply air outlet to the room. In the first adsorbent heat exchangers 22, 32, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 22, 32 passes through the exhaust air outlet and is exhausted as the exhaust air EA to the outside (see the arrows shown on the both sides of the adsorbent heat exchangers 22, 23, 32, 33 in FIG. 15).

Here, the first adsorbent heat exchangers 22, 32 and second adsorbent heat exchangers 23, 33 treat not only the latent heat but also the sensible heat.

In this way, in the humidifying operation in the air supply mode, this air conditioning system 1 can perform the humidifying operation in which humidification of outdoor air is performed, and simultaneously heating is performed using the sensible heat treatment capacity that is obtained according to the switching time interval and the heated air is supplied to the room.

<Exhaust Mode>

Next, the dehumidifying operation and the humidifying operation in a exhaust mode will be described. In the exhaust mode, when the air supply fan and the exhaust fan of the utilization units 2, 3 are operated, the room air RA is drawn through the indoor air inlets into the units, and is supplied as the supply air SA through the supply air outlets to the room, while the room air RA is drawn through the indoor air inlets into the units, and is exhausted as the exhaust air EA through the exhaust air outlets to the outside.

Figure 16:
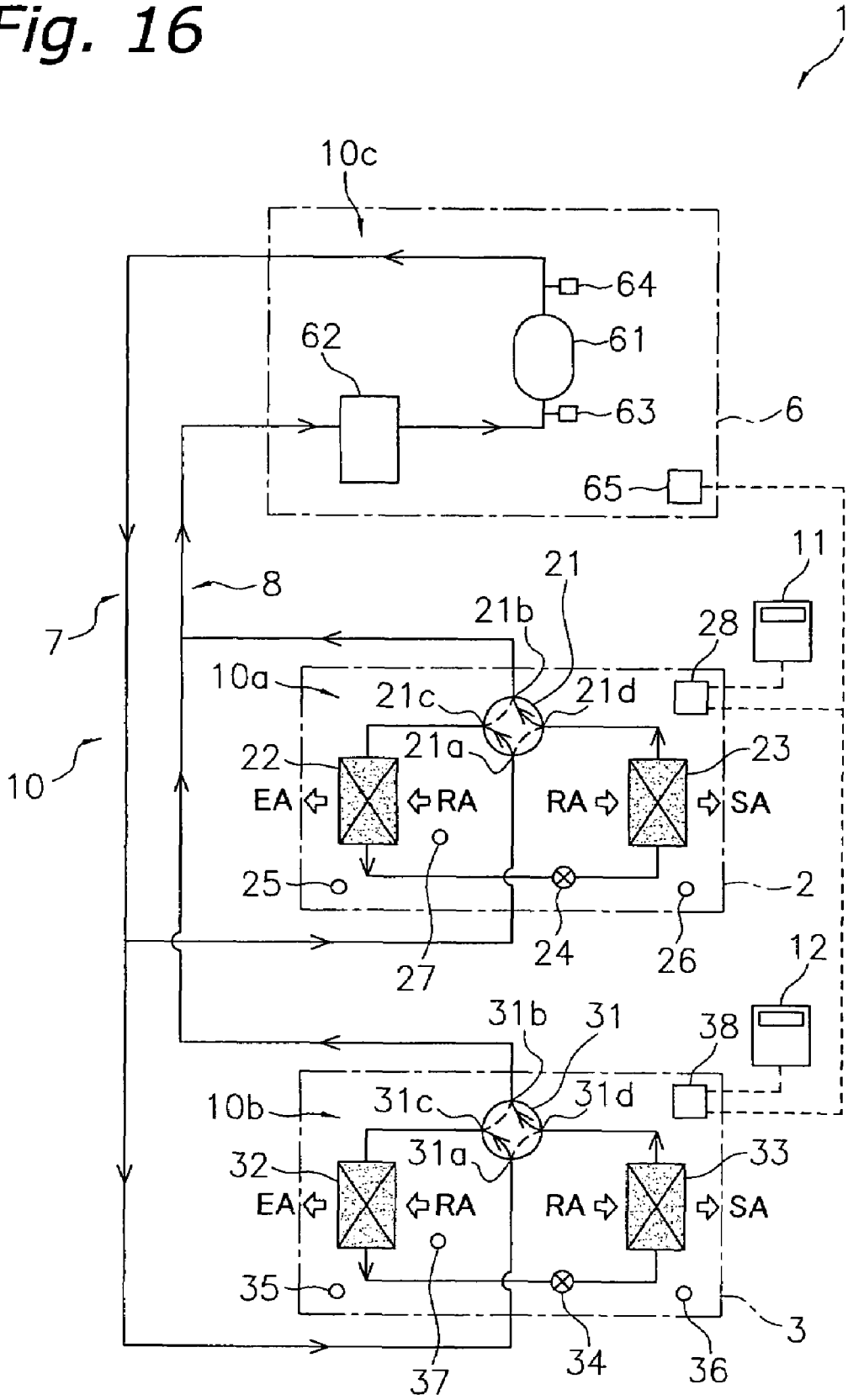
FIG. 16 is a schematic diagram of a refrigerant circuit showing the operation during the dehumidifying operation in a exhaust mode in the air conditioning system of the first embodiment.
Figure 17:
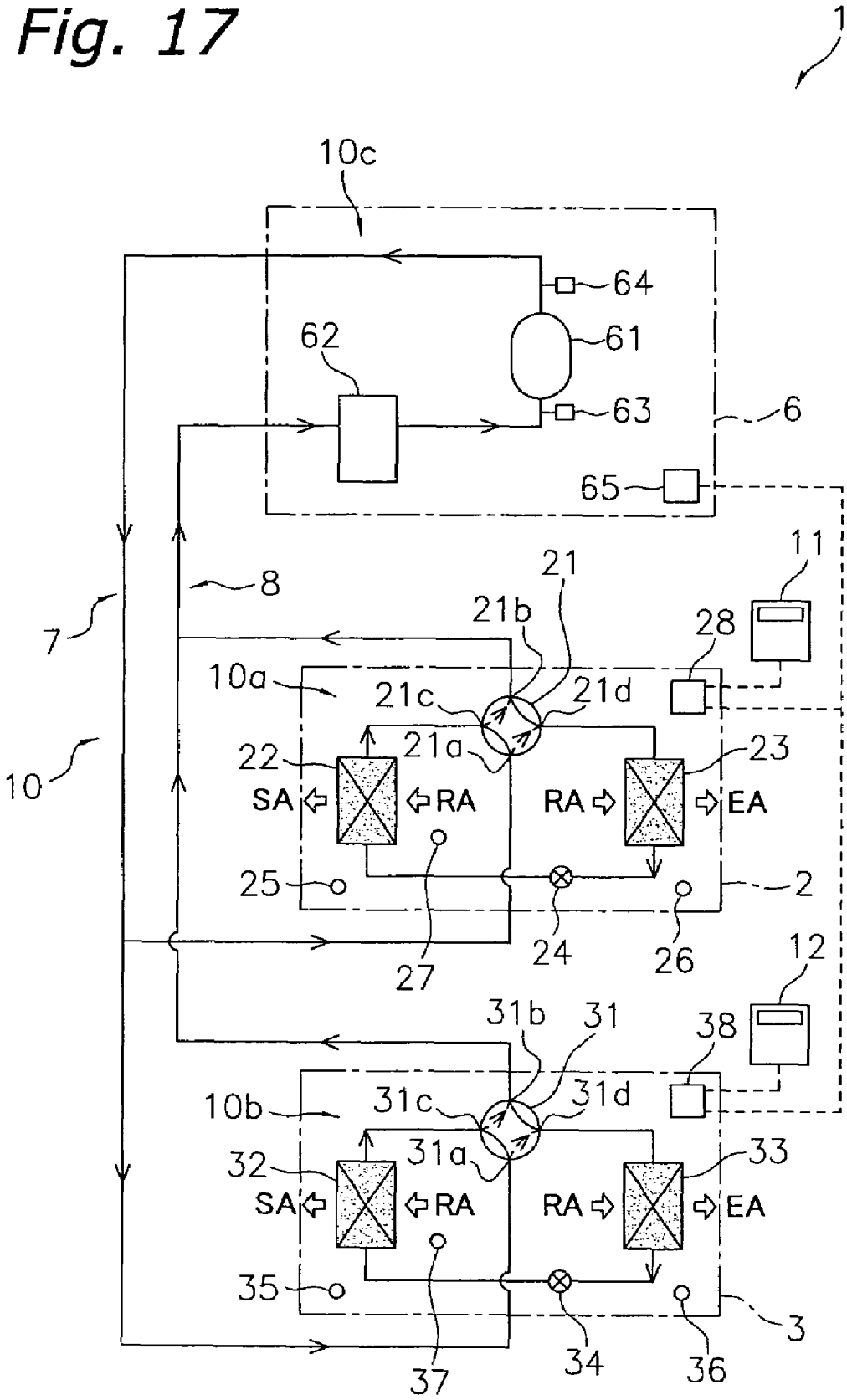
FIG. 17 is a schematic diagram of a refrigerant circuit showing the operation during the dehumidifying operation in the exhaust mode in the air conditioning system of the first embodiment.

The operation during the dehumidifying operation in the exhaust mode will be described with reference to FIGS. 16 and 17. Here, FIGS. 16 and 17 are schematic diagrams of a refrigerant circuit showing the operation during the dehumidifying operation in the exhaust mode in the air conditioning system 1. Note that the system control that is performed in the air conditioning system 1 is the same as the system control for the above-described dehumidifying operation in the full ventilation mode, so that a description thereof will be omitted.

During the dehumidifying operation, as shown in FIGS. 16 and 17, for example, the utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is exhausted as the exhaust air EA through the exhaust air outlet to the outside. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the supply air outlets and is supplied as the supply air SA to the room (see the arrows shown on the both sides of the adsorbent heat exchangers 22, 23, 32, 33 in FIG. 16).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is exhausted as the exhaust air EA through the exhaust air outlet to the outside. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the supply air outlet and is supplied as the supply air SA to the room (see the arrows shown on the both sides of the adsorbent heat exchangers 22, 23, 32, 33 in FIG. 17).

Here, the first adsorbent heat exchangers 22, 32 and second adsorbent heat exchangers 23, 33 treat not only the latent heat but also the sensible heat.

In this way, in the dehumidifying operation in the exhaust mode, this air conditioning system 1 can perform the dehumidifying operation in which dehumidification of room air is performed, and simultaneously cooling is performed using the sensible heat treatment capacity that is obtained according to the switching time interval and the cooled air is supplied to the room.

Figure 18:
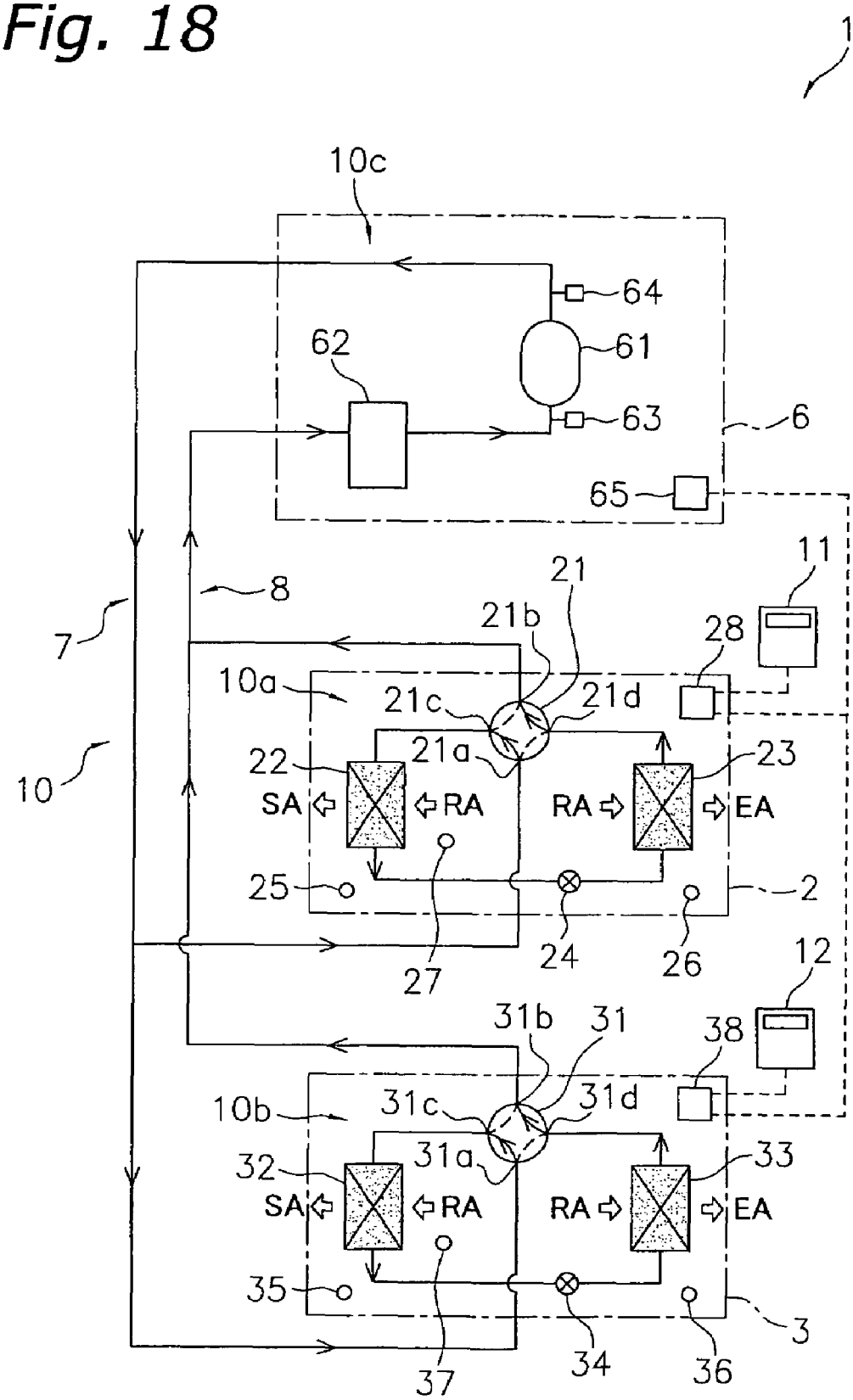
FIG. 18 is a schematic diagram of a refrigerant circuit showing the operation during the humidifying operation in the exhaust mode in the air conditioning system of the first embodiment.
Figure 19:
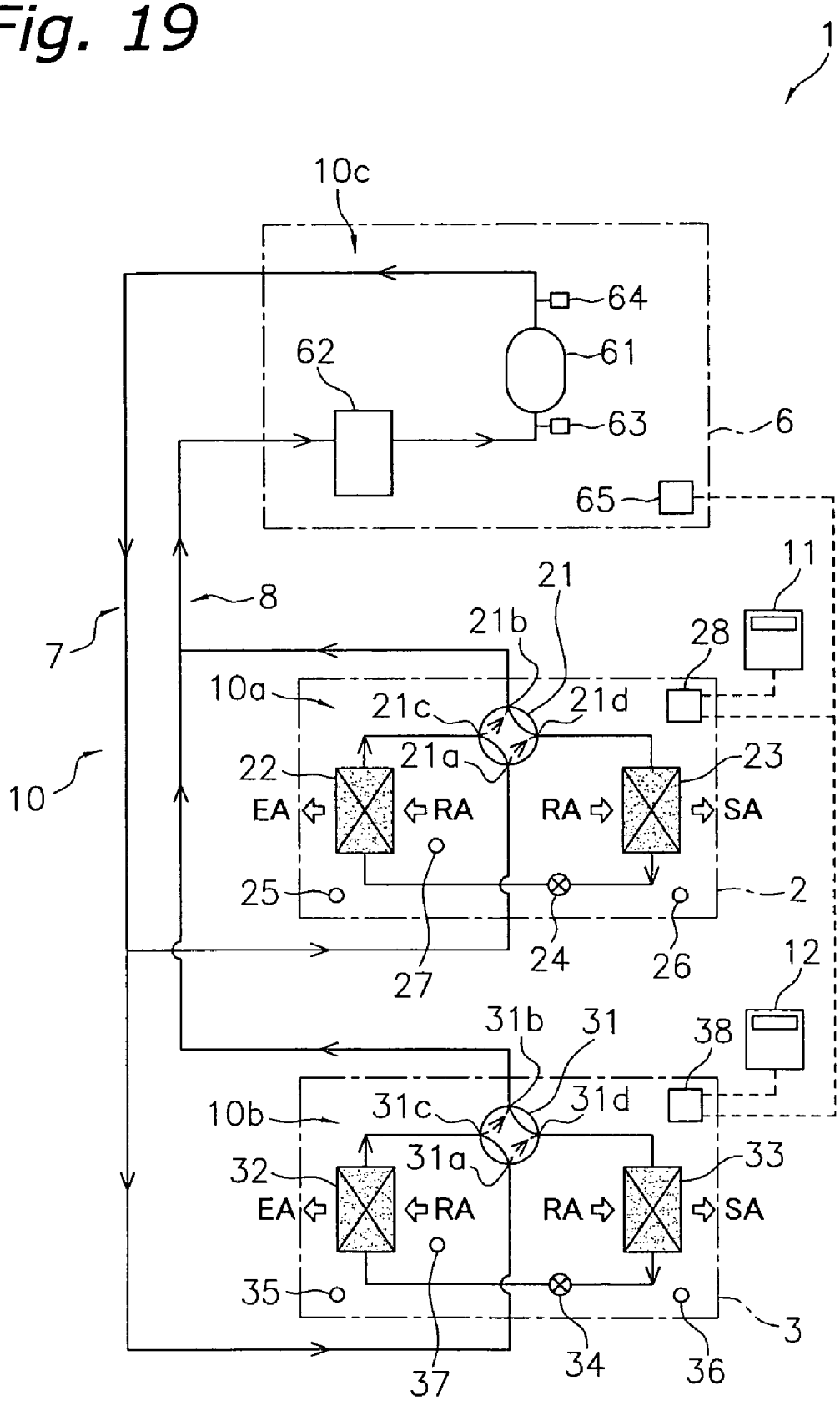
FIG. 19 is a schematic diagram of a refrigerant circuit showing the operation during the humidifying operation in the exhaust mode in the air conditioning system of the first embodiment.

The operation during the humidifying operation in the exhaust mode will be described with reference to FIGS. 18 and 19. Here, FIGS. 18 and 19 are schematic diagrams of a refrigerant circuit showing the operation during the humidifying operation in the exhaust mode in the air conditioning system 1. Note that the system control that is performed in the air conditioning system 1 is the same as the system control for the above-described dehumidifying operation in the full ventilation mode, so that a description thereof will be omitted.

During the humidifying operation, as shown in FIGS. 18 and 19, for example, the utilization unit 2 alternately repeats the first operation in which the first adsorbent heat exchanger 22 functions as a condenser and the second adsorbent heat exchanger 23 functions as an evaporator, and the second operation in which that second adsorbent heat exchanger 23 functions as a condenser and the first adsorbent heat exchanger 22 functions as an evaporator. Likewise, the utilization unit 3 alternately repeats the first operation in which the first adsorbent heat exchanger 32 functions as a condenser and the second adsorbent heat exchanger 33 functions as an evaporator and the second operation in which the second adsorbent heat exchanger 33 functions as a condenser and the first adsorbent heat exchanger 32 functions as an evaporator. Hereinafter, since the flow of the refrigerant in the refrigerant circuit 10 during the first operation and the second operation is the same as that during the above-described dehumidifying operation in the full ventilation mode, a description thereof will be omitted, and only the flow of the air during the first operation and the second operation will be described.

During the first operation, in the first adsorbent heat exchangers 22, 32, moisture is desorbed from the adsorbent heated by condensation of the refrigerant, and this desorbed moisture is added to the room air RA that is drawn from the indoor air inlet. The moisture desorbed from the first adsorbent heat exchangers 22, 32 is carried with the room air RA and is supplied as the supply air SA through the supply air outlet to the room. In the second adsorbent heat exchangers 23, 33, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 23, 33 passes through the exhaust air outlet and is exhausted as the exhaust air EA to the outside (see the arrows shown on the both sides of the adsorbent heat exchangers 22, 23, 32, 33 in FIG. 18).

During the second operation, in the second adsorbent heat exchangers 23, 33, moisture is desorbed from the adsorbent heated by condensation of the refrigerant, and this desorbed moisture is added to the room air RA that is drawn from the indoor air inlet. The moisture desorbed from the second adsorbent heat exchangers 23, 33 is carried with the room air RA and is supplied as the supply air SA through the supply air outlet to the room. In the first adsorbent heat exchangers 22, 32, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 22, 32 passes through the exhaust air outlet and is exhausted as the exhaust air EA to the outside (see the arrows shown on the both sides of the adsorbent heat exchangers 22, 23, 32, 33 in FIG. 19).

Here, the first adsorbent heat exchangers 22, 32 and second adsorbent heat exchangers 23, 33 treat not only the latent heat but also the sensible heat.

In this way, in the humidifying operation in the exhaust mode, this air conditioning system 1 can perform humidification of room air, and simultaneously perform heating operation using the sensible heat treatment capacity that is obtained according to the switching time interval and the heated air is supplied to the room.

<Partial Load Operation>

Figure 20:
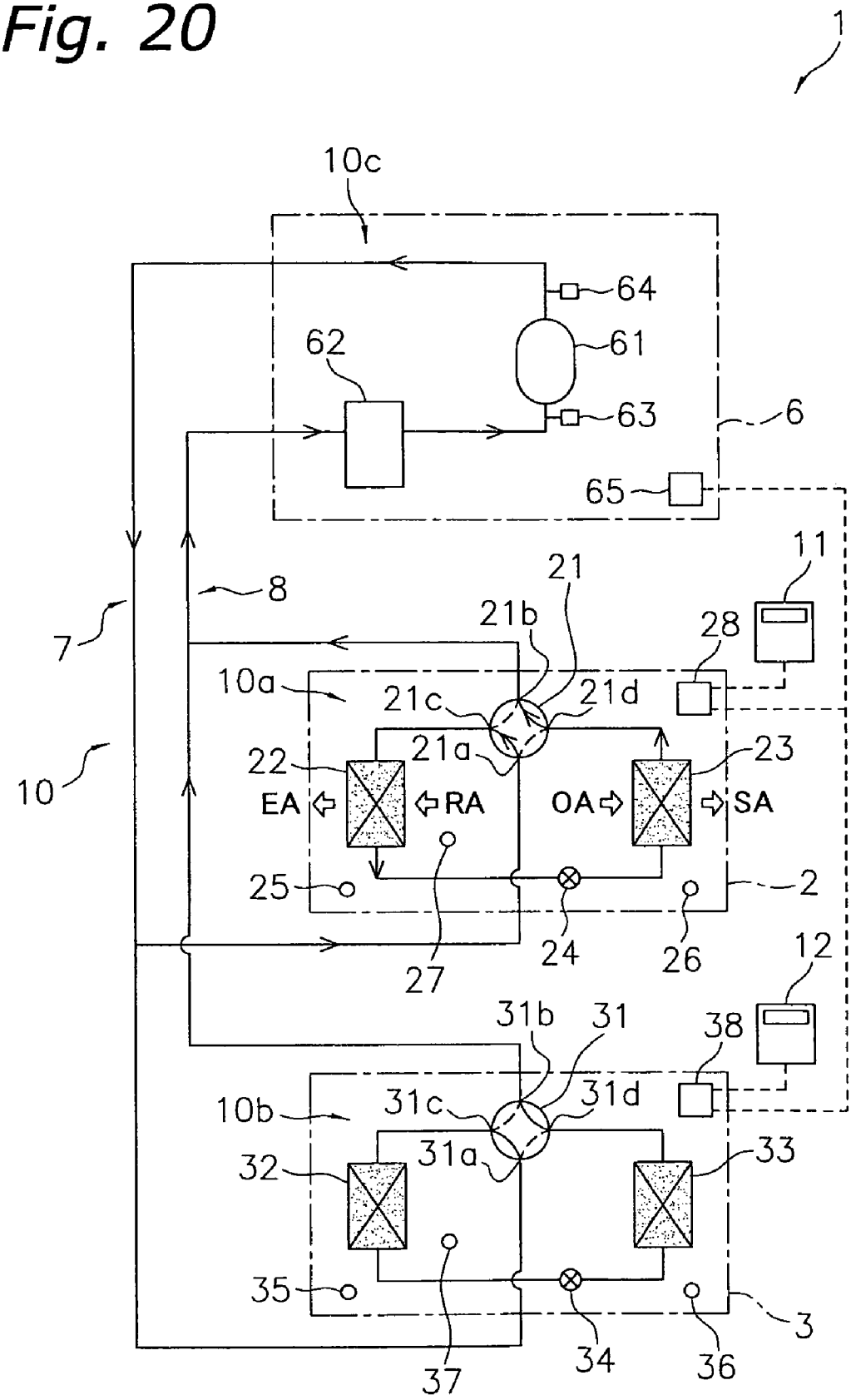
FIG. 20 is a schematic diagram of a refrigerant circuit showing the operation of a partial load operation during the dehumidifying operation in the full ventilation mode in the air conditioning system of the first embodiment.
Figure 21:
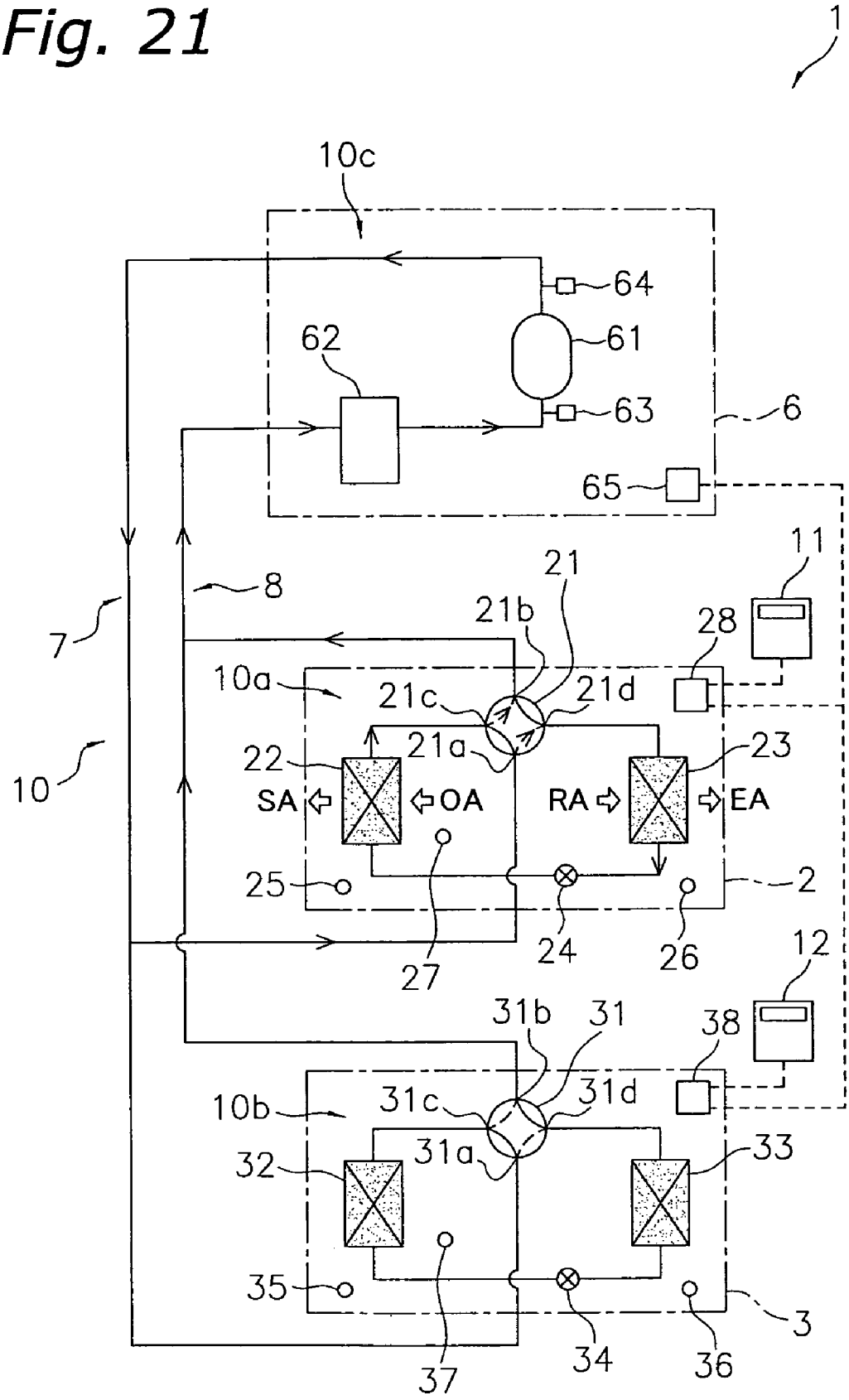
FIG. 21 is a schematic diagram of a refrigerant circuit showing the operation of the partial load operation during the dehumidifying operation in the full ventilation mode in the air conditioning system of the first embodiment.

Next, the operation when a partial load operation is performed in the air conditioning system 1 will be described. As an example, as shown in FIGS. 20 and 21, the case where the operation of the utilization unit 3 is stopped and only the utilization unit 2 is operated during the dehumidifying operation in the full ventilation mode will be described. Here, FIGS. 20, 21 are schematic diagrams of a refrigerant circuit showing the operation of the partial load operation during the dehumidifying operation in the full ventilation mode in the air conditioning system 1.

First, a utilization side expansion valve 34 of the utilization unit 3 is closed, and also, the air supply fan and the exhaust fan are stopped, and thereby the operation of the utilization unit 3 is stopped. Consequently, in the air conditioning system 1, the heat transfer area of the adsorbent heat exchangers in the air conditioning system 1 as a whole will be reduced by the heat transfer area of the adsorbent heat exchangers 32, 33 in the utilization unit 3. Consequently, in one of the adsorbent heat exchangers 22, 23, whichever is acting as an evaporator, the temperature difference between the refrigerant evaporation temperature and the air temperature increases; whereas in one of the adsorbent heat exchangers 22, 23, whichever is acting as a condenser, the temperature difference between the refrigerant condensation temperature and the air temperature increases.

Consequently, the system condensation temperature Tc1 will be higher than the target condensation temperature TcS1 that is calculated in step S2 in FIG. 4, and the system evaporation temperature Te1 will be lower than the target evaporation temperature TeS1. As a result, the heat source side controller 65 will control and reduce the operational capacity of the compression mechanism 61.

As a result, the amount of refrigerant that circulates in the refrigerant circuit 10 will decrease, and excessive refrigerant will be produced in the refrigerant circuit 10. This excessive refrigerant will be not be accumulated in the adsorbent heat exchangers 22, 23, 32, 33 but will be accumulated in the accumulator 62. Accordingly, a decrease in the inlet pressure or an increase in the discharge pressure of the compression mechanism 61, or accumulation of the refrigerant in the adsorbent heat exchangers 22, 23, 32, 33 will be prevented, and thus the partial load operation will be operated in a stable manner.

(3) Characteristics of the Air Conditioning System

The air conditioning system 1 of the present embodiment has the following characteristics.

(A)

In this air conditioning system, the utilization units 2, 3 comprising a plurality of utilization side refrigerant circuits 10*a*, 10*b* capable of mainly treating the latent heat load in the room by alternating between the adsorption process and the regeneration process in the adsorbent heat exchangers 22, 23, 32, 33 so as to dehumidify or humidify air that passes through the adsorbent heat exchanger 22, 23, 32, 33, is connected to the heat source unit 6 comprising the heat source side refrigerant circuit 10*c* having the compression mechanism 61, through the discharge gas connection pipe 7 and the inlet gas connection pipe 8. In this way, this air conditioning system constitutes so-called multi-type air conditioning system. In other words, heat sources for a vapor compression type refrigeration cycle operation between the utilization side refrigerant circuits are collected as one heat source to be shared by the plurality of utilization side refrigerant circuits. In this way, it is possible to prevent problems such as an increase in cost and an increase in the number of parts to be maintained, which occur when a plurality of air conditioners that use adsorbent heat exchangers are installed.

(B)

Further, the heat source side refrigerant circuit 10*c* includes the accumulator 62 as a liquid container connected to the inlet side of the compression mechanism 61, and excessive refrigerant that increase when the amount of circulating refrigerant decreases along with a change in the operating load of the air conditioning system 1 can be accumulated in the accumulator 62. Consequently, receivers to accumulate excessive refrigerant that is produced along with the decrease in the amount of circulating refrigerant do not need to be connected according to the number of utilization side refrigerant circuits 10*a*, 10*b* i.e. the number of the adsorbent heat exchangers 22, 23, 32, 33, and thus problems such as an increase in cost and an increase in size of the utilization units 2, 3 which house the adsorbent heat exchangers 22, 23, 32, 33 can be prevented.

(4) MODIFIED EXAMPLE

Figure 22:
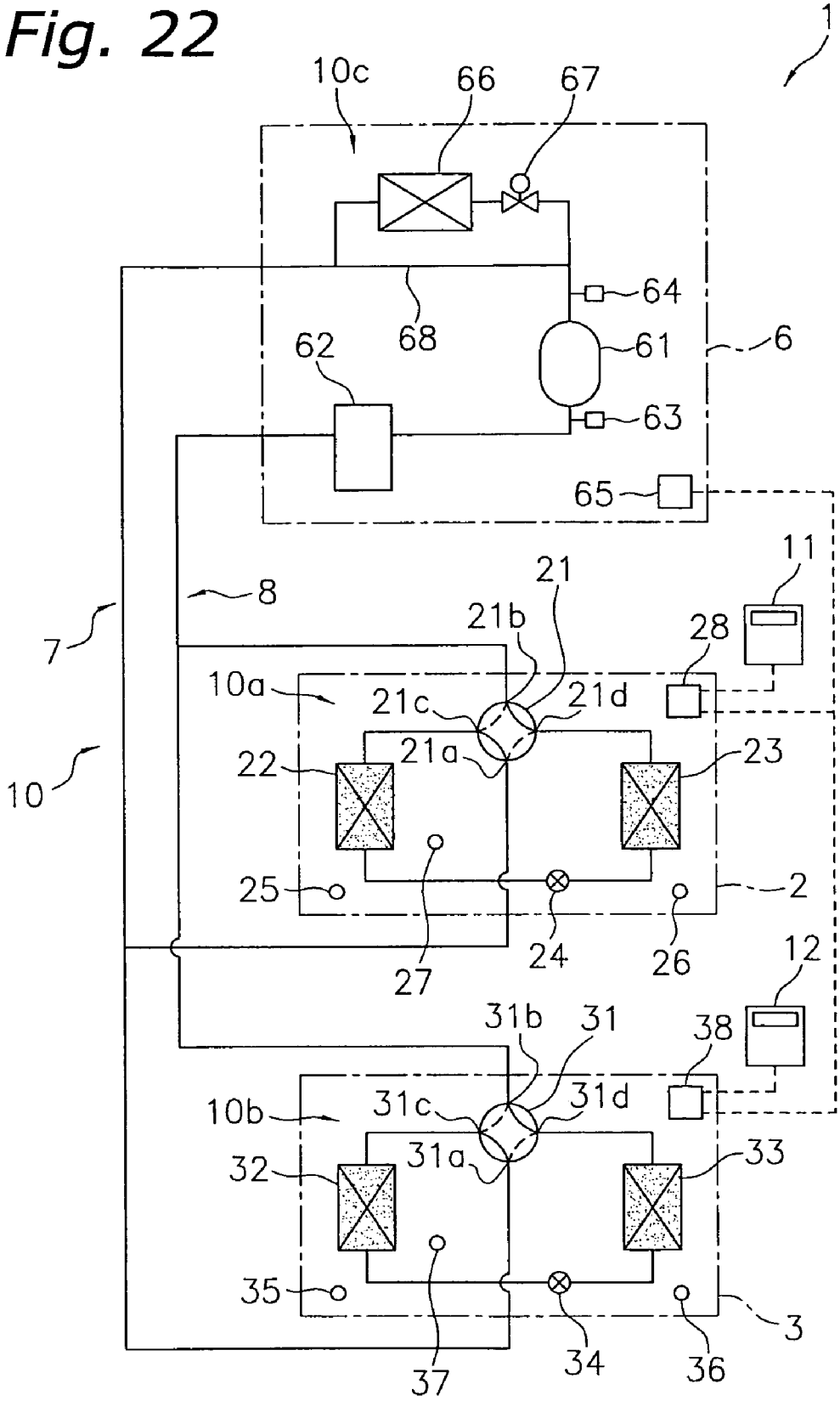
FIG. 22 is a schematic diagram of a refrigerant circuit of an air conditioning system according to a modified example of the first embodiment.

As shown in FIG. 22, in the heat source side refrigerant circuit 10*c* in the heat source unit 6 of the above-described embodiment, a supplementary condenser 66 may be connected to the discharge side of the compression mechanism 61 so as to allow a portion of high-pressure gas refrigerant, which is discharged from the compression mechanism 61 and sent to the utilization units 2, 3, to be condensed.

In this modification, a supplementary condenser 66 is connected so as to bypass a portion of a discharge pipe 68 of the compression mechanism 61, and after a portion of high-pressure gas refrigerant, which is discharged from the compression mechanism 61 and is sent to the utilization units 2, 3, is bypassed and condensed, the resulting refrigerant is again merged with high-pressure gas refrigerant that again flows through the discharge pipe 68. Consequently, the pressure of high-pressure gas refrigerant can be reduced. Further, since an electromagnetic valve 67 is connected to an inlet side of the supplementary condenser 66, the supplementary condenser 66 is allowed to be used only when the discharge pressure of the compression mechanism 61 excessively increases, such as when a sudden decrease in the operating load occurs.

In the present modified example, a portion of the refrigerant that flows on the discharge side of the compression mechanism 61 is condensed by the supplementary condenser 66, and therefore the pressure of the refrigerant on the discharge side of the compression mechanism 61 can be reduced. Accordingly, even when the pressure changes, such as in a way that the pressure of refrigerant on the discharge side of the compression mechanism 61 temporarily increases because of the increase or decrease in the amount of circulating refrigerant along with a change in the operating load of the air conditioning system 1, a multi air conditioning system that uses the adsorbent heat exchangers 22, 23, 32, 33 can be operated in a stable manner.

Second Embodiment (1) Configuration of the Air Conditioning System

Figure 23:
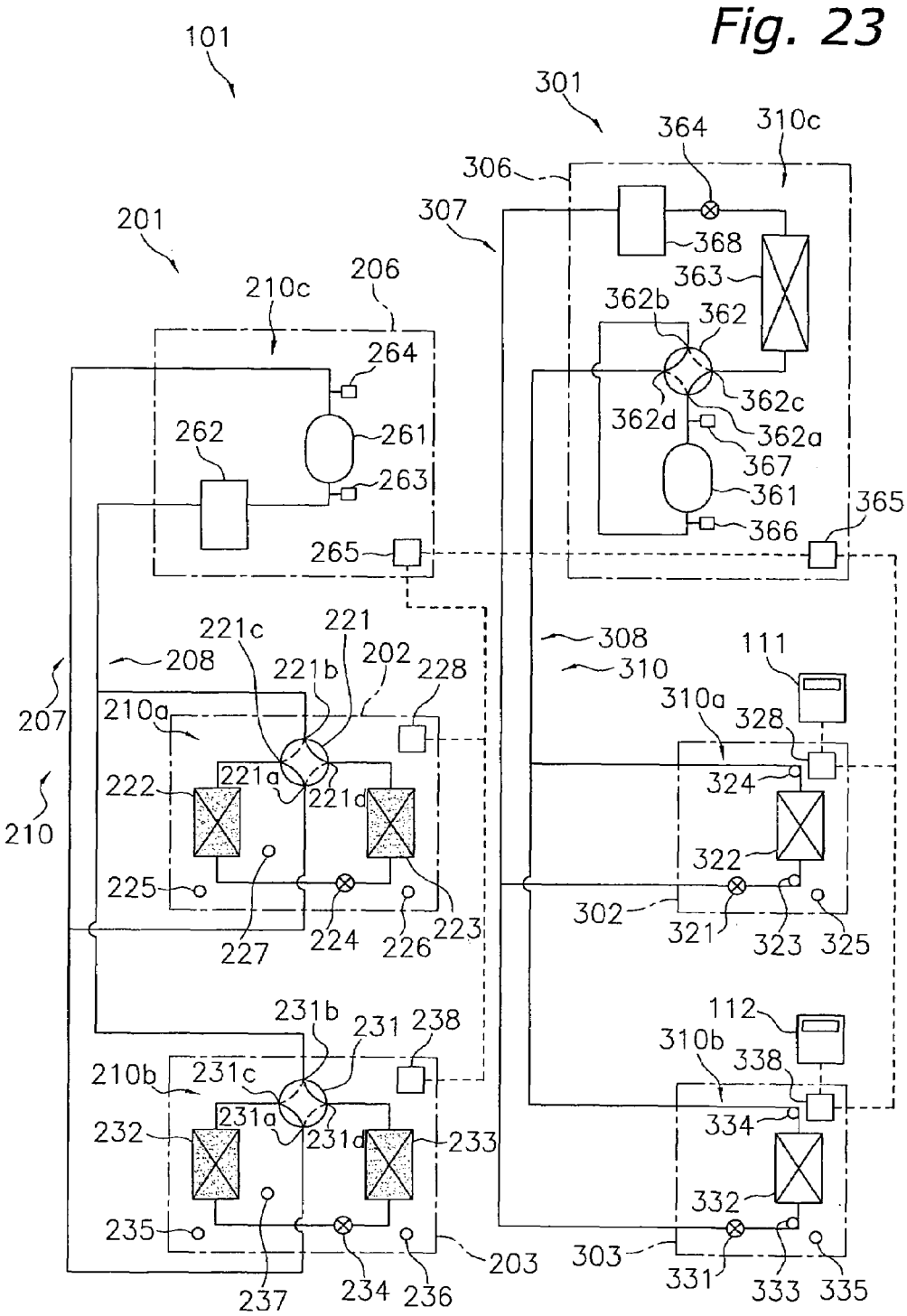
FIG. 23 is a schematic diagram of a refrigerant circuit of an air conditioning system of a second embodiment according to the present invention.

FIG. 23 is a schematic diagram of a refrigerant circuit of an air conditioning system 101 of a second embodiment according to the present invention. The air conditioning system 101 is an air conditioning system that treats the latent heat load and the sensible heat load in the room of a building and the like by operating a vapor compression type refrigeration cycle. The air conditioning system 101 is so-called separate type multi air conditioning system, and comprises: a latent heat load treatment system 201 that mainly treats the latent heat load in the room; and a sensible heat load treatment system 301 that mainly treat the sensible heat load in the room.

The configuration of the latent heat load treatment system 201 is the same as that of the air conditioning system 1 of the first embodiment. Therefore, all reference numerals representing each component of the utilization unit 2 of the first embodiment will be changed to those in 200s, and also, a term "latent heat" will be added to the name of each component (for example, the utilization unit 2 will be a latent heat utilization unit 202), and a description of each component will be omitted.

A sensible heat load treatment system 301 mainly comprises: a plurality of (two in the present embodiment) sensible heat utilization units 302, 303; a sensible heat heat source unit 306; and sensible heat connection pipes 307, 308 which connect the sensible heat utilization units 302, 303 to the sensible heat heat source unit 306. In the present embodiment, the sensible heat heat source unit 306 functions as a heat source that is shared by the sensible heat utilization units 302, 303. In addition, although the present embodiment has only one sensible heat heat source unit 306, a plurality of sensible heat heat source units 306 may be connected in parallel when there are many sensible heat utilization units 302, 303.

<Sensible Heat Utilization Unit>

The sensible heat utilization units 302, 303 are disposed such by being embedded in or hung from an indoor ceiling of a building or the like, or by being mounted on a space in above a ceiling. The sensible heat utilization units 302, 303 are connected to sensible heat heat source unit 306 through the sensible heat connection pipes 307, 308, and constitute part of a sensible heat refrigerant circuit 310 in a space between the sensible heat utilization units 302, 303 and sensible heat heat source unit 306. The sensible heat utilization units 302, 303 are capable of mainly treating the sensible heat load in the room by circulating refrigerant in the sensible heat refrigerant circuit 310 and operating a vapor compression type refrigeration cycle. Further, the sensible heat utilization unit 302 is disposed in the same air-conditioned space as is the latent heat utilization unit 202, and the sensible heat utilization unit 303 is disposed in the same air-conditioned space as is the latent heat utilization unit 203. In other words, the latent heat utilization unit 202 pairs up with the sensible heat utilization unit 302 to treat the latent heat load and the sensible heat load in an air-conditioned space, whereas the latent heat utilization unit 203 pairs up with the sensible heat utilization unit 303 to treat the latent heat load and the sensible heat load in a different air-conditioned space.

Next, the configuration of the sensible heat utilization units 302, 303 will be described. Note that since the sensible heat utilization unit 302 and the sensible heat utilization unit 303 have the same configuration, only the configuration of the sensible heat utilization unit 302 will be described here, and in regard to the configuration of the sensible heat utilization unit 303, reference numerals in the 330s will be used instead of reference numerals in the 320s representing each component of the sensible heat utilization unit 302, and a description of each component will be omitted.

The sensible heat utilization unit 302 mainly constitutes part of the sensible heat refrigerant circuit 310, and comprises a sensible heat utilization side refrigerant circuit 310*a* capable of dehumidifying or humidifying air. This sensible heat utilization side refrigerant circuit 310*a* mainly comprises a sensible heat utilization side expansion valve 321 and an air heat exchanger 322. In the present embodiment, the sensible heat utilization side expansion valve 321 is an electric expansion valve connected to a liquid side of the air heat exchanger 322 in order to adjust the flow rate of the refrigerant. In the present embodiment, the air heat exchanger 322 is a fin and tube type heat exchanger of the cross fin type, which is formed with a heat transfer tube and a number of fins, and is a device configured to exchange heat between refrigerant and room air RA. In the present embodiment, the sensible heat utilization unit 302 comprises a ventilation fan (not shown) for supplying air as supply air SA to the room, after the room air RA is drawn into the unit and is heat-exchanged. The sensible heat utilization unit 302 is capable of exchanging the heat between the room air RA and the refrigerant that flows through the air heat exchanger 322.

In addition, the sensible heat utilization unit 302 is provided with various sensors. The liquid side of the air heat exchanger 322 is provided with a liquid side temperature sensor 323 that detects the temperature of the liquid refrigerant, and a gas side of the air heat exchanger 322 is provided with a gas side temperature sensor 324 that detects the temperature of the gas refrigerant. The sensible heat utilization unit 302 is further provided with an RA inlet temperature sensor 325 that detects the temperature of the room air RA to be drawn into the unit. In addition, the sensible heat utilization unit 302 comprises a sensible heat utilization side controller 328 that controls the operation of each component that constitutes the sensible heat utilization unit 302. The sensible heat utilization side controller 328 includes a microcomputer and a memory device provided for controlling sensible heat utilization unit 302. Through a remote control 111, the sensible heat utilization side controller 328 can send and receive input signals of the target temperature and the target humidity of the room air, and also can exchange control signals and other signals with the sensible heat heat source unit 306.

<Sensible Heat Heat Source Unit>

The sensible heat heat source unit 306 is disposed on the roof of a building and the like, and is connected to the sensible heat utilization units 302, 303 through the sensible heat connection pipes 307, 308. The sensible heat heat source unit 306 constitutes the sensible heat refrigerant circuit 310 in a space between the sensible heat heat source unit 306 and the sensible heat utilization units 302, 303.

Next the configuration of the sensible heat heat source unit 306 will be described. The sensible heat heat source unit 306 mainly constitutes part of the sensible heat refrigerant circuit 310 and comprises a sensible heat heat source side refrigerant circuit 310*c*. This sensible heat heat source side refrigerant circuit 310*c* mainly comprises: a sensible heat compression mechanism 361; a sensible heat heat source side four-way directional control valve 362; a sensible heat heat source side heat exchanger 363: a sensible heat heat source side expansion valve 364; and a sensible heat receiver 368.

In the present embodiment, the sensible heat compression mechanism 361 is a positive-displacement compressor whose operational capacity can be changed by the inverter control. In the present embodiment, the sensible heat compression mechanism 361 only has one compressor but is not limited thereto, and may also be one where two or more compressors are connected in parallel in accordance with the number of sensible heat utilization units to be connected.

The sensible heat heat source side four-way directional control valve 362 is a valve used to switch a passage of refrigerant that flows in the sensible heat heat source side refrigerant circuit 310*c* when the cooling operation is switched to the heating operation and vice versa. A first port 362*a* of the sensible heat heat source side four-way directional control valve 362 is connected to a discharge side of the sensible heat compression mechanism 361; a second port 362*b* thereof is connected to an inlet side of the sensible heat compression mechanism 361; a third port 362*c* thereof is connected to a gas side end of the sensible heat heat source side heat exchanger 363; and a fourth port 362*d* thereof is connected to the sensible heat gas connection pipe 308. Further, the sensible heat heat source side four-way directional control valve 362 is capable of switching between a state in which the first port 362*a* is connected to the third port 362*c* while the second port 362*b* is connected to the fourth port 362*d* (a cooling operation state; see the solid lines in the sensible heat heat source side four-way directional control valve 362 in FIG. 23) and a state in which the first port 362*a* is connected to the fourth port 362*d* while the second port 362*b* is connected to the third port 362*c* (a heating operation state; see the broken lines in the sensible heat heat source side four-way directional control valve 362 in FIG. 23).

In the present embodiment, the sensible heat heat source side heat exchanger 363 is a fin and tube type heat exchanger of the cross fin type, which is formed with a heat transfer tube and a number of fins, and is a device configured to exchange the heat with refrigerant, using air as a heat source. In the present embodiment, the sensible heat heat source unit 306 comprises an outdoor fan (not shown) for taking in the outdoor air into the unit and blowing the air out, and is capable of exchanging the heat between outdoor air and the refrigerant that flows through the sensible heat heat source side heat exchanger 363.

In the present embodiment, the sensible heat heat source side expansion valve 364 is an electric expansion valve capable of adjusting the flow rate of the refrigerant flowing between the sensible heat heat source side heat exchanger 363 and the air heat exchangers 322, 332 through the sensible heat liquid connection pipe 307. During the cooling operation, the sensible heat heat source side expansion valve 364 is used in an almost full open state, whereas during the heating operation, the degree of opening of the sensible heat heat source side expansion valve 364 is adjusted so as to reduce the pressure of the refrigerant that flows into the sensible heat heat source side heat exchanger 363 from the air heat exchangers 322, 332 through the sensible heat liquid connection pipe 307.

The sensible heat receiver 368 is a container that is used to temporarily accumulate the refrigerant that flows between the sensible heat heat source side heat exchanger 363 and the air heat exchangers 322, 332. In the present embodiment, the sensible heat receiver 368 is connected between the sensible heat heat source side expansion valve 364 and the sensible heat liquid connection pipe 307.

In addition, the sensible heat heat source unit 306 is provided with various sensors. Specifically, the sensible heat heat source unit 306 comprises: a sensible heat inlet pressure sensor 366 that detects the inlet pressure of the sensible heat compression mechanism 361; a sensible heat discharge pressure sensor 367 that detects the discharge pressure of the sensible heat compression mechanism 361; and a sensible heat heat source side controller 365 that controls the operation of each component that constitutes the sensible heat heat source unit 306. The sensible heat heat source side controller 365 includes a microcomputer and a memory device provided for controlling the sensible heat heat source unit 306, and is capable of transmitting control signals to and from the sensible heat utilization side controllers 328, 338 of the sensible heat utilization units 302, 303. The sensible heat heat source side controller 365 can also exchange control signals and other signals with a latent heat heat source side controller 265. Further, the sensible heat heat source side controller 365 can also exchange control signals with latent heat utilization side controllers 228, 238 through the latent heat heat source side controller 265.

(2) Operation of the Air Conditioning System

Next, the operation of the air conditioning system 101 of the present embodiment will be described. The air conditioning system 101 can treat the latent heat load in the room by the latent heat load treatment system 201, and treat the sensible heat load in the room mainly by the sensible heat load treatment system 301. Each type of operation will be described below.

<Dehumidifying and Cooling Operation>

Figure 24:
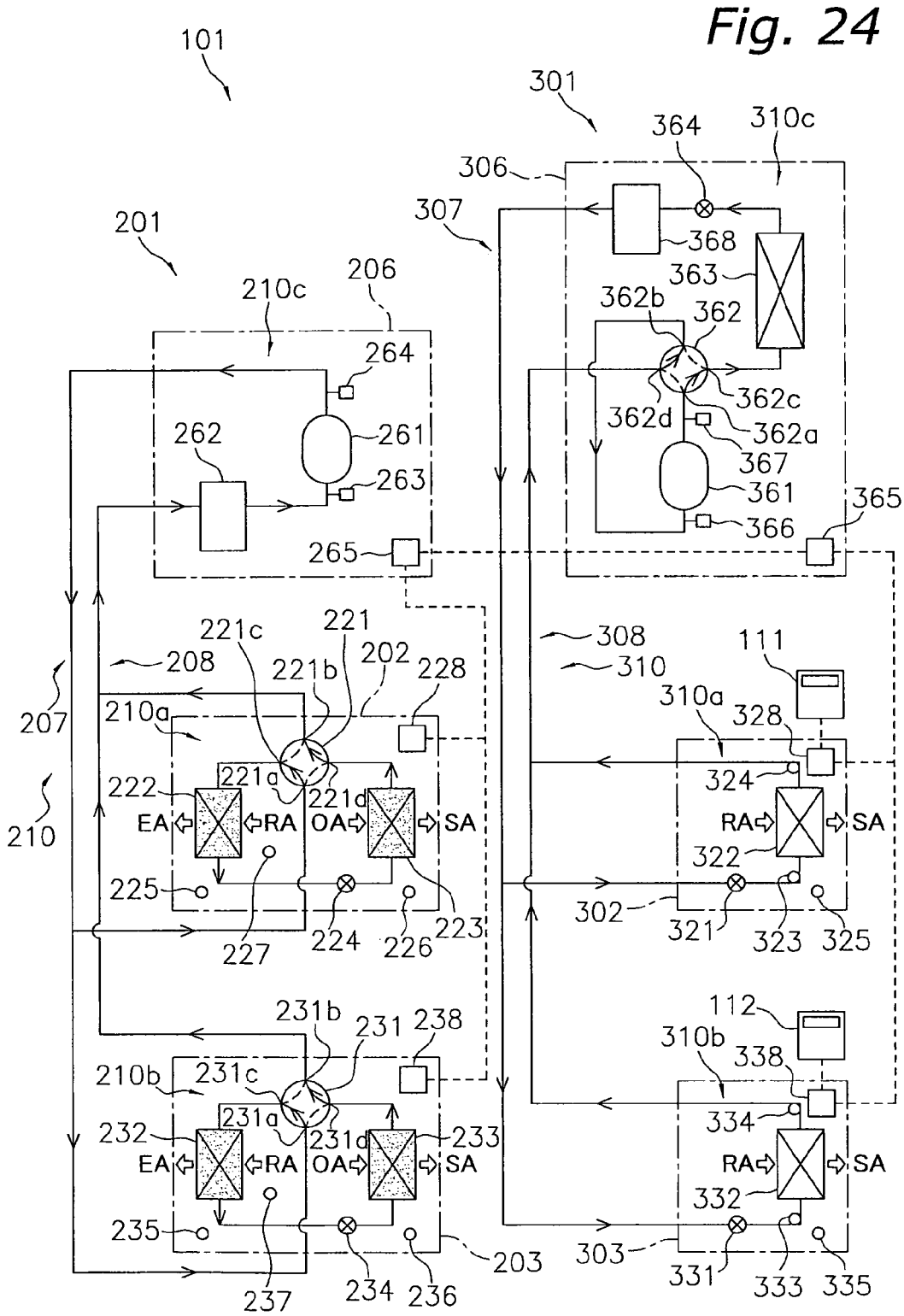
FIG. 24 is a schematic diagram of a refrigerant circuit showing the operation during the dehumidifying and cooling operation in the full ventilation mode in the air conditioning system of the second embodiment.
Figure 25:
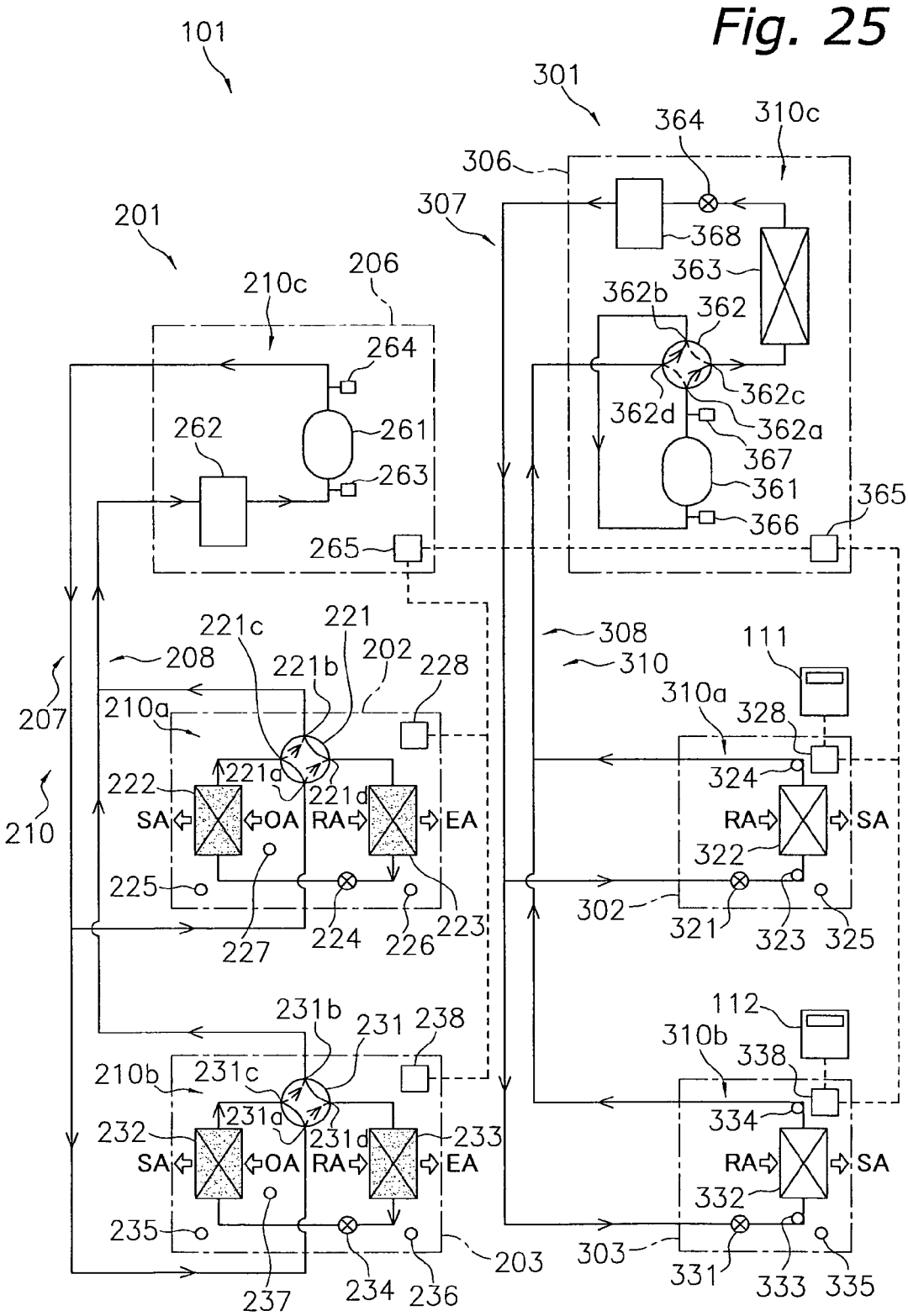
FIG. 25 is a schematic diagram of a refrigerant circuit showing the operation during the dehumidifying and cooling operation in the full ventilation mode in the air conditioning system of the second embodiment.
Figure 26:
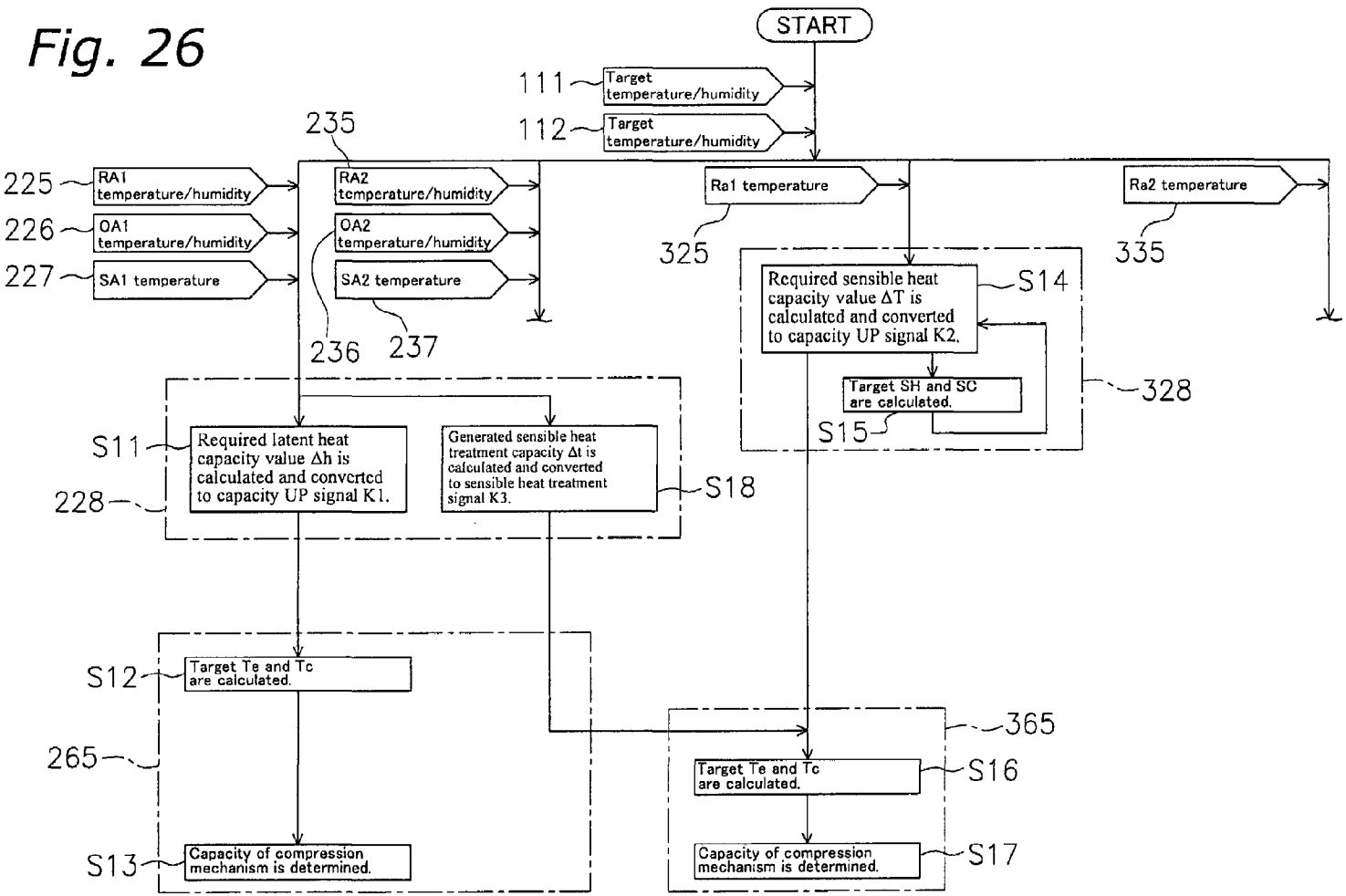
FIG. 26 is a diagram of control flow during normal operation in the air conditioning system of the second embodiment.

First, the operation of a cooling and dehumidifying operation in which the cooling operation is performed in the sensible heat load treatment system 301 while the dehumidifying operation is performed in the full ventilation mode in the latent heat load treatment system 201 will be described with reference to FIGS. 24, 25, and 26. Here, FIGS. 24 and 25 are schematic diagrams of a refrigerant circuit showing the operation during the dehumidifying and cooling operation in the full ventilation mode in the air conditioning system 101. FIG. 26 is a control flow diagram during normal operation in the air conditioning system 101. Note that as for FIG. 26, since the latent heat utilization unit 202 and the sensible heat utilization unit 302 as a pair have the same control flow as the latent heat utilization unit 203 and the sensible heat utilization unit 303 as a pair, so that the illustration of the control flow of the latent heat utilization unit 203 and the sensible heat utilization unit 303 as a pair is omitted.

First, the operation of the latent heat load treatment system 201 will be described.

As with the above-described single operation of the latent heat load treatment system 201, the latent heat utilization unit 202 of the latent heat load treatment system 201 alternately repeats the first operation in which a first adsorbent heat exchanger 222 functions as a condenser and a second adsorbent heat exchanger 223 functions as an evaporator, and the second operation in which the second adsorbent heat exchanger 223 functions as a condenser and the first adsorbent heat exchanger 222 functions as an evaporator. Likewise, the latent heat utilization unit 203 alternately repeats the first operation in which a first adsorbent heat exchanger 232 functions as a condenser and a second adsorbent heat exchanger 233 functions as an evaporator and the second operation in which the second adsorbent heat exchanger 233 functions as a condenser and the first adsorbent heat exchanger 232 functions as an evaporator.

The operation of the two latent heat utilization units 202 and 203 will be described together below.

In the first operation, the regeneration process in the first adsorbent heat exchangers 222, 232 and the adsorption process in the second adsorbent heat exchangers 223, 233 are performed in parallel. During the first operation, as shown in FIG. 24, the latent heat utilization side four-way directional control valves 221, 231 are set to a first state (see the solid lines in the latent heat utilization side four-way directional control valves 221, 231 in FIG. 24). In this state, high-pressure gas refrigerant discharged from a latent heat compression mechanism 261 flows into the first adsorbent heat exchangers 222, 232 through a latent heat discharge gas connection pipe 207 and the latent heat utilization side four-way directional control valves 221, 231, and is condensed while passing through the first adsorbent heat exchangers 222, 232. The condensed refrigerant is pressure-reduced by the latent heat utilization side expansion valves 224, 234, and is subsequently evaporated while passing through the second adsorbent heat exchangers 223, 233. Then, the refrigerant is again drawn into the latent heat compression mechanism 261 through the latent heat utilization side four-way directional control valves 221, 231, a latent heat inlet gas connection pipe 208, a latent heat accumulator 262 (see the arrows shown on a latent heat refrigerant circuit 210 in FIG. 24).

During the first operation, in the first adsorbent heat exchangers 222, 232, moisture is desorbed from the adsorbent heated by condensation of the refrigerant, and this desorbed moisture is added to the room air RA that is drawn from the indoor air inlet. The moisture desorbed from the first adsorbent heat exchangers 222, 232 is carried with the room air RA and exhausted as the exhaust air EA through the exhaust air outlet to the outside. In the second adsorbent heat exchangers 223, 233, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 223, 233 passes through the supply air outlet and is supplied as the supply air SA to the room (see the arrows shown on the both sides of the adsorbent heat exchangers 222, 223, 232, 233 in FIG. 24).

In the second operation, the adsorption process in the first adsorbent heat exchangers 222, 232 and the regeneration process in the second adsorbent heat exchangers 223, 233 are performed in parallel. During the second operation, as shown in FIG. 25, the utilization side four-way directional control valves 221, 231 are set to a second state (see the broken lines in the utilization side four-way directional control valves 221, 231 in FIG. 25). In this state, high-pressure gas refrigerant discharged from the latent heat compression mechanism 261 flows into the second adsorbent heat exchangers 223, 233 through the latent heat discharge gas connection pipe 207 and the latent heat utilization side four-way directional control valves 221, 231, and is condensed while passing through the second adsorbent heat exchangers 223, 233. The condensed refrigerant is pressure-reduced by latent heat utilization side expansion valves 224, 234, and is subsequently evaporated while passing through the first adsorbent heat exchangers 222, 232. Then, the refrigerant is again drawn into the latent heat compression mechanism 261 through the latent heat utilization side four-way directional control valves 221, 231, the latent heat inlet gas connection pipe 208, and the latent heat accumulator 262 (see the arrows shown on a latent heat refrigerant circuit 210 in FIG. 25).

During the second operation, in the second adsorbent heat exchangers 223, 233, moisture is desorbed from the adsorbent heated by condensation of the refrigerant, and this desorbed moisture is added to the room air RA that is drawn from the indoor air inlet. The moisture desorbed from the second adsorbent heat exchangers 223, 233 is carried with the room air RA and is exhausted as the exhaust air EA through the exhaust air outlet to the outside. In the first adsorbent heat exchangers 222, 232, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 222, 232 passes through the supply air outlet and is supplied as the supply air SA to the room (see the arrows shown on the both sides of the adsorbent heat exchangers 222, 223, 232, 233 in FIG. 25).

Here, the system control being performed in the air conditioning system 101 will be described, focusing on the latent heat load treatment system 201.

First, when the target temperature and the target relative humidity are set by the remote controls 111, 112, the following information will be input into the latent heat utilization side controllers 228, 238 of the latent heat utilization units 202, 203 along with these target temperature and target relative humidity: the temperature and relative humidity of the room air to be drawn into the units, which were detected by RA inlet temperature/humidity sensors 225, 235; and the temperature and relative humidity of outdoor air to be drawn into the units, which were detected by OA inlet temperature/humidity sensors 226, 236.

Then, in step S11, the latent heat utilization side controllers 228, 238 calculate the target value of the enthalpy or the target absolute humidity based on the target temperature and target relative humidity of the room air; calculate the current value of the enthalpy or the current absolute humidity of the air to be drawn into the units from the room based on the temperature and the relative humidity detected by the RA inlet temperature/humidity sensors 225, 235; and then calculate the required latent heat capacity value Δh, which is the difference between the two calculated values. Then, this value Δh is converted to a capacity UP signal K1 that informs the latent heat heat source side controller 265 whether or not it is necessary to increase the treatment capacity of the latent heat utilization units 202, 203. For example, when the absolute value of Δh is lower than a predetermined value (in other words, when the humidity of the room air is close to the target humidity, and the treatment capacity does not need to be increased or decreased), the capacity UP signal K1 will be "0." When the absolute value of Δh is higher than a predetermined value in a way that the treatment capacity needs to be increased (in other words, the humidity of the room air is higher than the target humidity during the humidifying operation, and the treatment capacity needs to be increased), the capacity UP signal K1 will be "A," and when the absolute value of Δh is higher than a predetermined value in a way that the treatment capacity needs to be decreased (in other words, the humidity of the room air is lower than the target humidity during the humidifying operation, and the treatment capacity needs to be decreased), the capacity UP signal K1 will be "B."

Next in step S12, the latent heat heat source side controller 265 uses the capacity UP signal K1 of the latent heat utilization units 202, 203, which was transmitted from the latent heat utilization side controllers 228, 238 to the latent heat heat source side controller 265, in order to calculate the target condensation temperature TcS1 and the target evaporation temperature TeS1. For example, the target condensation temperature TcS1 is calculated by adding the capacity UP signal K1 of the latent heat utilization units 202, 203 to the current target condensation temperature. In addition, the target evaporation temperature TeS1 is calculated by subtracting the capacity UP signal K1 of the latent heat utilization units 202, 203 from the current target evaporation temperature. Consequently, when a value of the capacity UP signal K1 is "A," the target condensation temperature TcS1 will be high, and the target evaporation temperature TeS1 will be low.

Next, in step S13, a system condensation temperature Tc1 and a system evaporation temperature Te1, which respectively correspond to measured values of the condensation temperature and the evaporation temperature of the latent heat load treatment system 201 as a whole, are calculated. For example, the system condensation temperature Tc1 and the system evaporation temperature Te1 are calculated by converting the inlet pressure of the latent heat compression mechanism 261, which was detected by a latent heat inlet pressure sensor 263, and the discharge pressure of the latent heat compression mechanism 261, which was detected by a latent heat discharge pressure sensor 264, into saturation temperatures of the refrigerant at these pressures. Then, the temperature difference ΔTc1 between the system condensation temperature Tc1 and the target condensation temperature TcS1, and the temperature difference ΔTe1 between the system evaporation temperature Te1 and the target evaporation temperature TeS1 are calculated. Then based on the subtraction between these temperature differences, the necessity and amount of the increase or decrease in the operational capacity of the latent heat compression mechanism 261 will be determined.

By using thus determined operational capacity of the latent heat compression mechanism 261 to control the operational capacity of the latent heat compression mechanism 261, the system control to aim the target relative humidity of the room air is performed. The system control is performed such that, for example, when a value determined by subtracting the temperature difference ΔTe1 from the temperature difference ΔTc1 is a positive value, the operational capacity of the latent heat compression mechanism 261 is increased, whereas when a value determined by subtracting the temperature difference ΔTe1 from the temperature difference ΔTc1 is a negative value, the operational capacity of the latent heat compression mechanism 261 is decreased.

Next, the operation of the sensible heat load treatment system 301 will be described.

The sensible heat heat source side four-way directional control valve 362 in the sensible heat heat source unit 306 of the sensible heat load treatment system 301 is in a cooling operation state (the first port 362*a* is connected to the third port 362*c*, and also, the second port 362*b* is connected to the fourth port 362*d*). In addition, the degree of opening of sensible heat utilization side expansion valves 321, 331 of the sensible heat utilization units 302, 303, respectively, is adjusted so as to reduce the pressure of the refrigerant. The sensible heat heat source side expansion valve 364 is opened.

When the sensible heat compression mechanism 361 of the sensible heat heat source unit 306 starts with the sensible heat refrigerant circuit 310 being in the above-described state, high-pressure gas refrigerant discharged from the sensible compression mechanism 361 passes through the sensible heat heat source side four-way direction control valve 362, flows into the sensible heat heat source side heat exchanger 363, and is condensed into liquid refrigerant. This liquid refrigerant is sent to the sensible heat utilization units 302, 303 through the sensible heat heat source side expansion valve 364, the sensible heat receiver 368, and the sensible heat liquid connection pipe 307. The liquid refrigerant sent to the sensible heat utilization units 302, 303 is pressure-reduced by the sensible heat utilization side expansion valves 321, 331, and then, in air heat exchangers 322, 332, this liquid refrigerant is evaporated into low-pressure gas refrigerant by heat exchange with the room air RA drawn into the unit. This gas refrigerant is again drawn into the sensible heat compression mechanism 361 of the sensible heat heat source unit 306 through the sensible heat gas connection pipe 308. On the other hand, the room air RA cooled by heat exchange with the refrigerant in the air heat exchangers 322, 332 is supplied as the supply air SA to the room. Note that, as described below, the degree of opening of the sensible heat utilization side expansion valves 321, 331 is adjusted such that the degree of superheat SH in the air heat exchangers 332, 332, i.e., the temperature difference between the refrigerant temperature on the liquid side of the air heat exchangers 322, 332 respectively detected by the liquid side temperature sensors 323, 333 and the refrigerant temperature on the gas side of the air heat exchangers 322, 332 respectively detected by the gas side temperature sensors 324, 334, is equal to the target degree of superheat SHS.

Here, the system control that is performed in the air conditioning system 101 will be described, focusing on the sensible heat load treatment system 301.

First, when the target temperatures are set by the remote controls 111, 112, along with these target temperatures, the temperature of the room air to be drawn into the unit, which were detected by RA inlet temperature sensors 325, 335, will be input into the sensible heat utilization side controllers 328, 338 of the sensible heat utilization units 302, 303, respectively.

Then, in step S14, the sensible heat utilization side controllers 328, 338 calculate the temperature difference between the target temperature of the room air and the temperature detected by the RA inlet temperature and humidity sensors 325, 335 (this temperature difference will be hereinafter referred to as the required sensible heat capability value ΔT).

Here, as described above, the required sensible heat capacity value ΔT is the difference between the target temperature of the room air and the current temperature of the room air, so that this value ΔT corresponds to the sensible heat load that must be treated in the air conditioning system 101. Then, this required sensible heat capacity value ΔT is converted to a capacity UP signal K2 that informs the sensible heat heat source side controller 365 whether or not it is necessary to increase the treatment capacity of the sensible heat utilization units 302, 303. For example, when the absolute value of ΔT is lower than a predetermined value (in other words, when the temperature of the room air is close to the target temperature of the room air and the treatment capacity does not need to be increased or decreased), the capacity UP signal K2 will be "0." When the absolute value of ΔT is higher than a predetermined value in a way that the treatment capacity needs to be increased (in other words, the temperature of the room air is higher than the target temperature during the cooling operation and the treatment capacity needs to be increased), the capacity UP signal K2 will be "a," and when the absolute value of ΔT is higher than a predetermined value in a way that the treatment capacity needs to be decreased (in other words, the temperature of the room air is lower than the target temperature during the cooling operation, and the treatment capacity needs to be decreased), the capacity UP signal K2 will be "b."

Next, in step S15, the sensible heat utilization side controllers 328, 338 change the target degree of superheat SHS according to the required sensible heat capability value ΔT. For example, when the treatment capacity of the sensible heat utilization units 302, 303 needs to be decreased (when the capacity UP signal K2 is "b"), the degree of opening of the sensible heat utilization side expansion valves 321, 331 is controlled such that the target degree of superheat SHS is increased and the amount of heat exchanged between the air and the refrigerant in the air heat exchangers 322, 332 is decreased.

In addition, in step S16, the sensible heat heat source side controller 365 calculates the target condensation temperature TcS2 and the target evaporation temperature TeS2, using the capacity UP signal K2 of the sensible heat utilization units 302, 303, which was transmitted from the sensible heat utilization side controllers 328, 338 to the sensible heat heat source side controller 365. For example, the target condensation temperature TcS2 is calculated by adding the capacity UP signal K2 of the sensible heat utilization units 302, 303 to the current target condensation temperature. In addition, the target evaporation temperature TeS2 is calculated by subtracting the capacity UP signal K2 of the sensible heat utilization units 302, 303 from the current target evaporation temperature. Accordingly, when a value of the capacity UP signal K2 is "a," the target condensation temperature TcS2 will be high and the target evaporation temperature TeSs will be low. Note that, as described above, in the latent heat load treatment system 201, both the latent heat and the sensible heat are treated, so that for the calculation of the target condensation temperature TcS2 and the target evaporation temperature TeS2, a calculation method that takes into consideration the capacity of the sensible heat load treatment that is performed along with the latent heat load treatment in the latent heat load treatment system 201 (generated sensible heat treatment capacity) is employed. However, a description of the method is not described here but will be described later.

Next in step S17, a system condensation temperature Tc2 and a system evaporation temperature Te2, which respectively correspond to measured values of the condensation temperature and the evaporation temperature of the entire sensible heat load treatment system 301, are calculated. For example, the system condensation temperature Tc2 and the system evaporation temperature Te2 are calculated by converting the inlet pressure of the sensible heat compression mechanism 361 detected by the sensible heat inlet pressure sensor 366 and the discharge pressure of the sensible heat compression mechanism 361 detected by a sensible heat discharge pressure sensor 367 to the saturation temperatures of the refrigerant at these pressures. Then, the temperature difference ΔTc2 between the system condensation temperature Tc2 and the target condensation temperature TcS2 and the temperature difference ΔTe2 between the system evaporation temperature Te2 and the target evaporation temperature TeS2 are calculated. When the cooling operation is being performed, the necessity and amount of the increase or decrease in the operational capacity of the sensible heat compression mechanism 361 will be determined based on the temperature difference ΔTe2.

By using thus determined operational capacity of the sensible heat compression mechanism 361 to control the operational capacity of the sensible heat compression mechanism 361, the system control to aim the target temperature of the sensible heat utilization units 302, 303 is performed. The system control is performed such that, for example, when the temperature difference ΔTe2 is a positive value, the operational capacity of the sensible heat compression mechanism 361 is decreased, whereas when the temperature difference ΔTe2 is a negative value, the operational capacity of the sensible heat compression mechanism 361 is increased.

In this way, in this air conditioning system 101, the latent heat load (required latent heat treatment capacity, which corresponds to Δh), which must be treated in the air conditioning system 101 as a whole, and the sensible heat load (required sensible heat treatment capacity, which corresponds to ΔT), which must be treated in the air conditioning system 101 as a whole, are treated by using the latent heat load treatment system 201 and the sensible heat load treatment system 301. Here, the increase or decrease in the treatment capacity of the latent heat load treatment system 201 is controlled mainly through the control of the operational capacity of the latent heat compression mechanism 261. In addition, the increase or decrease in the treatment capacity of the sensible heat load treatment system 301 is controlled mainly through the control of the operational capacity of the sensible heat compression mechanism 361. In other words, the increase or decrease in the treatment capacity of the latent heat refrigerant circuit 201 and the increase or decrease in the treatment capacity of the sensible heat refrigerant circuit 301 are performed basically separately.

On the other hand, in the latent heat load treatment by the latent heat load treatment system 201, as described above, the sensible heat is treated along with the latent heat in the latent heat load treatment system 201 through the adsorption process or the regeneration process in the adsorbent heat exchangers 222, 223, 232, 233. In other words, given that the capacity of the sensible heat treatment which is performed along with the latent heat treatment in the latent heat load treatment system 201 is the generated sensible heat treatment capacity value Δt, the sensible heat load that must treated in the sensible heat load treatment system 301 is equal to the amount remaining after subtracting the generated sensible heat treatment capacity value At from the sensible latent heat treatment capacity value ΔT. Nonetheless, the treatment capacity of the latent heat load treatment system 201 and the treatment capacity of the sensible heat load treatment system 301 are increased or decreased basically separately, so that the treatment capacity of the sensible heat load treatment system 301 will be more excessive than the treatment capacity of the latent heat load treatment system 201 by the amount of the generated sensible heat treatment capacity value Δt.

Accordingly, with this air conditioning system 101, the following system control is performed in view of that the above-described relationship.

First, since the information such as the temperature and the relative humidity of the room air to be drawn into the unit, which were detected by the above-described RA inlet temperature/humidity sensors 225, 235, and also the temperature of the air to be supplied to the room from the unit, which was detected by SA supply temperature sensors 227, 237, has been input into latent heat utilization side controller 228, 238, in step S18, the latent heat utilization side controller 228, 238 calculate the generated sensible heat treatment capacity value Δt, which is the temperature difference between the temperature detected by the RA inlet temperature/humidity sensors 225, 235 and the temperature detected by the SA supply temperature sensors 227, 237. Then, this generated sensible heat treatment capacity value Δt is converted to the sensible heat treatment signal K3 that informs the sensible heat heat source side controller 365 whether or not it is necessary to decrease the treatment capacity of the sensible heat utilization units 302, 303. For example, when the absolute value of Δt is lower than a predetermined value (in other words, when the temperature of the air to be supplied to the room from the latent heat utilization units 202, 203 is close to the temperature of the room air, and the treatment capacity of the sensible heat utilization units 302, 303 does not need to be increased or decreased), the sensible heat treatment signal K3 will be "0." When the absolute value of Δt is higher than a predetermined value such that the treatment capacity of the sensible heat utilization units 302, 303 needs to be decreased (in other words, the temperature of the air to be supplied to the room from the latent heat utilization units 202, 203 is lower than the temperature of the room air in the cooling operation, and the treatment capacity of the sensible heat utilization units 302, 303 needs to be decreased), the sensible heat treatment signal K3 will be "a'."

Then, in step S16, when the sensible heat heat source side controller 365 calculates the target condensation temperature TcS2 and the target evaporation temperature TeS2 by using the capacity UP signal K2 of the sensible heat utilization units 302, 303, which was transmitted from the sensible heat utilization side controllers 328, 338 to the sensible heat heat source side controller 365, the sensible heat heat source side controller 365 performs such a calculation by taking into consideration the sensible heat treatment signal K3 that was transmitted from the latent heat utilization side controllers 228, 238 to the sensible heat heat source controller 365 through the latent heat heat source side controller 265. The target condensation temperature TcS2 is calculated by adding the capacity UP signal K2 of the sensible heat utilization units 302, 303 to the current target condensation temperature and also by subtracting the sensible heat treatment signal K3 therefrom. In addition, the target evaporation temperature TeS2 is calculated by subtracting the capacity UP signal K2 of the sensible heat utilization units 302, 303 from the current target evaporation temperature and also by adding the sensible heat treatment signal K3 thereto. Accordingly, when a value of the sensible heat treatment signal K3 is "a'," the target condensation temperature TcS2 will be low, and the target evaporation temperature TeS2 will be high. As a result, the target condensation temperature TcS2 and the target evaporation temperature TeS2 can be changed so as to decrease the treatment capacity of the sensible heat utilization units 302, 303.

Then in step S17, when the cooling operation is being performed, the temperature difference ΔTe2 is calculated based on the target evaporation temperature TeS2 in view of the sensible heat treatment signal K3, and the necessity and amount of the increase or decrease in the operational capacity of the sensible heat compression mechanism 361 will be determined.

By using thus determined operational capacity of the sensible heat compression mechanism 361 to control the operational capacity of the sensible heat compression mechanism 361, the system control to aim the target temperature of the sensible heat utilization units 302, 303 is performed. The system control is performed such that, for example, when the temperature difference ΔTe2 is a positive value, the operational capacity of the sensible heat compression mechanism 361 is decreased, whereas when the temperature difference ΔTe2 is a negative value, the operational capacity of the sensible heat compression mechanism 361 is increased.

In this way, in the air conditioning system 101, the generated sensible heat treatment capacity value Δt corresponding to the generated sensible heat treatment capacity, which is the capacity of the sensible heat treatment that is performed along with the latent heat treatment in the latent heat load treatment system 201, is calculated, and based on this generated sensible heat treatment capacity value Δt, the operational capacity of the sensible heat compression mechanism 361 is controlled. Accordingly, the sensible heat treatment capacity of the sensible heat load treatment system 301 will be prevented from becoming excessive. Consequently, convergence to the target temperature of the room air can be improved.

Note that, here, as an example of the dehumidifying and cooling operation, the case where the cooling operation is performed in the sensible heat load treatment system 301 while the dehumidifying operation is performed in the full ventilation mode in the latent heat load treatment system 201 is described; however, a case where the dehumidifying operation in a different mode such as the circulation mode or the air supply mode is performed in the latent heat load treatment system 201 is also applicable.

<Humidifying and Heating Operation>

Figure 27:
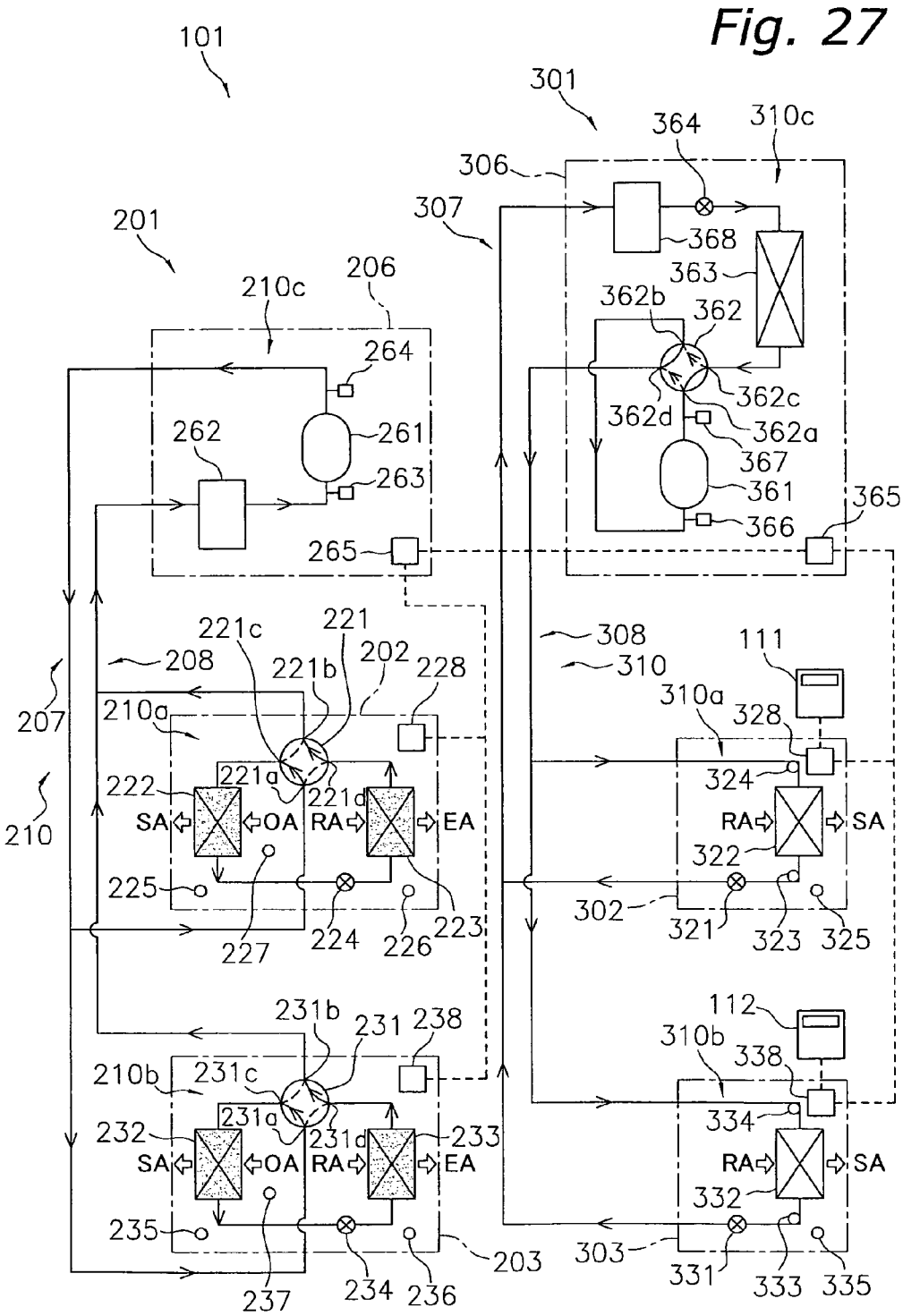
FIG. 27 is a schematic diagram of a refrigerant circuit showing the operation during a humidifying and heating operation in the full ventilation mode in the air conditioning system of the second embodiment.
Figure 28:
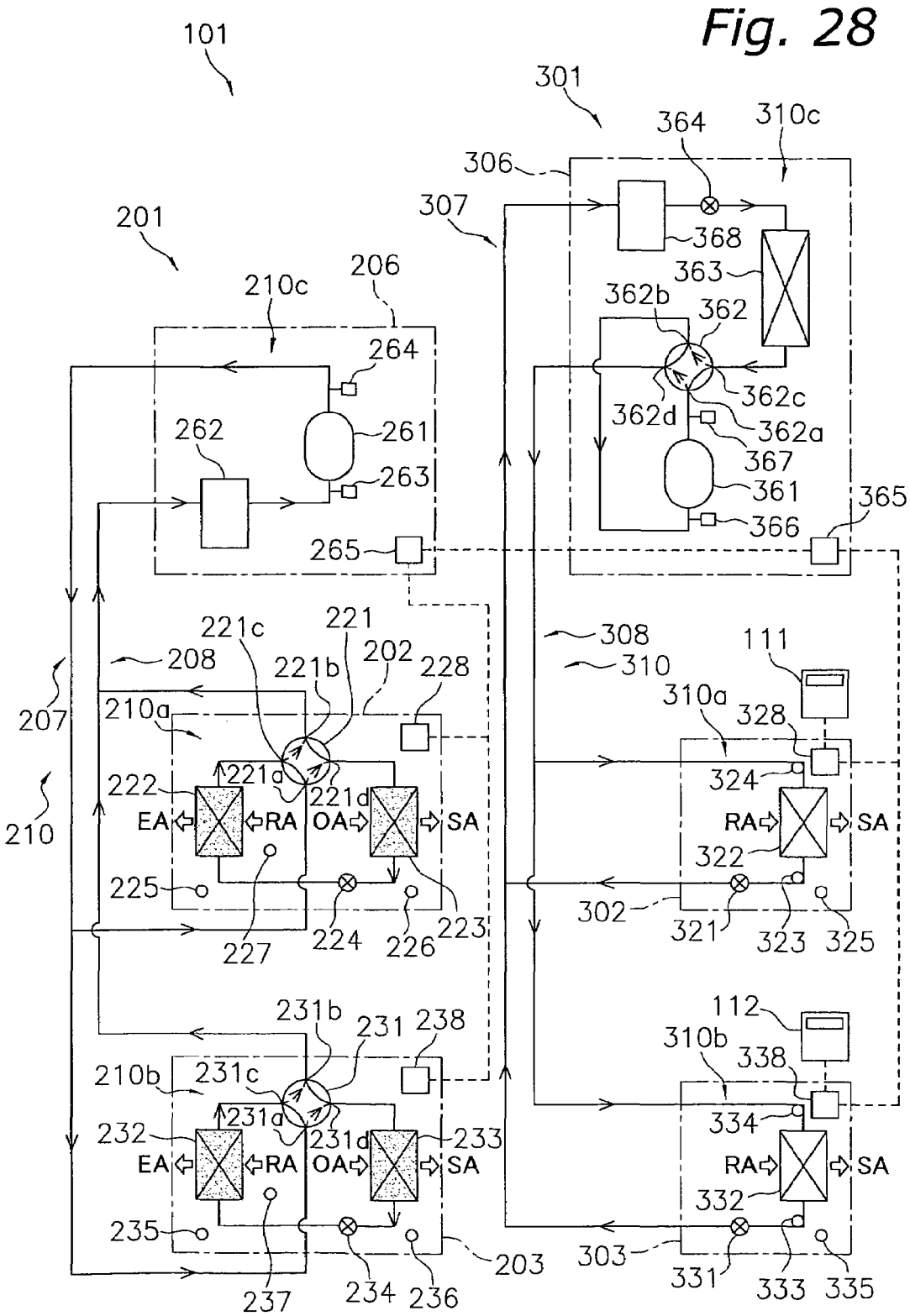
FIG. 28 is a schematic diagram of a refrigerant circuit showing the operation during the humidifying and heating operation in the full ventilation mode in the air conditioning system of the second embodiment.

Next, the operation of a humidifying and heating operation in which the heating operation is performed in the sensible heat load treatment system 301 while the humidifying operation is performed in the full ventilation mode in the latent heat load treatment system 201 will be described with reference to FIGS. 26 to 28. Here, FIGS. 27 and 28 are schematic diagrams of a refrigerant circuit showing the operation during the humidifying and heating operation in the full ventilation mode in the air conditioning system 101.

First, the operation of the latent heat load treatment system 201 will be described.

As in the above-described single operation by the latent heat load treatment system 201, the latent heat utilization unit 202 of the latent heat load treatment system 201 alternately repeats the first operation in which the first adsorbent heat exchanger 222 functions as a condenser and the second adsorbent heat exchanger 223 functions as an evaporator, and the second operation in which the second adsorbent heat exchanger 223 functions as a condenser and the first adsorbent heat exchanger 222 functions as an evaporator. Likewise, the latent heat utilization unit 203 alternately repeats the first operation in which the first adsorbent heat exchanger 232 functions as a condenser and the second adsorbent heat exchanger 233 functions as an evaporator and the second operation in which the second adsorbent heat exchanger 233 functions as a condenser and the first adsorbent heat exchanger 232 functions as an evaporator.

The operation of the two latent heat utilization units 202 and 203 will be described together below.

In the first operation, the regeneration process in the first adsorbent heat exchangers 222, 232 and the adsorption process in the second adsorbent heat exchangers 223, 233 are performed in parallel. During the first operation, as shown in FIG. 27, the latent heat utilization side four-way directional control valves 221, 231 are set to a first state (see the solid lines in the latent heat utilization side four-way directional control valves 221, 231 in FIG. 27). In this state, high-pressure gas refrigerant discharged from the latent heat compression mechanism 261 flows into the first adsorbent heat exchangers 222, 232 through the latent heat discharge gas connection pipe 207 and the latent heat utilization side four-way directional control valves 221, 231, and is condensed while passing through the first adsorbent heat exchangers 222, 232. The condensed refrigerant is pressure-reduced by the latent heat utilization side expansion valves 224, 234, and is subsequently evaporated while passing through the second adsorbent heat exchangers 223, 233. Then, the refrigerant is again drawn into the latent heat compression mechanism 261 through the latent heat utilization side four-way directional control valves 221, 231, the latent heat inlet gas connection pipe 208, and the latent heat accumulator 262 (see the arrows shown on the latent heat refrigerant circuit 210 in FIG. 27).

During the first operation, in the first adsorbent heat exchangers 222, 232, moisture is desorbed from the adsorbent heated by condensation of the refrigerant, and this desorbed moisture is added to the outdoor air OA that is drawn from the outside air inlet. The moisture desorbed from the first adsorbent heat exchangers 222, 232 is carried with the outdoor air OA and supplied as the supply air SA through the supply air outlet to the room. In the second adsorbent heat exchangers 223, 233, moisture in the room air RA is adsorbed onto the adsorbent, the room air RA is dehumidified, the absorption heat thereby generated is transferred to the refrigerant, and the refrigerant evaporates. Then the room air RA dehumidified in the second adsorbent heat exchangers 223, 233 passes through the exhaust air outlet and is exhausted as the exhaust air EA to the outside (see the arrows shown on the both sides of the adsorbent heat exchangers 222, 223, 232, 233 in FIG. 27).

In the second operation, the adsorption process in the first adsorbent heat exchangers 222, 232 and the regeneration process in the second adsorbent heat exchangers 223, 233 are performed in parallel. During the second operation, as shown in FIG. 28, the latent heat utilization side four-way directional control valves 221, 231 are set to a second state (see the broken lines in the latent heat utilization side four-way directional control valves 221, 231 in FIG. 28). In this state, high-pressure gas refrigerant discharged from the latent heat compression mechanism 261 flows into the second adsorbent heat exchangers 223, 233 through the latent heat discharge gas connection pipe 207 and the latent heat utilization side four-way directional control valves 221, 231, and is condensed while passing through the second adsorbent heat exchangers 223, 233. The condensed refrigerant is pressure-reduced by the latent heat utilization side expansion. valves 224, 234, and is subsequently evaporated while passing through the first adsorbent heat exchangers 222, 232. Then, the refrigerant is again drawn into the latent heat compression mechanism 261 through the latent heat utilization side four-way directional control valves 221, 231, the latent heat inlet gas connection pipe 208, and the latent heat accumulator 262 (see the arrows shown on the latent heat refrigerant circuit 210 in FIG. 28).

During the second operation, in the second adsorbent heat exchangers 223, 233, moisture is desorbed from the adsorbent heated by condensation of the refrigerant, and this desorbed moisture is added to the outdoor air OA that is drawn from the outside air inlet. The moisture desorbed from the second adsorbent heat exchangers 223, 233 is carried with the outdoor air OA and is supplied as the supply air SA through the supply air outlet to the room. In the first adsorbent heat exchangers 222, 232, moisture in the room air RA is adsorbed onto the adsorbent, the room air RA is dehumidified, the absorption heat thereby generated is transferred to the refrigerant, and the refrigerant evaporates. Then the room air RA dehumidified in the first adsorbent heat exchangers 222, 232 passes through the exhaust air outlet and is exhausted as the exhaust air EA to the outside (see the arrows shown on the both sides of the adsorbent heat exchangers 222, 223, 232, 233 in FIG. 28).

Here, the system control being performed in the air conditioning system 101 will be described, focusing on the latent heat load treatment system 201.

First, when the target temperature and the target relative humidity are set by the remote controls 111, 112, along with these target temperature and target relative humidity, the following information will be input into the latent heat utilization side controllers 228, 238 of the latent heat utilization units 202, 203: the temperature and relative humidity of the room air to be drawn into the units, which were detected by the RA inlet temperature/humidity sensors 225, 235; and the temperature and relative humidity of outdoor air to be drawn into the units, which were detected by the OA inlet temperature/humidity sensors 226, 236.

Then, in step S11, the latent heat utilization side controllers 228, 238 calculate the target value of the enthalpy or the target absolute humidity based on the target temperature and target relative humidity of the room air; calculate the current value of the enthalpy or the current absolute humidity of the air to be drawn into the units from the room based on the temperature and the relative humidity detected by the RA inlet temperature/humidity sensors 225, 235; and then calculate the required latent heat capacity value Δh, which is the difference between the two calculated values. Then, this value Δh is converted to a capacity UP signal K1 that informs the latent heat heat source side controller 265 whether or not it is necessary to increase the treatment capacity of the latent heat utilization units 202, 203. For example, when the absolute value of Δh is lower than a predetermined value (in other words, when the humidity of the room air is close to the target humidity, and the treatment capacity does not need to be increased or decreased), the capacity UP signal K1 will be "0." When the absolute value of Δh is higher than a predetermined value in a way that the treatment capacity needs to be increased (in other words, the humidity of the room air is lower than the target humidity during the humidifying operation, and the treatment capacity needs to be increased), the capacity UP signal K1 will be "A," and when the absolute value of Δh is higher than a predetermined value in a way that the treatment capacity needs to be decreased (in other words, the humidity of the room air is higher than the target humidity during the humidifying operation, and the treatment capacity needs to be decreased), the capacity UP signal K1 will be "B."

Next, in step S12, the latent heat heat source side controller 265 uses the capacity UP signal K1 of the latent heat utilization units 202, 203, which was transmitted from the latent heat utilization side controllers 228, 238 to the latent heat heat source side controller 265, and calculates the target condensation temperature TcS1 and the target evaporation temperature TeS1. For example, the target condensation temperature TcS1 is calculated by adding the capacity UP signal K1 of the latent heat utilization units 202, 203 to the current target condensation temperature. In addition, the target evaporation temperature TeS1 is calculated by subtracting the capacity UP signal K1 of the latent heat utilization units 202, 203 from the current target evaporation temperature. Accordingly, when a value of the capacity UP signal K1 is "A," the target condensation temperature TcS1 will be high and the target evaporation temperature TeS1 will be low.

Next in step S13, the system condensation temperature Tc1 and the system evaporation temperature Te1, which respectively correspond to measured values of the condensation temperature and the evaporation temperature of the latent heat load treatment system 201 as a whole, are calculated. For example, the system condensation temperature Tc1 and the system evaporation temperature Te1 are calculated by converting the inlet pressure of the latent heat compression mechanism 261, which was detected by the latent heat inlet pressure sensor 263, and the discharge pressure of the latent heat compression mechanism 261, which was detected by the latent heat discharge pressure sensor 264, to the saturation temperatures of the refrigerant at these pressures. Then, the temperature difference ΔTc1 between the system condensation temperature Tc1 and the target condensation temperature TcS1, and the temperature difference ΔTe1 between the system evaporation temperature Te1 and the target evaporation temperature TeS1 are calculated. Then, based on the subtraction between these temperature differences, the necessity and amount of the increase or decrease in the operational capacity of the latent heat compression mechanism 261 will be determined.

By using thus determined operational capacity of the latent heat compression mechanism 261 to control the operational capacity of the latent heat compression mechanism 261, the system control to aim the target relative humidity of the room air is performed. The system control is performed such that, for example, when a value determined by subtracting the temperature difference ΔTe1 from the temperature difference ΔTc1 is a positive value, the operational capacity of the latent heat compression mechanism 261 is increased, whereas when a value determined by subtracting the temperature difference ΔTe1 from the temperature difference ΔTc1 is a negative value, the operational capacity of the latent heat compression mechanism 261 is decreased.

Next, the operation of the sensible heat load treatment system 301 will be described.

The sensible heat heat source side four-way directional control valve 362 in the sensible heat heat source unit 306 of the sensible heat load treatment system 301 is in a heating operation state (the first port 362*a* is connected to the fourth port 362*d*, and also, the second port 362*b* is connected to the third port 362*c*). In addition, the degree of opening of the sensible heat utilization side expansion valves 321, 331 of the sensible heat utilization units 302, 303, respectively, is adjusted according to the heating load of the sensible heat utilization units 302, 303. The degree of opening of the sensible heat heat source side expansion valve 364 is adjusted so as to reduce the pressure of the refrigerant.

When the sensible heat compression mechanism 361 in the sensible heat heat source unit 306 starts with the sensible heat treatment refrigerant circuit 310 being in the above-described state, high-pressure gas refrigerant discharged from the sensible heat compression mechanism 361 passes through the sensible heat heat source side four-way direction control valve 362 and the sensible heat gas connection pipe 308, and is sent to the sensible heat utilization units 302, 303. Then, high-pressure gas refrigerant sent to the sensible heat utilization units 302, 303 is condensed into liquid refrigerant by heat exchange with the room air RA drawn into the unit in the air heat exchangers 322, 332, and is sent to the sensible heat heat source unit 306 through the sensible heat utilization side expansion valves 321, 331 and the sensible heat liquid connection pipe 307. On the other hand, the room air RA heated by heat exchange with the refrigerant in the air heat exchangers 322, 332 is supplied as the supply air SA to the room. The liquid refrigerant sent to the sensible heat heat source unit 306 is passed through the sensible heat receiver 368, is pressure-reduced by the sensible heat heat source side expansion valve 364, is evaporated in the sensible heat heat source side heat exchanger 363 into low-pressure gas refrigerant, and is again drawn back to the sensible heat compression mechanism 361 through the sensible heat heat source side four-way directional control valve 362. Note that, as described below, the degree of opening of the sensible heat utilization side expansion valves 321, 331 is adjusted so that the degree of subcool SC of the air heat exchangers 322, 332, i.e., the temperature difference between the refrigerant temperature on the liquid side of the air heat exchangers 322, 332, which is detected by the liquid side temperature sensors 323, 333, and the refrigerant temperature on the gas side of the air heat exchangers 322, 332, which is detected by gas side temperature sensors 324, 334, is equal to the target degree of subcool SCS.

Here, the system control being performed in the air conditioning system 101 will be described, focusing on the sensible heat load treatment system 301.

First, when the target temperature is set by the remote controls 111, 112, along with these target temperatures, the temperature of the room air to be drawn into the units, which were detected by the RA inlet temperature sensors 325, 335, will be also input into the sensible heat utilization side controllers 328, 338 of the sensible heat utilization units 302, 303, respectively.

Then, in step S14, the sensible heat utilization side controllers 328, 338 calculate the temperature difference between the target temperature of the room air and the temperature detected by RA inlet temperature/humidity sensors 325, 335 (this temperature difference will be hereinafter referred to as the required sensible heat capability value ΔT). Here, as described above, the required sensible heat capacity value ΔT is the difference between the target temperature of the room air and the current temperature of the room air, so that this value ΔT corresponds to the sensible heat load that must be treated in the air conditioning system 101. Then, this required sensible heat capacity value ΔT is converted to a capacity UP signal K2 that informs the sensible heat heat source side controller 365 whether or not it is necessary to increase the treatment capacity of the sensible heat utilization units 302, 303. For example, when the absolute value of ΔT is lower than a predetermined value (in other words, when the temperature of the room air is close to the target temperature of the room air and the treatment capacity does not need to be increased or decreased), the capacity UP signal K2 will be "0." When the absolute value of ΔT is higher than a predetermined value in a way that the treatment capacity needs to be increased (in other words, the temperature of the room air is lower than the target temperature during the heating operation and the treatment capacity needs to be increased), the capacity UP signal K2 will be "a," and when the absolute value of ΔT is higher than a predetermined value in a way that the treatment capacity needs to be decreased (in other words, the temperature of the room air is higher than the target temperature during the heating operation, and the treatment capacity needs to be decreased), the capacity UP signal K2 will be "b."

Next, in step S15, the sensible heat utilization side controllers 328, 338 change the target degree of subcool SCS according to the required sensible heat capability value ΔT. For example, when the treatment capacity of the sensible heat utilization units 302, 303 needs to be decreased (when the capacity UP signal K2 is "b"), the degree of opening of the sensible heat utilization side expansion valves 321, 331 is controlled such that the target degree of subcool SCS is increased and the amount of heat exchanged between the air and the refrigerant in the air heat exchangers 322, 332 is decreased.

Next, in step S16, the sensible heat heat source side controller 365 calculates the target condensation temperature TcS2 and the target evaporation temperature TeS2, using the capacity UP signal K2 of the sensible heat utilization units 302, 303, which was transmitted from the sensible heat utilization side controllers 328, 338 to the sensible heat heat source side controller 365. For example, the target condensation temperature TcS2 is calculated by adding the capacity UP signal K2 of the sensible heat utilization units 302, 303 to the current target condensation temperature. In addition, the target evaporation temperature TeS is calculated by subtracting the capacity UP signal K2 of the sensible heat utilization units 302, 303 from the current target evaporation temperature. Accordingly, when a value of the capacity UP signal K2 is "a," the target condensation temperature TcS2 will be high and the target evaporation temperature TeS2 will be low. Note that, as described above, both the latent heat and the sensible heat are treated in the latent heat load treatment system 201, so that for the calculation of the target condensation temperature TcS2 and the target evaporation temperature TeS2, a calculation method that takes into consideration the capacity of the latent heat treatment that is performed along with the sensible heat treatment in the latent heat load treatment system 201 (generated sensible heat treatment capacity) is employed. However, a description of the method is not described here but will be described later.

Next in step S17, a system condensation temperature Tc2 and a system evaporation temperature Te2, which respectively correspond to measured values of the condensation temperature and the evaporation temperature of the entire sensible heat load treatment system 301, are calculated. For example, the system condensation temperature Tc2 and the system evaporation temperature Te2 are calculated by converting the inlet pressure of the sensible heat compression mechanism 361 detected by the sensible heat inlet pressure sensor 366 and the discharge pressure of the sensible heat compression mechanism 361 detected by the sensible heat discharge pressure sensor 367 to the saturation temperatures of the refrigerant at these pressures. Then, the temperature difference ΔTc2 between the system condensation temperature Tc2 and the target condensation temperature TcS2 and the temperature difference ΔTe2 between the system evaporation temperature Te2 and the target evaporation temperature TeS2 are calculated. When the heating operation is being performed, the necessity and amount of the increase or decrease in the operational capacity of the sensible heat compression mechanism 361 will be determined based on the temperature difference ΔTc2.

By using thus determined operational capacity of the sensible heat compression mechanism 361 to control the operational capacity of the sensible heat compression mechanism 361, the system control to aim the target temperature of the sensible heat utilization units 302, 303 is performed. The system control is performed such that, for example, when the temperature difference ΔTc2 is a positive value, the operational capacity of the latent heat compression mechanism 261 is increased, whereas when the temperature difference ΔTc2 is a negative value, the operational capacity of the latent heat compression mechanism 261 is decreased.

Also in this case, both the latent heat treatment and the sensible heat treatment are being performed in the latent heat load treatment system 201 through the adsorption process or the regeneration process in the adsorbent heat exchangers 222, 223, 232, 233, so that a phenomenon is observed in which the treatment capacity of the sensible heat load treatment system 301 is more excessive than the treatment capacity of the latent heat load treatment system 201 by the amount of the generated sensible heat treatment capacity value Δt.

Therefore, in this air conditioning system 101, the system control is performed in the same manner as the system control during the dehumidifying and cooling operation.

First, since the information such as the temperature and the relative humidity of the room air to be drawn into the unit, which were detected by the above-described RA inlet temperature/humidity sensors 225, 235, and also the temperature of the air to be supplied to the room from the unit, which was detected by the SA supply temperature sensors 227, 237, has been input into the latent heat utilization side controller 228, 238, in step S18, the latent heat utilization side controller 228, 238 calculates the generated sensible heat treatment capacity value Δt, which is the temperature difference between the temperature detected by the RA inlet temperature/humidity sensors 225, 235 and the temperature detected by the SA supply temperature sensors 227, 237. Then, this generated sensible heat treatment capacity value Δt is converted to the sensible heat treatment signal K3 that informs the sensible heat heat source side controller 365 whether or not it is necessary to increase the treatment capacity of the sensible heat utilization units 302, 303. For example, when the absolute value of Δt is lower than a predetermined value (in other words, when the temperature of the air to be supplied to the room from the latent heat utilization units 202, 203 is close to the temperature of the room air, and the treatment capacity of the sensible heat utilization units 302, 303 does not need to be increased or decreased), the sensible heat treatment signal K3 will be "0." When the absolute value of Δt is higher than a predetermined value in a way that the treatment capacity of the sensible heat utilization units 302, 303 needs to be decreased (in other words, the temperature of the air to be supplied to the room from the latent heat utilization units 202, 203 is higher than the temperature of the room air in the heating operation, and the treatment capacity of the sensible heat utilization units 302, 303 needs to be decreased), the sensible heat treatment signal K3 will be "a'."

Then, in step S16, when the sensible heat heat source side controller 365 calculates the target condensation temperature TcS2 and the target evaporation temperature TeS2 by using the capacity UP signal K2 of the sensible heat utilization units 302, 303, which was transmitted from the sensible heat utilization side controllers 328, 338 to the sensible heat heat source side controller 365, the sensible heat heat source side controller 365 performs such a calculation by taking into consideration the sensible heat treatment signal K3 that was transmitted from the latent heat utilization side controllers 228, 238 to the sensible heat heat side controller 365 through the latent heat heat source side controller 265. The target condensation temperature TcS2 is calculated by adding the capacity UP signal K2 of the sensible heat utilization units 302, 303 to the current target condensation temperature and also by subtracting the sensible heat treatment signal K3 therefrom. In addition, the target evaporation temperature TeS2 is calculated by subtracting the capacity UP signal K2 of the sensible heat utilization units 302, 303 from the current target evaporation temperature and also by adding the sensible heat treatment signal K3 thereto. Accordingly, when a value of the sensible heat treatment signal K3 is "a'," the target condensation temperature TcS2 will be low, and the target evaporation temperature TeS2 will be high. As a result, the target condensation temperature TcS2 and the target evaporation temperature TeS2 can be changed so as to decrease the treatment capacity of the sensible heat utilization units 302, 303.

Then in step S17, when the heating operation is being performed, the temperature difference ΔTc2 is calculated based on the target condensation temperature TcS2 in view of the sensible heat treatment signal K3, and the necessity and amount of the increase or decrease in the operational capacity of the sensible heat compression mechanism 361 will be determined.

By using thus determined operational capacity of the sensible heat compression mechanism 361 to control the operational capacity of the sensible heat compression mechanism 361, the system control to aim the target temperature of the sensible heat utilization units 302, 303 is performed. The system control is performed such that, for example, when the temperature difference ΔTc2 is a positive value, the operational capacity of the sensible heat compression mechanism 361 is increased, whereas when the temperature difference ΔTc2 is a negative value, the operational capacity of the sensible heat compression mechanism 361 is decreased.

In this way, in the air conditioning system 101, the generated sensible heat treatment capacity value Δt corresponding to the generated sensible heat treatment capacity, which is the capacity of the sensible heat treatment that is performed along with the latent heat treatment in the latent heat load treatment system 201, is calculated, and based on this generated sensible heat treatment capacity value Δt, the operational capacity of the sensible heat compression mechanism 361 is controlled. Accordingly, the sensible heat treatment capacity of the sensible heat load treatment system 301 will prevented from becoming excessive. Consequently, convergence to the target temperature of the room air can be improved.

Note that, here, as an example of the humidifying and heating operation, the case where the heating operation is performed in the sensible heat load treatment system 301 while the humidifying operation is performed in the full ventilation mode in the latent heat load treatment system 201 is described; however, a case where the humidifying operation in a different mode such as the circulation mode or the air supply mode is performed in the latent heat load treatment system is also applicable.

<System Startup>

Figure 29:
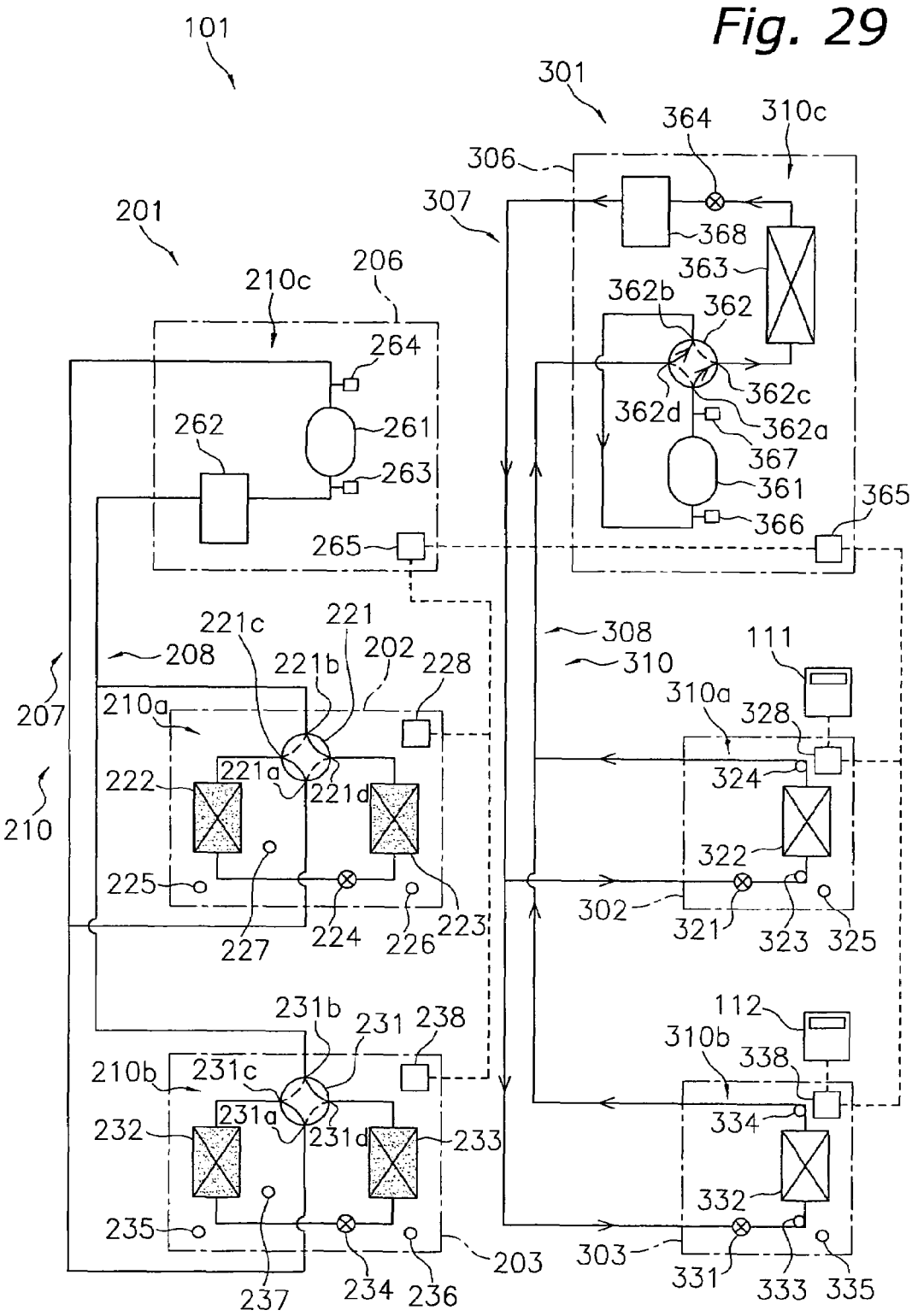
FIG. 29 is a schematic diagram of a refrigerant circuit showing the operation at system startup of the air conditioning system of the second embodiment.
Figure 30:
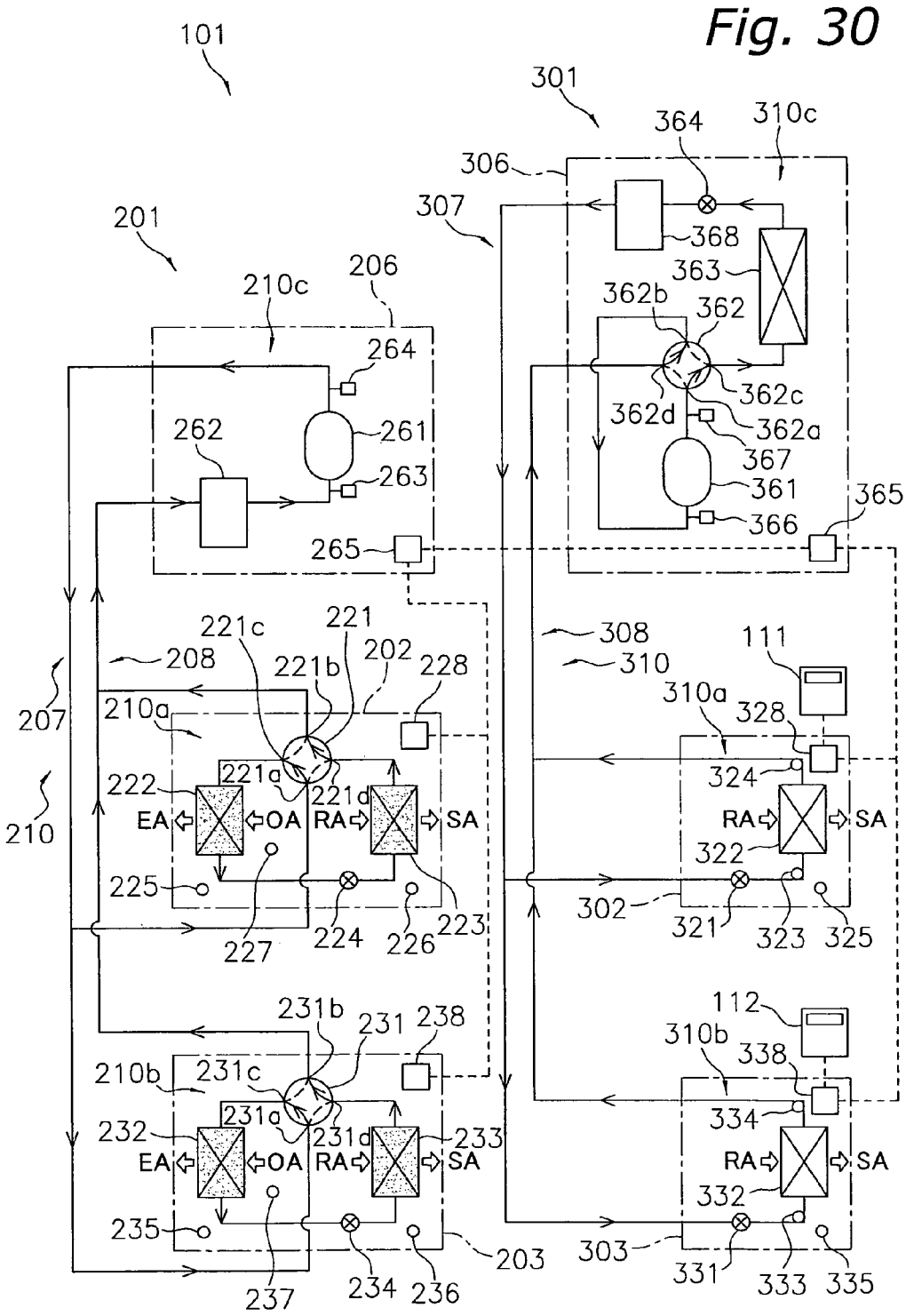
FIG. 30 is a schematic diagram of a refrigerant circuit showing the operation at system startup of the air conditioning system of the second embodiment.

Next, a system startup operation of the air conditioning system 101 will be described with reference to FIGS. 5, 24, 25, 29, and 30. Here, FIG. 29 is a schematic diagram of a refrigerant circuit showing the operation at first system startup of the air conditioning system 101. FIG. 30 is a schematic diagram of a refrigerant circuit showing the operation at second system startup of the air conditioning system 101.

As for the startup operation of the air conditioning system 101, there are three startup methods as described below. A first system startup method is a method to start the operation without having the outdoor air pass through the adsorbent heat exchangers 222, 223, 232, 233 in the latent heat load treatment system 201. A second system startup method is an operation method in which, in a state in which switching between the adsorption process and the regeneration process in the adsorbent heat exchangers 222, 223, 232, 233 in the latent heat load treatment system 201 is stopped, outdoor air is passed through one of the first adsorbent heat exchangers 222, 232 and one of the second adsorbent heat exchangers 223, 233 in the latent heat load treatment system 201 and then be exhausted to the outside, and also room air is passed through the other one of the first adsorbent heat exchangers 222, 232 and the other one of the second adsorbent heat exchangers 223, 233 and then be supplied to the room. A third system startup method is a method to start the operation with the switching time interval between the adsorption process and the regeneration process in the adsorbent heat exchangers 222, 223, 232, 233 being made longer than that during normal operation.

First, the operation at first system startup will be described for the case where the cooling operation is performed in the sensible heat load treatment system 301, with reference to FIG. 29.

When an operation command is issued from the remote controls 111, 112, the sensible heat load treatment system 301 will start and the cooling operation will be performed. Here, since the operation of the sensible heat load treatment system during the cooling operation is the same as that during the above-described dehumidifying and cooling operation, a description thereof will be omitted.

On the other hand, the latent heat load treatment system 201 starts in a state in which, through the operation of air supply fan, exhaust fan, damper, etc., the outdoor air is drawn into the unit and is not passed through the adsorbent heat exchangers 222, 223, 232, 323 in the latent heat utilization units 202, 203.

Consequently, since the refrigerant and the air does not exchange heat therebetween in the adsorbent heat exchangers 222, 223, 232, 233 in the latent heat utilization units 202, 203, the latent heat compression mechanism 261 of the latent heat sensible heat heat source unit 206 will not start, and the latent heat will not be treated in the latent heat load treatment system 201.

Then a system startup operation will be terminated after a predetermined condition is satisfied, and then a normal dehumidifying and cooling operation will be initiated. For example, after a timer provided in the latent heat heat source side controller 265 indicates that a predetermined period of time (for example, about 30 minutes) elapsed since system startup, the system startup operation will be terminated, or after the temperature difference between the target temperature of the room air, which was input by the remote controls 111, 112, and the temperature of the room air to be drawn into the unit, which was detected by the RA inlet temperature sensors 325, 335, is equal to or below a predetermined temperature difference (for example, 3 degree C.), the system startup operation will be terminated.

In this air conditioning system 101, at system startup, mainly the sensible heat is treated by supplying air that has been heat-exchanged in the heat exchanger 322, 332 in the sensible heat utilization units 302, 303, and also outdoor air is prevented from passing through the adsorbent heat exchangers 222, 223, 232, 233 in the latent heat utilization units 202, 203 in order to prevent introduction of outdoor air. Accordingly, at system startup, the introduction of heat load from outdoor air can be prevented when the air conditioning capacity of the latent heat load treatment system is not operating at full capacity, and the target temperature of the room air can be quickly obtained. Consequently, in the air conditioning system 101 comprising the latent heat load treatment system 201 having the adsorbent heat exchangers 222, 223, 232, 233 and configured to mainly treat the latent heat load in the room, and the sensible heat load treatment system 301 having the air heat exchangers 322, 332 and configured to mainly treat the sensible heat load in the room, it will be possible to quickly cool the room at system startup. Note that, here, the case where the cooling operation is performed in the sensible heat load treatment system 301 was described; however, this system startup method is also applicable to a case where the heating operation is performed.

Next, the second operation at system startup will be described for the case where the cooling operation is performed in the sensible heat load treatment system 301, with reference to FIGS. 5 and 30.

When an operation command is issued from the remote controls 111, 112, the sensible heat load treatment system 301 will start up and the cooling operation will be performed. Here, since the operation of the sensible heat load treatment system 301 during the cooling operation is the same as described above, a description thereof will be omitted.

On the other hand, in the latent heat load treatment system 201, in a state in which the switching operation of latent heat utilization side four-way directional control valves 221, 231 is not performed and also an air passage is switched to the same air passage as in the circulation mode by operating the damper and the like, when the air supply fan and the exhaust fan of the latent heat utilization units 202, 203 are operated, room air RA is drawn through the indoor air inlet into the unit, and is supplied as the supply air SA through the supply air outlet to the room, while outdoor air OA is drawn through the outside air inlet into the unit, and is exhausted as the exhaust air EA through the exhaust air outlet to the outside.

When such an operation is performed, in a period immediately after system startup, the desorbed moisture is added to the outdoor air OA drawn from the outside air inlet, and is exhausted as the exhaust air EA through the exhaust air outlet to the outside, while moisture in the room air RA is adsorbed on to the adsorbent, and the room air RA is dehumidified and supplied as the supply air SA through the supply air outlet to the room. However, after some period of time elapsed since system startup, as shown in FIG. 5, the adsorbent of the adsorbent heat exchangers 222, 223, 232, 233 will have adsorbed an amount of moisture close to the maximum moisture adsorption capacity, and after which the sensible heat treatment will be mainly performed. As a result, the latent heat load treatment system 201 will be caused to function as a system to treat the sensible heat load. Accordingly, the sensible heat treatment in the room can be facilitated by increasing the sensible heat treatment capacity in the air conditioning system 101 as a whole.

Then the system startup operation will be terminated after a predetermined condition is satisfied, and then a normal dehumidifying and cooling operation will be initiated. For example, after a timer provided in a latent heat heat source side controller 265 indicates that a predetermined period of time (for example, about 30 minutes) elapsed from system startup, the system startup operation will be terminated, or after the temperature difference between the target temperature of the room air, which was input by the remote controls 111, 112, and the temperature of the room air to be drawn into the unit, which was detected by the RA inlet temperature/humidity sensors 225, 235, is equal to or below a predetermined temperature difference (for example, 3 degree C.), the system startup operation will be terminated.

In this way, in the air conditioning system 101, at system startup, mainly the sensible heat is treated by supplying the room with air that has been heat exchanged in the air heat exchangers 322, 332 of the sensible heat utilization units 302, 303, and also in a state in which switching between the adsorption process and the regeneration process in the adsorbent heat exchangers 222, 223, 232, 233 is stopped, the sensible heat is treated by passing outdoor air through the adsorbent heat exchangers 222, 223, 232, 233 and then exhausting the air to the outside. As a result, at system startup, the sensible heat treatment in the room can be facilitated and the target temperature of the room air can be quickly obtained. Consequently, in the air conditioning system 101 comprising the latent heat load treatment system 201 having the adsorbent heat exchangers 222, 223, 232, 233 and configured to mainly treat the latent heat load in the room, and the sensible heat load treatment system 301 having the air heat exchangers 322, 332 and configured to mainly treat the sensible heat load in the room, it will be possible to quickly cool the room at system startup. Note that, here, the case where the cooling operation is performed in the sensible heat load treatment system 301 was described; however, this system startup method is also applicable to a case where the heating operation is performed.

Next, the third operation at system startup will be described for the case where the dehumidifying operation is performed in the full ventilation mode in the latent heat load treatment system 201 and also the cooling operation is performed in the sensible heat load treatment system 301, with reference to FIGS. 5, 24, and 25.

When an operation command is issued from the remote controls 111, 112, the sensible heat load treatment system 301 will start up and the cooling operation will be performed. Here, since the operation of the sensible heat load treatment system 301 during the cooling operation is the same as described above, a description thereof will be omitted.

On the other hand, the latent heat load treatment system 201 is the same described above in that the dehumidifying operation is performed in the full ventilation mode; however, the switching time interval between the adsorption process and the regeneration process is set to the switching time interval D, which prioritizes the treatment of the sensible heat process, and which has a longer interval than the switching time interval C that prioritizes the treatment of the latent heat used in the normal operation. Therefore, the switching operation of the latent heat utilization side four-way directional control valves 221, 231 in the latent heat utilization units 202, 203, respectively, is performed at longer cycle than that during normal operation only at system startup. Consequently, in a period immediately after the latent heat utilization side four-way directional control valves 221, 231 are switched, the adsorbent heat exchangers 222, 223, 232, 233 will mainly treat the latent heat; however, when time D elapses, mainly the sensible heat will be treated. As a result, the latent heat load treatment system 201 will be caused to function as a system that mainly treats the sensible heat load. Accordingly, the sensible heat treatment in the room can be facilitated by increasing the sensible heat treatment capacity in the air conditioning system 101 as a whole.

Then the system startup operation will be terminated after a predetermined condition is satisfied, and then a normal dehumidifying and cooling operation will be initiated. For example, after a timer provided in the latent heat source side controller 265 indicates that a predetermined period of time (for example, about 30 minutes) elapsed since system startup, the system startup operation will be terminated, or after the temperature difference between the target temperature of the room air, which was input by the remote controls 111, 112, and the temperature of the room air to be drawn into the unit, which was detected by the RA inlet temperature/humidity sensors 225, 235, is equal to or below a predetermined temperature difference (for example, 3 degree C.), the system startup operation will be terminated.

In this way, in this air conditioning system 101, at system startup, the switching time interval in the adsorbent heat exchangers 222, 223, 232, 233 in the latent heat utilization units 202, 203 is made longer than that during normal operation, and mainly the sensible heat is treated. As a result, the target temperature of the room air can be quickly obtained. Consequently, in the air conditioning system 101 comprising the latent heat load treatment system 201 having the adsorbent heat exchangers 222, 223, 232, 233 and configured to mainly treat the latent heat load in the room, and the sensible heat load treatment system 301 having the air heat exchangers 322, 332 and configured to mainly treat the sensible heat load in the room, it will be possible to quickly cool the room at system startup. Note that, here, the case where the cooling operation is performed in the sensible heat load treatment system 301 is described; however, this system startup method is also applicable to a case where the heating operation is performed. In addition, here, the case where the latent heat load treatment system 201 is operated in the full ventilation mode was described; however, this system startup method can be applied to a case where the system is operated in a different mode such as the circulation mode or the air supply mode.

When the above-described system startup of the air conditioning system 101 is performed, which preferentially treats the sensible heat load in the room, there is a case where, for example, the temperature of the room air at system startup is close to the target temperature of the room air. In such a case, the above-described system startup does not need to be performed, so that the system startup operation can be omitted and then the normal operation will be initiated.

Therefore, this air conditioning system 101 is configured such that, at system startup, whether or not the temperature difference between the target temperature of the room air and the temperature of the room air is equal to or below a predetermined temperature difference (for example, the same temperature difference as a condition to terminate the system startup operation) will be determined before starting the above-described operation that preferentially treats the sensible heat load in the room, and when the temperature difference between the target temperature of the room air and the temperature of the room air is equal to or below a predetermined temperature, the system startup operation is prevented from being performed.

Accordingly, in the air conditioning system 101, at system startup, the operation in which the sensible heat load in the room is preferentially treated is prevented from being unnecessarily performed, and therefore the normal operation in which the latent heat load and the sensible heat load in the room are treated can be initiated as soon as possible.

(3) Characteristics of the Air Conditioning System

The air conditioning system 101 of the present embodiment has the following characteristics.

(A)

In the air conditioning system 101 of the present embodiment, the latent heat load treatment system 201 has the same configuration as that in the air conditioning system 1 of the first embodiment, so that the air conditioning system 101 have the same characteristics as in the air conditioning system 1 of the first embodiment.

Further, the air conditioning system 101 of the present embodiment further comprises the sensible heat load treatment system 301 comprising the sensible heat heat source unit 306 that includes the sensible heat heat source side refrigerant circuit 310*c*, and the sensible heat utilization units 302, 303 that include sensible heat utilization side refrigerant circuits 310*a*, 310*b* having the air heat exchangers 302, 332, in addition to the latent heat load treatment system 201 comprising the latent heat heat source unit 206 that includes a latent heat heat source side refrigerant circuit 210*c* and the latent heat utilization units 202, 203 that include the latent heat utilization side refrigerant circuits 210*a*, 210*b* having the adsorbent heat exchangers 222, 223, 232, 233. Consequently, it is possible to treat the latent heat load and sensible heat load in the room separately by the two treatment systems 201, 301.

(B)

In the air conditioning system 101 of the present embodiment, the required latent heat treatment capacity (corresponding to Δh), which is the latent heat load that must be treated in the air conditioning system 101 as a whole, and the required sensible heat treatment capacity (corresponding to ΔT), which is the sensible heat load that must be treated in the air conditioning system 101 as a whole are treated by using the latent heat refrigerant circuit 210 in the latent heat load treatment system 201 and the sensible heat refrigerant circuit 310 in the sensible heat load treatment system 301. Here, the treatment capacity of the latent heat refrigerant circuit 210 is increased or decreased mainly through the control of the operational capacity of the latent heat compression mechanism 261. In addition, the treatment capacity of the sensible heat refrigerant circuit 310 is increased or decreased mainly through the control of the operational capacity of the sensible heat compression mechanism 361. In other words, the increase or decrease in the treatment capacity of the latent heat refrigerant circuit 210 and the increase or decrease in the treatment capacity of the sensible heat refrigerant circuit 310 are performed basically separately.

On the other hand, in the treatment of the latent heat load in the latent heat refrigerant circuit 210, the sensible heat is treated along with the latent heat in the latent heat refrigerant circuit 210 through the adsorption process or the regeneration process in the adsorbent heat exchangers 222, 223, 232, 233. In other words, given that the capacity of the sensible heat treatment that is performed along with the latent heat treatment in the latent heat load treatment system 210 is the generated sensible heat treatment capacity (corresponding to Δt), the sensible heat load that must treated in the sensible heat load treatment system 310 is equal to the amount remaining after subtracting the generated sensible heat treatment capacity from the required latent heat treatment capacity. Nonetheless, the increase or decrease in the treatment capacity of the latent heat load treatment system 210 and the increase or decrease in the treatment capacity of the sensible heat load treatment system 310 are performed basically separately, so that the treatment capacity of the sensible heat load treatment system 310 is more excessive than the treatment capacity of the latent heat load treatment system 210 by the amount of the generated sensible heat treatment capacity.

On the contrary, the air conditioning system 101 of the present embodiment calculates the generated sensible heat treatment capacity value Δt corresponding to the capacity of the sensible heat load treatment that is performed along with the latent heat treatment in the latent heat refrigerant circuit 210 through the adsorption process or the regeneration process in the adsorbent heat exchangers 222, 223, 232, 233, and controls the operational capacity of the sensible heat compression mechanism 361 in view of this generated sensible heat treatment capacity value Δt. As a result, the sensible heat treatment capacity in the sensible heat refrigerant circuit 310 is prevented from becoming excessive. Consequently, convergence to the target temperature of the room air can be improved.

(C)

In this air conditioning system 101 of the present embodiment, at system startup, mainly the sensible heat is treated by supplying air that has been heat-exchanged in the heat exchanger 322, 332 in the sensible heat utilization units 302, 303, and also outdoor air is prevented from passing through the adsorbent heat exchangers 222, 223, 232, 233 in the latent heat utilization units 202, 203 in order to prevent introduction of outdoor air. Accordingly, at system startup, the introduction of heat load from outdoor air can be prevented when the air conditioning capacity of the latent heat load treatment system is not operating at full capacity, and the target temperature of the room air can be quickly obtained. Consequently, in the air conditioning system 101 comprising the latent heat load treatment system 201 having the adsorbent heat exchangers 222, 223, 232, 233 and configured to mainly treat the latent heat load in the room, and the sensible heat load treatment system 301 having the air heat exchangers 322, 332 and configured to mainly treat the sensible heat load in the room, it will be possible to quickly cool and heat the room at system startup.

In addition, in the air conditioning system 101 of the present embodiment, at system startup, mainly the sensible heat is treated by supplying the room with air that has been heat exchanged in the air heat exchangers 322, 332 of the sensible heat utilization units 302, 303, and also in a state in which switching between the adsorption process and the regeneration process in the adsorbent heat exchangers 222, 223, 232, 233 is stopped, the sensible heat is treated by passing outdoor air through the adsorbent heat exchangers 222, 223, 232, 233 and then exhausting the air to the outside. As a result, at system startup, the sensible heat treatment in the room can be facilitated and the target temperature of the room air can be quickly obtained. Consequently, in the air conditioning system 101 comprising the latent heat load treatment system 201 having the adsorbent heat exchangers 222, 223, 232, 233 and configured to mainly treat the latent heat load in the room, and the sensible heat load treatment system 301 having the air heat exchangers 322, 332 and configured to mainly treat the sensible heat load in the room, it will be possible to quickly cool and heat the room at system startup.

In addition, in the air conditioning system 101 of the present embodiment, at system startup, the switching time interval in the adsorbent heat exchangers 222, 223, 232, 233 in the latent heat utilization units 202, 203 is made longer than that during normal operation, and mainly the sensible heat is treated. As a result, the target temperature of the room air can be quickly obtained. Consequently, in the air conditioning system 101 comprising the latent heat load treatment system 201 having the adsorbent heat exchangers 222, 223, 232, 233 and configured to mainly treat the latent heat load in the room, and the sensible heat load treatment system 301 having the air heat exchangers 322, 332 and configured to mainly treat the sensible heat load in the room, it will be possible to quickly cool and heat the room at system startup.

Further, these operations at system startup are terminated after a period of time enough to treat the sensible heat elapsed since the system startup, or are terminated after the difference between the target temperature of the room air and the temperature of the room air is equal to or below a predetermined temperature difference, and therefore the normal operation in which the latent heat load and the sensible heat load in the room are treated can be initiated as soon as possible.

In addition, before starting these operations at system startup, the air conditioning system determines whether or not it is necessary to start such operations based on the outdoor air temperature. Accordingly, at system startup, the operation in which the sensible heat load in the room is preferentially treated is prevented from being unnecessarily performed, and therefore the normal operation in which the latent heat load and the sensible heat load in the room are treated can be initiated as soon as possible.

(4) Modifies Example

Figure 31:
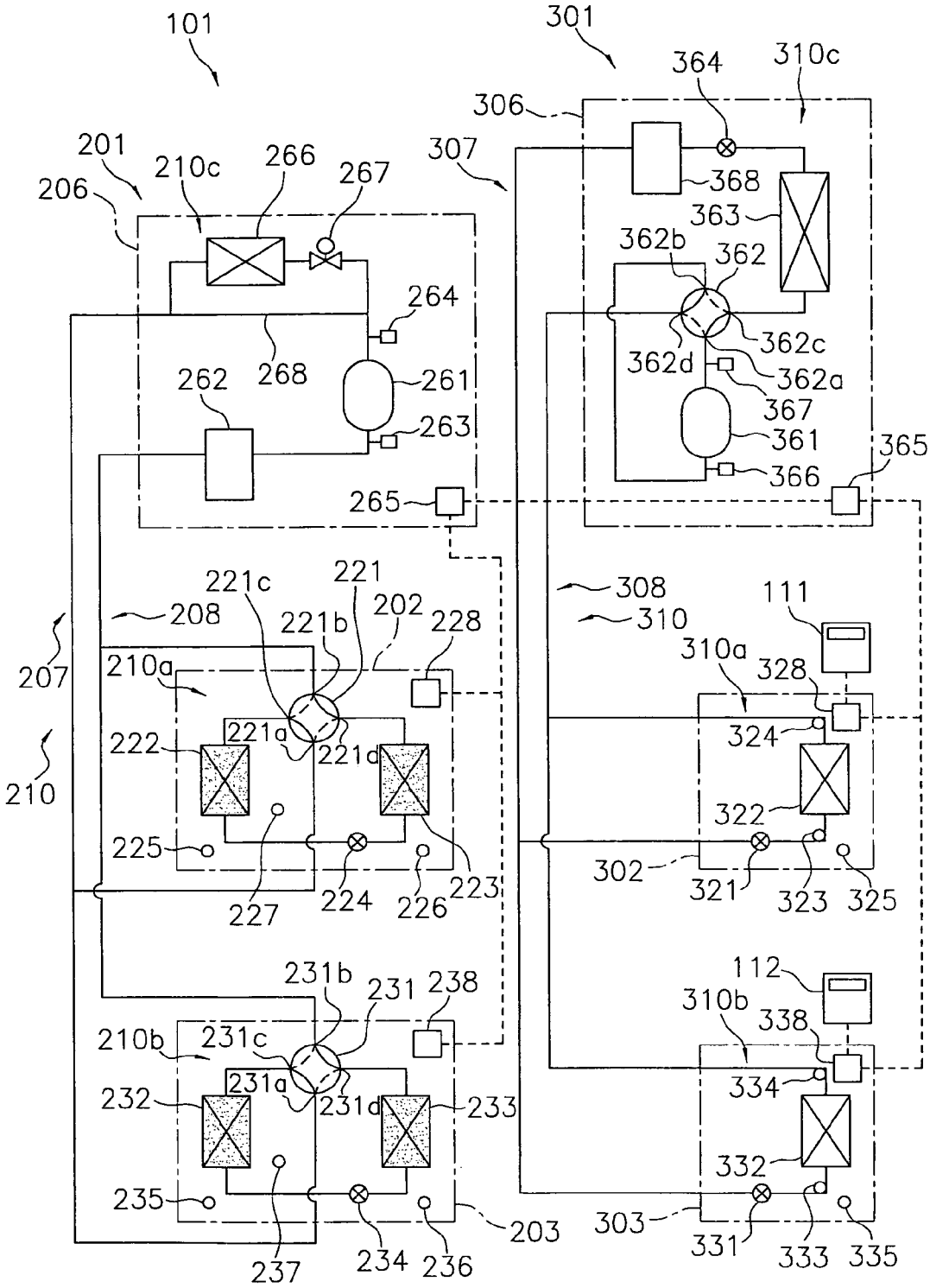
FIG. 31 is a schematic diagram of a refrigerant circuit of an air conditioning system according to a modified example of the second embodiment.

As shown in FIG. 31, in a latent heat heat source unit 206 of the present embodiment, as with the heat source unit 6 of the first embodiment, a latent heat supplementary condenser 266 may be connected thereto so as to allow a portion of high-pressure gas refrigerant, which is discharged from the latent heat compression mechanism 261 and sent to the latent heat utilization units 202, 203, to be condensed.

Third Embodiment (1) Configuration of the Air Conditioning System

Figure 32:
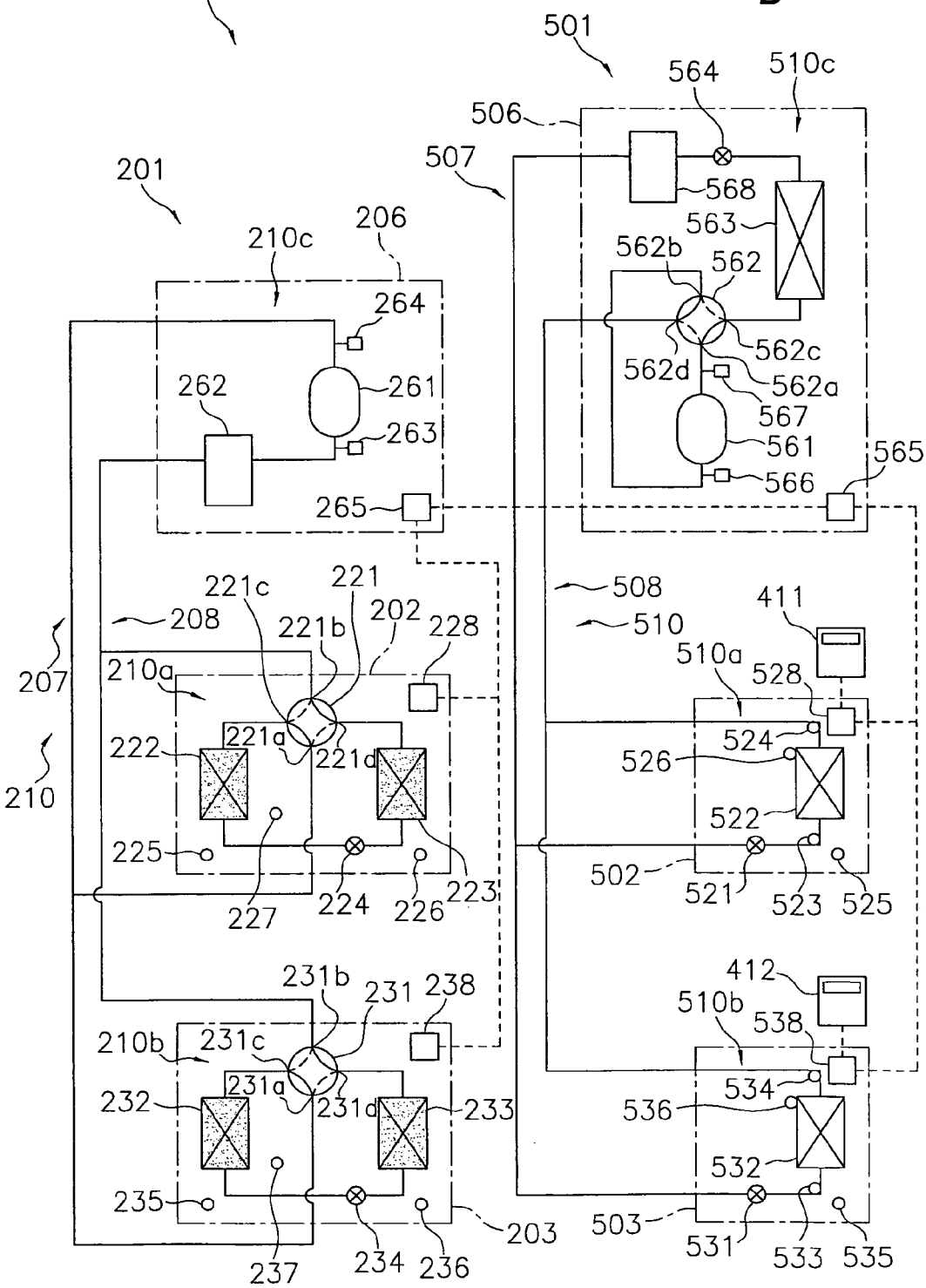
FIG. 32 is a schematic diagram of a refrigerant circuit of an air conditioning system of a third embodiment according to the present invention.

FIG. 32 a schematic diagram of a refrigerant circuit of an air conditioning system 401 of a third embodiment according to the present invention. The air conditioning system 401 is an air conditioning system that treats the latent heat load and the sensible heat load in the room of a building and the like by operating a vapor compression type refrigeration cycle. The air conditioning system 401 is so-called separate type multi air conditioning system, and mainly comprises: a latent heat load treatment system 201 that mainly treats the latent heat load in the room; and a sensible heat load treatment system 501 that mainly treat the sensible.

Since the configurations of the latent heat load treatment system 201 is the same as that of the latent heat load treatment system 201 of the second embodiment, a description of each component thereof will be omitted.

The sensible heat load treatment system 501 is different from the sensible heat load treatment system 301 of the second embodiment in that condensation sensors 526, 536 and RA inlet temperature/humidity sensors 525, 535 are provided in the sensible heat utilization units 502, 503; however, since the configuration of other components is the same as that in the sensible heat load treatment system 301 in the air conditioning system 101 of the second embodiment, all reference numerals representing each component of the sensible heat load treatment system 301 of the second embodiment will be simply changed to those in 500*s*, and a description of those other components will be omitted.

The condensation sensors 526, 536 are provided to function as condensation detection mechanisms that detect the presence of condensation in air heat exchangers 522, 532, respectively. Note that in the embodiment, the condensation sensors 526, 536 are used; however, it is not limited thereto and a float switch may be used instead of a condensation sensor, as long as a function as a condensation detection mechanism is ensured.

The RA Inlet temperature/humidity sensors 525, 535 are temperature/humidity sensors that detect the temperature and the relative humidity of the room air RA to be drawn into the units.

In addition, as described below, the sensible heat utilization units 502, 503 of the present embodiment are controlled such that a cooling operation is performed so as to prevent the generation of condensation in the air heat exchangers 522, 532 when performing the dehumidifying and cooling operation. In other words, the sensible heat utilization units 502, 503 are controlled so as to perform the sensible heat cooling operation. Accordingly, a drain pipe is not connected to the sensible heat utilization units 502, 503.

Further, as described above, latent heat utilization units 202, 203 used in the latent heat load treatment system 201 can treat the latent heat through the adsorption process and the regeneration process in adsorbent heat exchangers 222, 223, 232, 233, so that a drain pipe is not connected, as in the case of the sensible heat utilization units 502, 503. In other words, a drainless system is achieved in the entire air conditioning system 401 of the present embodiment.

(2) Operation of the Air Conditioning System

Next, the operation of the air conditioning system 401 of the present embodiment will be described. In the air conditioning system 401, the latent heat load in the room can be treated by the latent heat load treatment system 201, and only the sensible heat load in the room can be treated by the sensible heat load treatment system 501. Each type of operation will be described below.

<Drainless Dehumidifying and Cooling Operation>

Figure 33:
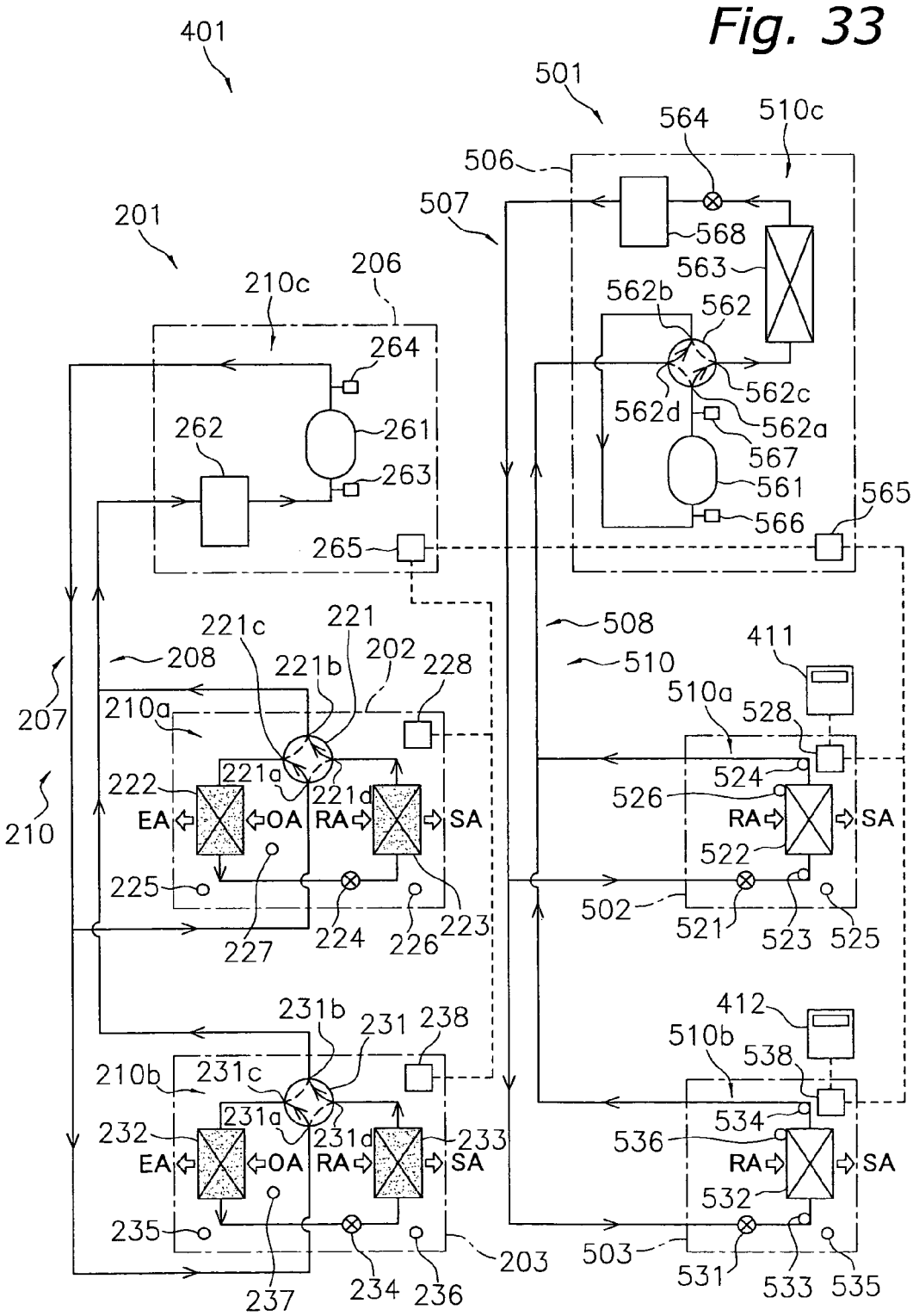
FIG. 33 is a schematic diagram of a refrigerant circuit showing the operation during a drainless dehumidifying and cooling operation in the full ventilation mode in the air conditioning system according the third embodiment.
Figure 34:
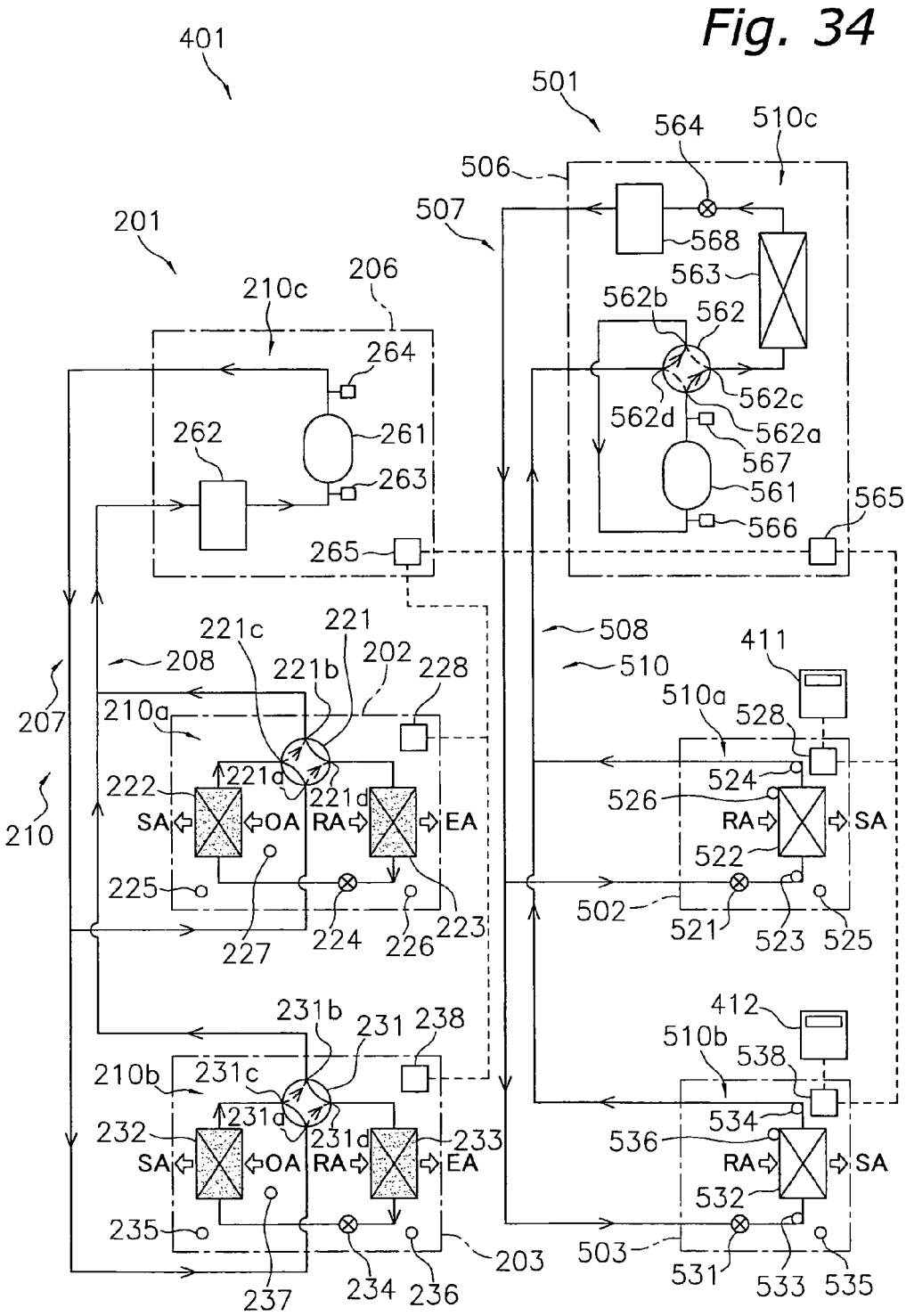
FIG. 34 is a schematic diagram of a refrigerant circuit showing the operation during the drainless dehumidifying and cooling operation in the full ventilation mode in the air conditioning system according the third embodiment.
Figure 35:
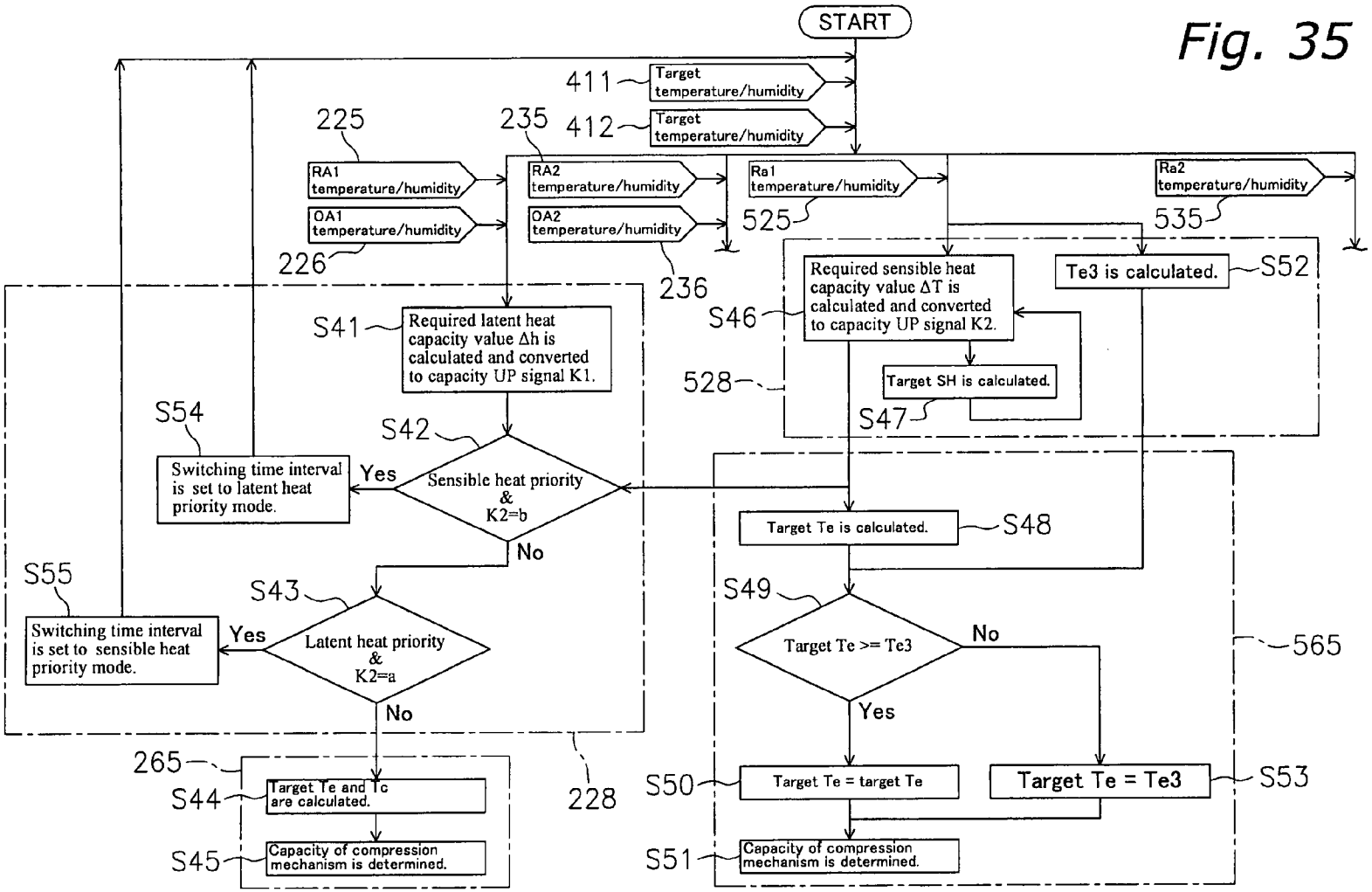
FIG. 35 is a diagram of control flow during the drainless dehumidifying and cooling operation in the air conditioning system according the third embodiment.

The operation of a drainless cooling operation in which the dehumidifying and cooling operation is performed in the sensible heat load treatment system 501 while the dehumidifying operation is performed in the full ventilation mode in the latent heat load treatment system 201 will be described with reference to FIGS. 33, 34, and 35. Here, FIGS. 33 and 34 are schematic diagrams of a refrigerant circuit showing the operation during a drainless dehumidifying and cooling operation in the full ventilation mode in the air conditioning system 401. FIG. 35 is a diagram of control flow during normal operation in the air conditioning system 401. Note that as for FIG. 35, since the latent heat utilization unit 202 and the sensible heat utilization unit 502 as a pair have the same control flow as the latent heat utilization unit 203 and the sensible heat utilization unit 503 as a pair, so that the illustration of the control flow of the latent heat utilization unit 203 and the sensible heat utilization unit 503 as a pair is omitted.

First, the operation of the latent heat load treatment system 201 will be described. Note that, the control necessary to achieve the sensible heat cooling operation in the sensible heat load treatment system 501 will be described later; and the basic control of the latent heat load treatment system 201 will be described herein.

As with the dehumidifying and cooling operation in the air conditioning system 101 of the second embodiment, the latent heat utilization unit 202 of the latent heat load treatment system 201 alternately repeats the first operation in which the first adsorbent heat exchanger 222 functions as a condenser and the second adsorbent heat exchanger 223 functions as an evaporator, and the second operation in which that second adsorbent heat exchanger 223 functions as a condenser and the first adsorbent heat exchanger 222 functions as an evaporator. Likewise, the latent heat utilization unit 203 alternately repeats the first operation in which the first adsorbent heat exchanger 232 functions as a condenser and the second adsorbent heat exchanger 233 functions as an evaporator, and the second operation in which the second adsorbent heat exchanger 233 functions as a condenser and the first adsorbent heat exchanger 232 functions as an evaporator.

The operation of both of the utilization units 202, 203 will be described together below.

In the first operation, the regeneration process in the first adsorbent heat exchangers 222, 232 and the adsorption process in the second adsorbent heat exchangers 223, 233 are performed in parallel. During the first operation, as shown in FIG. 33, latent heat utilization side four-way directional control valves 221, 231 are set to a first state (see the solid lines in the latent heat utilization side four-way directional control valves 221, 231 in FIG. 33). In this state, high-pressure gas refrigerant discharged from a compression mechanism 261 flows into the first adsorbent heat exchangers 222, 232 through a latent heat discharge gas connection pipe 207 and the latent heat utilization side four-way directional control valves 221, 231, and is condensed while passing through the first adsorbent heat exchangers 222, 232. The condensed refrigerant is pressure-reduced by latent heat utilization side expansion valves 224, 234, and is subsequently evaporated while passing through the second adsorbent heat exchangers 223, 233. Then, the refrigerant is again drawn into the latent heat compression mechanism 261 through the latent heat utilization side four-way directional control valves 221, 231, a latent heat inlet gas connection pipe 208, and a latent heat accumulator 262 (see the arrows shown on a latent heat refrigerant circuit 210 in FIG. 33).

During the first operation, in the first adsorbent heat exchangers 222, 232, moisture is desorbed from the adsorbent heated by condensation of the refrigerant, and this desorbed moisture is added to the room air RA that is drawn from the indoor air inlet. The moisture desorbed from the first adsorbent heat exchangers 222, 232 is carried with the room air RA and is exhausted as the exhaust air EA through the exhaust air outlet to the outside. In the second adsorbent heat exchangers 223, 233, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 223, 233 passes through the supply air outlet and is supplied as the supply air SA to the room (see the arrows shown on the both sides of the adsorbent heat exchangers 222, 223, 232, 233 in FIG. 33).

In the second operation, the adsorption process in the first adsorbent heat exchangers 222, 232 and the regeneration process in the second adsorbent heat exchangers 223, 233 are performed in parallel. During the second operation, as shown in FIG. 34, the latent heat utilization side four-way directional control valves 221, 231 are set to a second state (see the broken lines in the latent heat utilization side four-way directional control valves 221, 231 in FIG. 34). In this state, high-pressure gas refrigerant discharged from the latent heat compression mechanism 261 flows into the second adsorbent heat exchangers 223, 233 through the latent heat discharge gas connection pipe 207 and the latent heat utilization side four-way directional control valves 221, 231, and is condensed while passing through the second adsorbent heat exchangers 223, 233. The condensed refrigerant is pressure-reduced by the latent heat utilization side expansion valves 224, 234, and is subsequently evaporated while passing through the first adsorbent heat exchangers 222, 232. Then, the refrigerant is again drawn into the latent heat compression mechanism 261 through the latent heat utilization side four-way directional control valves 221, 231, the latent heat inlet gas connection pipe 208, and the latent heat accumulator 262 (see the arrows shown on the latent heat refrigerant circuit 210 in FIG. 34).

During the second operation, in the second adsorbent heat exchangers 223, 233, moisture is desorbed from the adsorbent heated by condensation of the refrigerant, and this desorbed moisture is added to the room air RA that is drawn from the indoor air inlet. The moisture desorbed from the second adsorbent heat exchangers 223, 233 is carried with the room air RA and is exhausted as the exhaust air EA through the exhaust air outlet to the outside. In the first adsorbent heat exchangers 222, 232, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 222, 232 passes through the supply air outlet and is supplied as the supply air SA to the room (see the arrows shown on the both sides of the adsorbent heat exchangers 222, 223, 232, 233 in FIG. 34).

Here, the system control being performed in the air conditioning system 401 will be described, focusing on the latent heat load treatment system 201.

First, when the target temperature and the target relative humidity are set by remote controls 411, 412, along with the target temperature and the target relative humidity, the following information will be input into latent heat utilization side controllers 228, 238 of the latent heat utilization units 202, 203, respectively: the temperature and the relative humidity of the room air to be drawn into the units, which were detected by RA inlet temperature/humidity sensors 225, 235; and the temperature and the relative humidity of outdoor air to be drawn into the units, which were detected by OA inlet temperature/humidity sensors 226, 236.

Then, in step S41, the latent heat utilization side controllers 228, 238 calculate the target value of the enthalpy or the target absolute humidity based on the target temperature and target relative humidity of the room air; calculate the current value of the enthalpy or the current absolute humidity of the air to be drawn into the unit from the room, based on the temperature and the relative humidity detected by the RA inlet temperature/humidity sensors 225, 235; and then calculate the required latent heat capacity value Δh, which is the difference between the two calculated values. Then, this value Δh is converted to a capacity UP signal K1 that informs a heat source side controller 265 whether or not it is necessary to increase the treatment capacity of the latent heat utilization units 202, 203. For example, when the absolute value of Δh is lower than a predetermined value (in other words, when the humidity of the room air is close to the target humidity, and the treatment capacity does not need to be increased or decreased), the capacity UP signal K1 will be "0." When the absolute value of Δh is higher than a predetermined value in a way that the treatment capacity needs to be increased (in other words, the humidity of the room air is higher than the target humidity during the dehumidifying operation and the treatment capacity needs to be increased), the capacity UP signal K1 will be "A," and when the absolute value of Δh is higher than a predetermined value in a way that the treatment capacity needs to be decreased (in other words, the humidity of the room air is lower than the target humidity during the dehumidifying operation, and the treatment capacity needs to be decreased), the capacity UP signal K1 will be "B."

Next in step S44, the latent heat heat source side controller 265 uses the capacity UP signal K1 of the latent heat utilization units 202, 203, which was transmitted from the latent heat utilization side controllers 228, 238 to the latent heat heat source side controller 265 through steps S42 and S43 (to be described below), and calculates the target condensation temperature TcS1 and the target evaporation temperature TeS1. For example, the target condensation temperature TcS1 is calculated by adding the capacity UP signal K1 of the latent heat utilization units 202, 203 to the current target condensation temperature. In addition, the target evaporation temperature TeS1 is calculated by subtracting the capacity UP signal K1 of the latent heat utilization units 202, 203 from the current target evaporation temperature. Consequently, when a value of the capacity UP signal K1 is "A," the target condensation temperature TcS1 will be high, and the target evaporation temperature TeS1 will be low.

Next, in step S45, the system condensation temperature Tc1 and the system evaporation temperature Te1, which respectively correspond to measured values of the condensation temperature and the evaporation temperature of the latent heat load treatment system 201 as a whole, are calculated. For example, the system condensation temperature Tc1 and the system evaporation temperature Te1 are calculated by converting the inlet pressure of the latent heat compression mechanism 261, which was detected by the latent heat inlet pressure sensor 263, and the discharge pressure of the latent heat compression mechanism 261, which was detected by a latent heat discharge pressure sensor 264, into saturation temperatures of the refrigerant at these pressures. Then, the temperature difference ΔTc1 between the system condensation temperature Tc1 and the target condensation temperature TcS1, and the temperature difference ΔTe1 between the system evaporation temperature Te1 and the target evaporation temperature TeS1 are calculated. Then based on these temperature differences, the necessity and amount of the increase or decrease in the operational capacity of the latent heat compression mechanism 261 will be determined.

By using thus determined operational capacity of the latent heat compression mechanism 261 to control the operational capacity of the latent heat compression mechanism 261, the system control to aim the target relative humidity of the room air is performed. The system control is performed such that, for example, when a value determined by subtracting the temperature difference ΔTe1 from the temperature difference ΔTc1 is a positive value, the operational capacity of the latent heat compression mechanism 261 is increased, whereas when a value determined by subtracting the temperature difference ΔTe1 from the temperature difference ΔTc1 is a negative value, the operational capacity of the latent heat compression mechanism 261 is decreased.

Next, the operation of the sensible heat load treatment system 501 will be described.

A sensible heat heat source side four-way directional control valve 562 in a sensible heat heat source unit 506 of the sensible heat load treatment system 501 is in a cooling operation state (a first port 562*a* is connected to a third port 562*c*, and also, a second port 562*b* is connected to a fourth port 562*d*). Further, the degree of opening of sensible heat utilization side expansion valves 521, 531 of the sensible heat utilization units 502, 503 is adjusted so as to reduce the pressure of the refrigerant. A sensible heat heat source side expansion valve 564 is opened.

When a sensible heat compression mechanism 561 in the sensible heat heat source unit 506 starts with a sensible heat treatment refrigerant circuit 510 being in the above-described state, high-pressure gas refrigerant discharged from the sensible heat compression mechanism 561 passes through the sensible heat heat source side four-way direction control valve 562, flows into a sensible heat heat source side heat exchanger 563, and is condensed into liquid refrigerant. This liquid refrigerant is sent to the sensible heat utilization units 502, 503 through the heat source side expansion valve 564, a sensible heat receiver 568, and a liquid connection pipe 507. The liquid refrigerant sent to the sensible heat utilization units 502, 503 is pressure-reduced by the sensible heat utilization side expansion valves 521, 531, and then, in air heat exchangers 522, 532, this liquid refrigerant is evaporated into low-pressure gas refrigerant by heat exchange with the room air RA drawn into the unit. This gas refrigerant is again drawn into the sensible heat compression mechanism 561 of the sensible heat heat source unit 506 through a sensible heat gas connection pipe 508. On the other hand, the room air RA cooled by heat exchange with the refrigerant in the air heat exchangers 522, 532 is supplied as the supply air SA to the room. Note that, as described below, the degree of opening of the sensible heat utilization side expansion valves 521, 531 is adjusted such that the degree of superheat SH in the air heat exchangers 522, 532, i.e., the temperature difference between the refrigerant temperature on the liquid side of the air heat exchangers 522, 532 respectively detected by liquid side temperature sensors 523, 533 and the refrigerant temperature on the gas side of the air heat exchangers 522, 532 respectively detected by gas side temperature sensors 524, 534, is the target degree of superheat SHS.

Here, the system control being performed in the air conditioning system 401 will be described, focusing on the sensible heat load treatment system 501. Note that, the control necessary to achieve the sensible heat cooling operation in the sensible heat load treatment system 501 will be described later; the basic control of the sensible heat load treatment system 501 will be described herein.

First, when the target temperature is set by remote controls 411, 412, along with these target temperatures, the temperature and the relative of the room air to be drawn into the unit, which were detected by the RA inlet temperature/humidity sensors 525, 535, will be input into sensible heat utilization side controllers 528, 538 of the sensible heat utilization units 502, 503, respectively.

Then, in step S46, sensible heat utilization side controllers 528, 538 calculate the temperature difference between the target temperature of the room air and the temperature detected by the RA inlet temperature/humidity sensors 525, 535 (this temperature difference will be hereinafter referred to as the required sensible heat capability value ΔT). Here, as described above, the required sensible heat capacity value ΔT is the difference between the target temperature of the room air and the current temperature of the room air, so that this value ΔT corresponds to the sensible heat load that must be treated in the air conditioning system 401. Then, this required sensible heat capacity value ΔT is converted to a capacity UP signal K2 that informs a sensible heat heat source side controller 565 whether or not it is necessary to increase the treatment capacity of the sensible heat utilization units 502, 503. For example, when the absolute value of Δh is lower than a predetermined value (in other words, when the temperature of the room air is close to the target temperature of the room air, and the treatment capacity does not need to be increased or decreased), the capacity UP signal K2 will be "0." When the absolute value of Δh is higher than a predetermined value in a way that the treatment capacity needs to be increased (in other words, the temperature of the room air is higher than the target temperature during the cooling operation and the treatment capacity needs to be increased), the capacity UP signal K2 will be "a," and when the absolute value of Δh is higher than a predetermined value in a way that the treatment capacity needs to be decreased (in other words, the temperature of the room air is lower than the target temperature during the cooling operation, and the treatment capacity needs to be decreased), the capacity UP signal K2 will be "b."

Next, in step S47, the sensible heat utilization side controllers 528, 538 change the target degree of superheat SHS according to the required sensible heat capability value ΔT. For example, when the treatment capacity of the sensible heat utilization units 502, 503 needs to be decreased (when the capacity UP signal K2 is "b"), the target degree of superheat SHS is increased, and the degree of opening of the sensible heat utilization side expansion valves 521, 531 is controlled such that the amount of heat exchanged between the air and the refrigerant in the air heat exchangers 522, 532 is decreased.

In addition, in step S48, sensible heat heat source side controller 565 calculates the target evaporation temperature TeS2, using the capacity UP signal K2 of the sensible heat utilization units 502, 503, which was transmitted from the sensible heat utilization side controllers 528, 538 to the sensible heat heat source side controller 565. For example, the target evaporation temperature TeS2 is calculated by subtracting the capacity UP signal K2 of the sensible heat utilization units 502, 503 from the current target evaporation temperature. Accordingly, when a value of the capacity UP signal K2 is "a," the target evaporation temperature TeS2 will be low.

Next in step S51, after going through steps S49 and S50, the sensible heat heat source side controller 565 calculates a system evaporation temperature Te2, which corresponds to measured values of the evaporation temperature of the entire sensible heat load treatment system 501. For example, the system evaporation temperature Te2 is calculated by converting the inlet pressure of the sensible heat compression mechanism 561 detected by a sensible heat inlet pressure sensor 566 to the saturation temperatures of the refrigerant at the pressure. Then, the temperature difference ΔTe2 between the system evaporation temperature Te2 and the target evaporation temperature TeS2 is calculated. Then based on this temperature difference ΔTe2, the necessity and amount of the increase or decrease in the operational capacity of the sensible heat compression mechanism 561 will be determined.

By using thus determined operational capacity of the sensible heat compression mechanism 561 to control the operational capacity of the sensible heat compression mechanism 561, the system control to aim the target temperature of the sensible heat utilization units 502, 503 is performed. The system control is performed such that, for example, when the temperature difference ΔTe2 is a positive value, the operational capacity of the sensible heat compression mechanism 561 is decreased, whereas when the temperature difference ΔTe2 is a negative value, the operational capacity of the sensible heat compression mechanism 561 is increased.

Incidentally, in this air conditioning system 401, as described above, the latent heat treatment that mainly treats the latent heat load in the room is performed in the latent heat load treatment system 201, and the sensible heat cooling operation that only treats the sensible heat load in the room is performed in the sensible heat load treatment system 501. Further, as shown in FIG. 5, in latent heat load treatment in the latent heat load treatment system 201, the sensible heat is treated along with the latent heat through the adsorption process or the regeneration process in the first adsorbent heat exchangers 222, 232 and the second adsorbent heat exchangers 223, 233 which constitute the latent heat load treatment system 201. As a result, both the latent heat treatment and the sensible heat treatment are performed.

Therefore, in this air conditioning system 401, the following system control is performed taking into consideration that the sensible heat cooling operation of the above-described sensible heat load treatment system 501 must be achieved and that the sensible heat load is treated in the latent heat load treatment system 201.

First, in step S52, the sensible heat utilization side controllers 528, 538 calculate the dew point temperature based on the temperature and the relative humidity of the room air that is to be drawn into the unit, which are detected by the RA inlet temperature/humidity sensors 525, 535, and then calculate the minimum evaporation temperature Te3 of the refrigerant that flows in the air heat exchangers 522, 532 such that condensation of air in the air heat exchangers 522, 532 is prevented, specifically, so that air in the air heat exchangers 522, 532 will be at least equal to or higher than this dew point temperature.

Next, in step S49, the latent heat heat source side controller 565 compares the minimum evaporation temperature Te3 transmitted from the sensible heat utilization side controllers 528, 538 to the latent heat heat source side controller 565 with the target evaporation temperature TeS2 calculated in step S48. When the target evaporation temperature TeS2 is equal to or higher than the minimum evaporation temperature Te3, in step S50, the target evaporation temperature TeS2 calculated in step S48 will be used as is for the calculation of the operational capacity of the sensible heat compression mechanism 561 in step S51. On the other hand, when the comparison between the minimum evaporation temperature Te3 and the target evaporation temperature TeS2 calculated in step S48 indicates that the target evaporation temperature TeS2 is lower than the minimum evaporation temperature Te3, in step S53, the target evaporation temperature TeS2 is replaced by the minimum evaporation temperature Te3 so as to be used for the calculation of the operational capacity of the sensible heat compression mechanism 561 in step S51.

In this way, the operational capacity of the sensible heat compression mechanism 561 will be determined so as to prevent condensation of moisture in the air in the air heat exchangers 522, 532 of the sensible heat utilization units 502, 503, and thus the sensible heat cooling operation will be provided.

On the other hand, in the latent heat utilization side controllers 228, 238, in step S42, when the switching time interval between the adsorption process and the regeneration process in the adsorbent heat exchangers 222, 223 and the adsorbent heat exchangers 232, 233 is set to a sensible heat priority mode (for example, time D in FIG. 5), and also when the capacity UP signal K2 is "b" (when the required sensible heat treatment capacity in the sensible heat utilization side units 502, 503 is small), in step S54, the switching time interval is changed and set to a latent heat priority mode (for example, time C in FIG. 5). When a condition is different than described above, the system control proceeds to step S43.

Then, in step S43, when the switching time interval between the adsorption process and the regeneration process in the adsorbent heat exchangers 222, 223 and the adsorbent heat exchangers 232, 233 is set to the latent heat priority mode (for example, time C in FIG. 5), and also when the capacity UP signal K2 is "a" (when the required sensible heat treatment capacity in the sensible heat utilization side units 502, 503 is large), the sensible heat treatment capacity in the latent heat load treatment system 201 can be increased.

In this way, in the air conditioning system 401, when the required sensible heat treatment capacity value ΔT is high and the sensible heat treatment capacity in the sensible heat load treatment system 501 needs to be increased, the switching time interval between the adsorption process and the regeneration process in the adsorbent heat exchangers 222, 232, 223, 233 of the latent heat utilization units 202, 203 is made longer than that during normal operation (the switching time interval is set to time C, i.e., the latent heat priority mode during normal operation) so as to decrease the latent heat treatment capacity and to increase the sensible heat treatment capacity in the adsorbent heat exchangers 222, 232, 223, 233, in other words, to increase the sensible heat treatment capacity ratio in the latent heat load treatment system 201. Consequently, even when the required sensible heat treatment capacity value ΔT is high, the air conditioning system 401 can follow a change in the required sensible heat treatment capacity while being operated to prevent condensation of moisture in the air in the air heat exchangers 522, 532 in the sensible heat load treatment system 501 and to treat only the sensible heat load in the room.

Note that, during the above-described drainless dehumidifying and cooling operation, when the evaporation temperature of the air heat exchangers 522, 532 in the sensible heat load treatment system 501 is equal to or below the dew point temperature (in other words, equal to or below the minimum evaporation temperature Te3), and when condensation is detected by the condensation sensors 526, 536, the following actions are taken in order to reliably prevent condensation in the air heat exchangers 522, 532: the sensible heat utilization side controllers 528, 538 respectively close the sensible heat utilization side expansion valves 521, 531; and the sensible heat utilization side controllers 528, 538 transmit a signal that informs the detection of condensation to the sensible heat heat source side controller 565, and the sensible heat heat source side controller 565 stops the sensible heat compression mechanism 561.

<Drainless System Startup>

Figure 36:
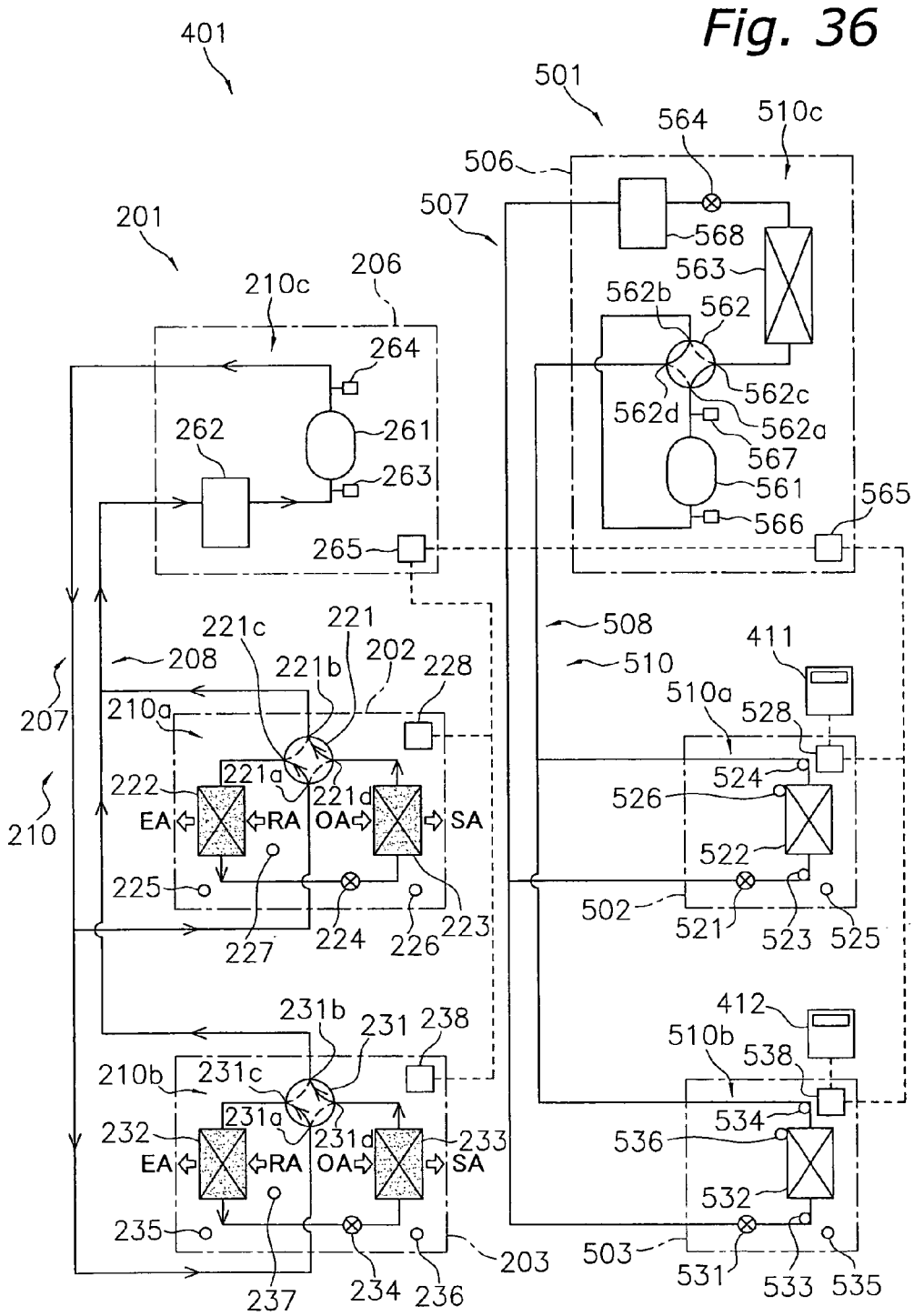
FIG. 36 is a schematic diagram of a refrigerant circuit showing the operation at drainless system startup of the air conditioning system of the third embodiment.
Figure 37:
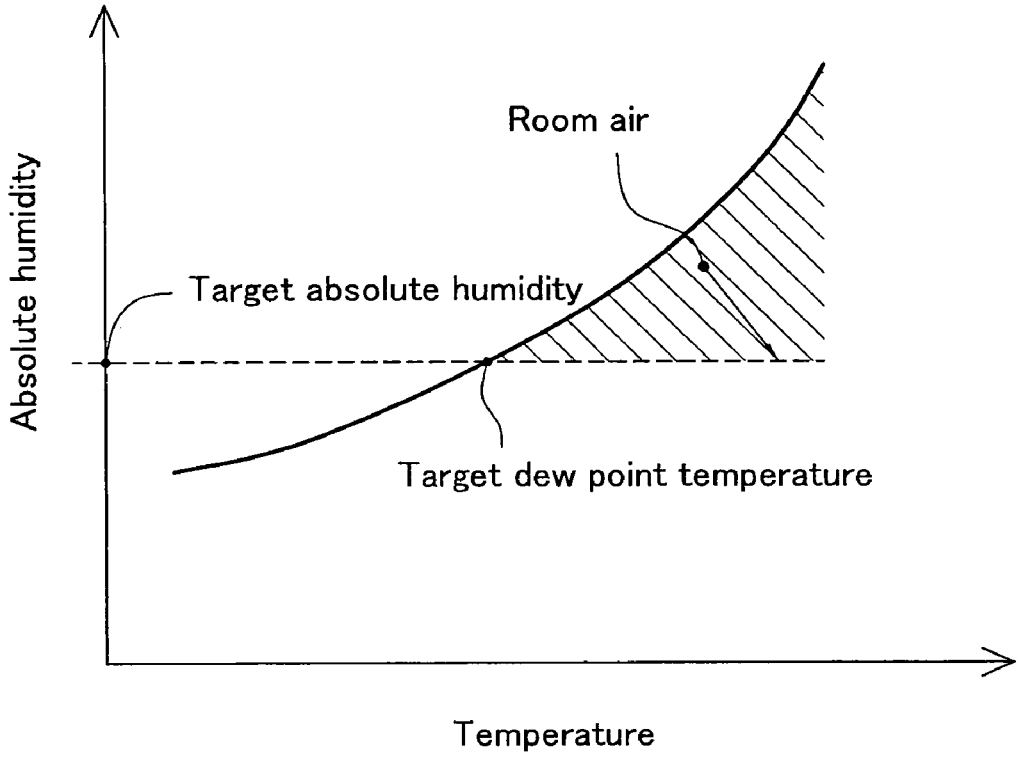
FIG. 37 is a psychrometric chart indicating the state of the room air at drainless system startup of the air conditioning system of the third embodiment.
Figure 38:
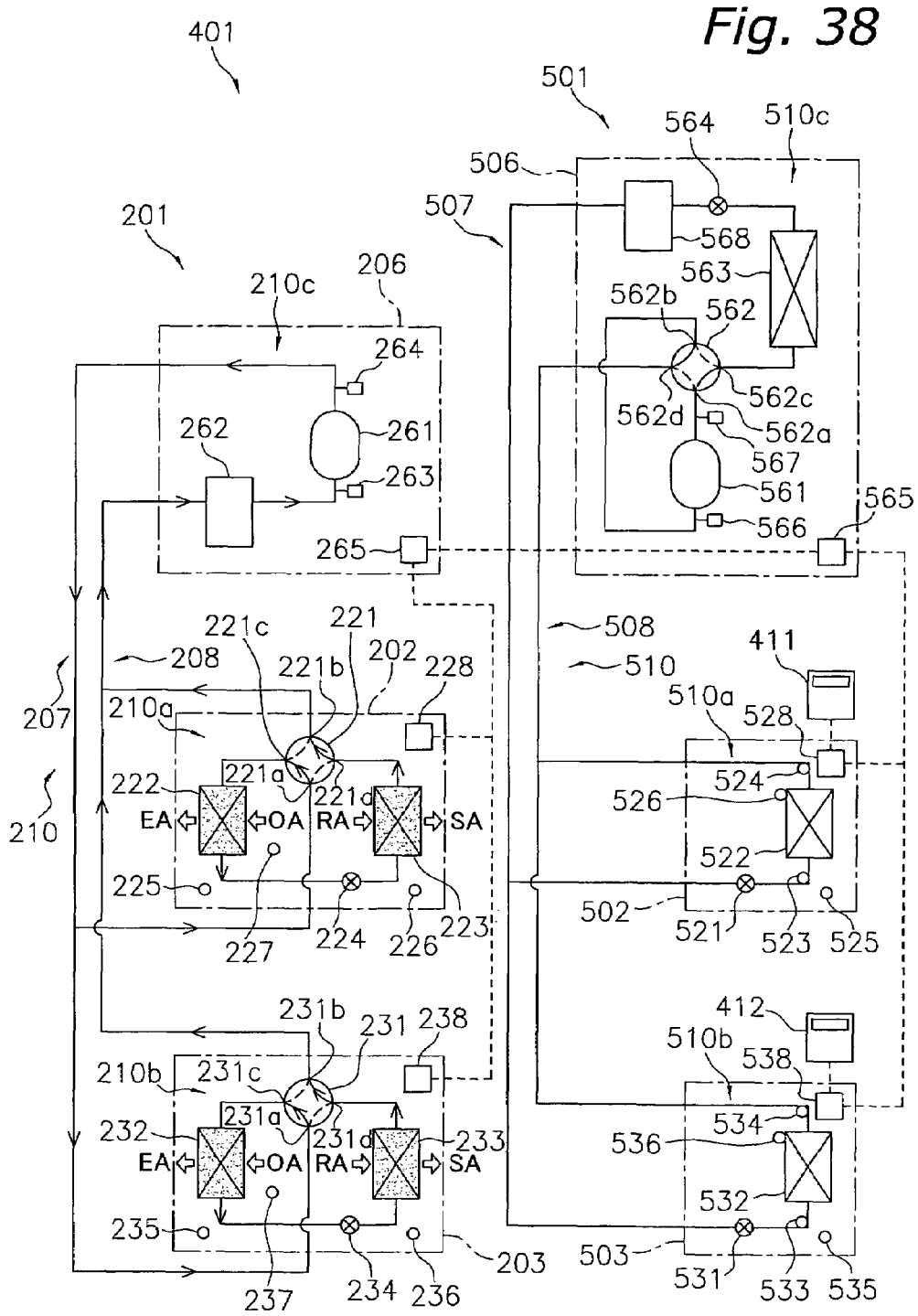
FIG. 38 is a schematic diagram of a refrigerant circuit showing the operation at drainless system startup of the air conditioning system of the third embodiment.
Figure 39:
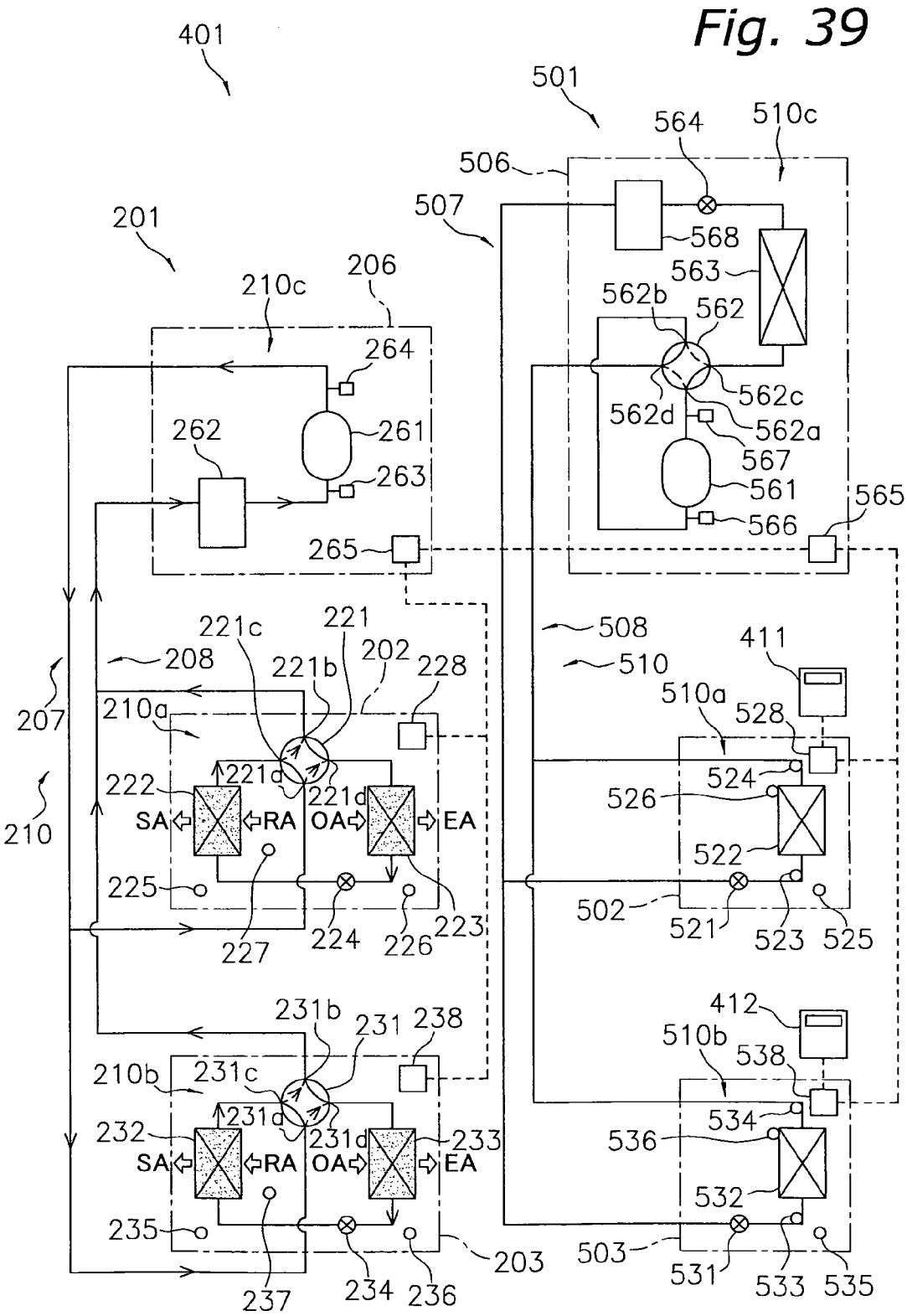
FIG. 39 is a schematic diagram of a refrigerant circuit showing the operation at drainless system startup of the air conditioning system of the third embodiment.

Next, the startup operation of the air conditioning system 401 will be described with reference to FIGS. 36, 37, 38, and 39. In the air conditioning system 401, a drainless system startup is performed in which the system is started without generating condensation in the air heat exchangers 522, 532 in the sensible heat utilization units 502, 503. FIG. 36 is a schematic diagram of a refrigerant circuit showing the operation at a first drainless system startup of the air conditioning system 401. FIG. 37 is an psychrometric chart indicating the state of the room air at drainless system startup of the air conditioning system 401. FIGS. 38 and 39 are schematic diagrams of a refrigerant circuit showing the operation at a second drainless system startup of air conditioning system 401.

As for the startup operation of the air conditioning system 401, there are two startup methods as described below. A first method for drainless system startup is a method in which the treatment of the latent heat load in the room by the latent heat load system 201 is given priority over the treatment of the sensible heat load treatment system by the sensible heat load treatment system 501. A second method for drainless system startup is a method in which, as with the first method for drainless system startup, treatment of the latent heat load in the room by the latent heat load treatment system 201 is given priority over treatment of the sensible heat load in the room by the sensible heat load treatment system 501, and also in the latent heat utilization units 202, 203 in the sensible heat load treatment system 501, outdoor air is passed through one of the first adsorbent heat exchangers 222, 232 and one of the second adsorbent heat exchangers 223, 233, whichever is performing the regeneration process, and is exhausted to the outside; at the same time, room air is passed through one of the first adsorbent heat exchangers 222, 232 and the second adsorbent heat exchangers 223, 233, whichever is performing the adsorption process, and then supplied to the room.

First, the operation at first drainless system startup will be described with reference to FIGS. 36 and 37.

When an operation command is issued from the remote controls 411, 412, the latent heat load treatment system 201 will start and the dehumidifying operation will be performed in a state in which the sensible heat load treatment system 501 is stopped. Here, since the operation during the dehumidifying operation of the latent heat load treatment system 201 is the same as the one during the above-described drainless dehumidifying and cooling operation (however, the switching time interval is fixed to the time C in the latent heat priority mode), a description thereof will be omitted.

On the other hand, as for the sensible heat load treatment system 501, for example, when the sensible heat utilization side controllers 528, 538 calculate the dew point temperature or the absolute humidity of the room air based on the temperature and the relative humidity of the room air (specifically, the temperature and relative humidity detected by the RA inlet temperature/humidity sensors 225, 235 in the latent heat utilization units 202, 203 and by the RA inlet temperature/humidity sensors 525, 535 in the sensible heat utilization units 502, 503), and when the measured value of dew point temperature or absolute humidity of the room air is within the hatched area shown in FIG. 37 (in other words, when the dew point temperature and absolute humidity of the room air are higher than the target dew point temperature and the target absolute humidity), the sensible heat load treatment system will be maintained in a stopped state until the dew point temperature of the room air or the absolute humidity will reach or fall below the target dew point temperature or the target absolute humidity, and thus moisture in the air in the air heat exchangers 522, 532 is prevented from being condensed immediately after startup. Here, as for the target dew point temperature or the target absolute humidity, for example, the dew point temperature or the absolute humidity may be calculated based on the target temperature and the target humidity that are input in the remote controls 411, 412, and the calculated dew point temperature or absolute humidity may be used as the target dew point temperature or the target absolute humidity. In addition, appropriate dew point temperature or the absolute humidity may be set, which is at levels approximately intermediate between the dew point temperature or the absolute humidity calculated based on the target temperature and the target humidity that were input into the remote controls 411, 412, and the dew point temperature or the absolute humidity calculated based on the temperature and the relative humidity detected by the RA inlet temperature/humidity sensors 225, 235 in the latent heat utilization units 202, 203 or by the RA inlet temperature/humidity sensors 525, 535 in the sensible heat utilization units 502, 503.

Then, after the target dew point temperature or the target absolute humidity is reached by the operation of the latent heat load treatment system 201, the sensible heat load treatment system 501 starts, and the above-described drainless dehumidifying and cooling operation is operated, and thereby, the temperature of the room air is lowered down to the target temperature.

In this way, in the air conditioning system 401, treatment of the latent heat load in the room by the latent heat load treatment system 201 is given priority over treatment of the sensible heat load in the room by the sensible heat load treatment system 301. Therefore, it is possible to treat the sensible heat by the sensible heat load treatment system 501 after the humidity of the room air is sufficiently lowered by treating the latent heat by the latent heat load treatment system 201 and the evaporation pressure of the refrigerant in the air heat exchangers 522, 532 is allowed to be lowered. Accordingly, in the air conditioning system 401 that comprises the latent heat load treatment system 201 comprising the latent heat utilization units 202, 203 having the adsorbent heat exchangers 222, 223, 232, 233 and configured to mainly treat the latent heat load in the room; and the sensible heat load treatment system 501 comprising the sensible heat utilization units 502, 503 having the air heat exchangers 522, 532 and configured to be operated so as to prevent condensation of moisture in the air in the air heat exchangers 522, 532 and treat only the sensible heat load in the room, it will be possible to quickly start cooling operation even when the system starts under a condition in which the dew point temperature of the room air is high.

Next, the operation at second drainless system startup will be described with reference to FIGS. 38 and 39.

When an operation command is issued from the remote controls 411, 412, the latent heat load treatment system 201 will start and the dehumidifying operation will be performed in a state in which the sensible heat load treatment system 501 is stopped, as in the case of the first drainless system startup. Here, as for the operation during the dehumidifying operation of the latent heat load treatment system 201, such dehumidifying operation is performed in a circulation mode but not in the full ventilation mode. Note that the control of the latent heat refrigerant circuit 210 in the sensible heat load treatment system 501 is the same as the operation performed during the drainless dehumidifying and cooling operation (however, the switching time interval is fixed to time C in the latent heat priority mode). In addition, as for the flow of air in the latent heat utilization units 202, 203 in the sensible heat load treatment system 501, by the operation of the latent heat utilization side four-way directional control valves 221, 231, the air supply fan, the exhaust fan, the damper, etc., the room air RA is drawn into the units through the indoor air inlets, and is supplied as the supply air SA to the room through the supply air outlets, and the outdoor air OA is drawn into the units through the outside air inlets, and is exhausted as the exhaust air EA to the outside through the exhaust air outlets.

In this way, in the air conditioning system 401, at the second drainless system startup, the dehumidifying operation is performed while circulating room air (in other words, the dehumidifying operation in the circulation mode). Consequently, even when the humidity in the room may get high when outdoor air is supplied, such as when outdoor air is at high humidity, dehumidification can be provided while circulating room air. Accordingly, the target dew point temperature or the target absolute humidity can be quickly achieved, and the sensible heat load can be treated by the sensible heat load treatment system 501.

When performing drainless system startup of the air conditioning system 401 configured to preferentially treat the latent heat load in the room as described above, for example, there are times when the dew point temperature or the absolute humidity of the room air at drainless system startup is close to the target dew point temperature or the target absolute humidity of the room air. In such a case, the above-described drainless system startup does not need to be performed, so that the operation at drainless system startup can be omitted and the normal operation will be initiated.

Therefore, this air conditioning system 401 is configured such that, at drainless system startup, before starting the above-described operation that preferentially treats the latent heat load in the room, whether or not the dew point temperature difference between the target dew point temperature of the room air and the dew point temperature of the room air is equal to or below a predetermined dew point temperature difference (for example, whether or not the target dew point temperature has been reached) is determined, and when the dew point temperature difference between the target dew point temperature of the room air and the dew point temperature of the room air is equal to or below a predetermined dew point temperature, the operation at drainless system startup is prevented from being performed.

In addition, in determining the necessity of the operation that preferentially treats the latent heat load in the room based on the absolute humidity but not the dew point temperature, at drainless system startup, before starting the above-described operation that preferentially treats the latent heat load in the room, whether or not the absolute humidity difference between the target absolute humidity of the room air and the absolute humidity of the room air is equal to or below a predetermined absolute humidity difference (for example, whether or not the target absolute humidity has been reached) is determined. When the absolute humidity difference between the target absolute humidity of the room air and the absolute humidity of the room air is equal to or below a predetermined absolute humidity difference, the operation at drainless system startup does not have to be performed.

Accordingly, in the air conditioning system 401, at drainless system startup, the operation in which the latent heat load in the room is preferentially treated is prevented from being unnecessarily performed, and therefore the normal operation in which the latent heat load and the sensible heat load in the room are treated can be initiated as soon as possible.

(3) Characteristics of the Air Conditioning System

The air conditioning system 401 of the present embodiment has the following characteristics.

(A)

In the air conditioning system 101 of the present embodiment, the latent heat load treatment system 201 has the same configuration as that in the air conditioning system 1 of the first embodiment, so that the air conditioning system 101 have the same characteristics as in the air conditioning system 1 of the first embodiment.

The air conditioning system 101 of the present embodiment further comprises a sensible heat load treatment system 301 comprising a sensible heat heat source unit 306 that includes a sensible heat heat source side refrigerant circuit 310*c*, and sensible heat utilization units 302, 303 that include sensible heat utilization side refrigerant circuits 310*a*, 310*b* having air heat exchangers 322, 332, in addition to the latent heat load treatment system 201 comprising a latent heat heat source unit 206 that include latent heat heat source side refrigerant circuit 210*c* and the latent heat utilization units 202, 203 that includes latent heat utilization side refrigerant circuits 210*a*, 210*b* having the adsorbent heat exchangers 222, 223, 232, 233. Consequently, it is possible to treat the latent heat load and sensible heat load in the room separately by the two treatment systems 201, 301.

(B)

In the air conditioning system 401 of the present embodiment, when the required sensible heat treatment capacity increases and thus the sensible heat treatment capacity in the sensible heat load treatment system 501 needs to be increased, the switching time interval between the adsorption process and the regeneration process in the adsorbent heat exchangers 222, 223, 232, 233 that constitute the latent heat load treatment system 201 is made longer so as to decrease the latent heat treatment and simultaneously increase the sensible heat treatment capacity in the adsorbent heat exchangers 222, 223, 232, 233, in other words, to increase the sensible heat treatment capacity ratio in the latent heat load treatment system 201, in order to increase the sensible heat treatment capacity in the latent heat load treatment system 201.

Accordingly, in the air conditioning system comprising the latent heat load treatment system that mainly treats the latent heat load in the room and the sensible heat load treatment system that is operated so as to prevent condensation of moisture in the air and treats only the sensible heat load in the room, it is possible to treat only the sensible heat load in the room by being operated so as to prevent condensation of moisture in the air in the sensible heat load treatment system and, simultaneously follow a change in the sensible heat treatment capacity.

(C)

In this air conditioning system 401 of the present embodiment, at system startup, treatment of the latent heat load in the room by the latent heat load treatment system 201 is given priority over treatment of the sensible heat load in the room by the sensible heat load treatment system 501. Therefore, by treating the latent heat by the latent heat load treatment system, it will be possible to treat the sensible heat by the sensible heat load treatment system 501 after the humidity of the room air is sufficiently lowered by treating the latent heat by the latent heat load treatment system 201 and the evaporation pressure of the refrigerant in the air heat exchangers 522, 532 is lowered.

More specifically, at system startup, treatment of the sensible heat load by the sensible heat load treatment system 501 is stopped and only the latent heat is treated by the latent heat load treatment system 201 until the dew point temperature of the room air is equal to or below the target dew point temperature, or until the absolute humidity of the room air is equal to or below the target absolute humidity. In this way, the sensible heat load can be quickly treated by the sensible heat load treatment system 501.

Accordingly, in the air conditioning system 401 that comprises the latent heat load treatment system 201 having the adsorbent heat exchangers 222, 223, 232, 233 and configured to mainly treat the latent heat load in the room; and the sensible heat load treatment system 501 having the air heat exchangers 522, 532 and configured to be operated so as to prevent condensation of moisture in the air in the air heat exchangers 522, 532 and treat only the sensible heat load in the room, it will be possible to quickly perform the cooling operation while preventing condensation in the air heat exchangers 522, 532, even when the system starts under a condition in which the dew point temperature of the room air is high.

Further, at system startup, outdoor air can be passed through one of the adsorbent heat exchangers 222, 223, 232, 233, whichever is performing the regeneration process, and then be exhausted to the outside; at the same time, room air can be passed through one of the adsorbent heat exchangers 222, 223, 232, 233, whichever is performing the adsorption process, and then be supplied to the room. Consequently, at system startup, it will be possible to treat the sensible heat load by the the sensible heat load treatment system 501 as soon as possible by performing the dehumidifying operation while circulating room air.

In addition, before starting the system startup operation, the necessity to start such an operation is determined based on the dew point temperature and the absolute humidity of the room air. Accordingly, at system startup, the operation in which the latent heat load in the room is preferentially treated is prevented from being unnecessarily performed, and the normal operation in which the latent heat load and the sensible heat load in the room are treated can be initiated quickly.

(D)

In the air conditioning system 401 of the present embodiment, condensation in the air heat exchangers 522, 532 is reliably prevented because condensation in the air heat exchangers 522, 532 can be reliably detected by the condensation sensors 526, 536, and when condensation is detected, the following actions are taken: the minimum evaporation pressure value P3 calculated based on the dew point temperature can be changed so as to change the evaporation pressure of the refrigerant in the air heat exchangers 522, 532; a sensible heat compression mechanism 761 that constitutes the sensible heat heat source side 506 is stopped; and the sensible heat utilization side expansion valves 521, 531 of the sensible heat utilization units 502, 503 are closed.

(4) MODIFIED EXAMPLE 1

Figure 40:
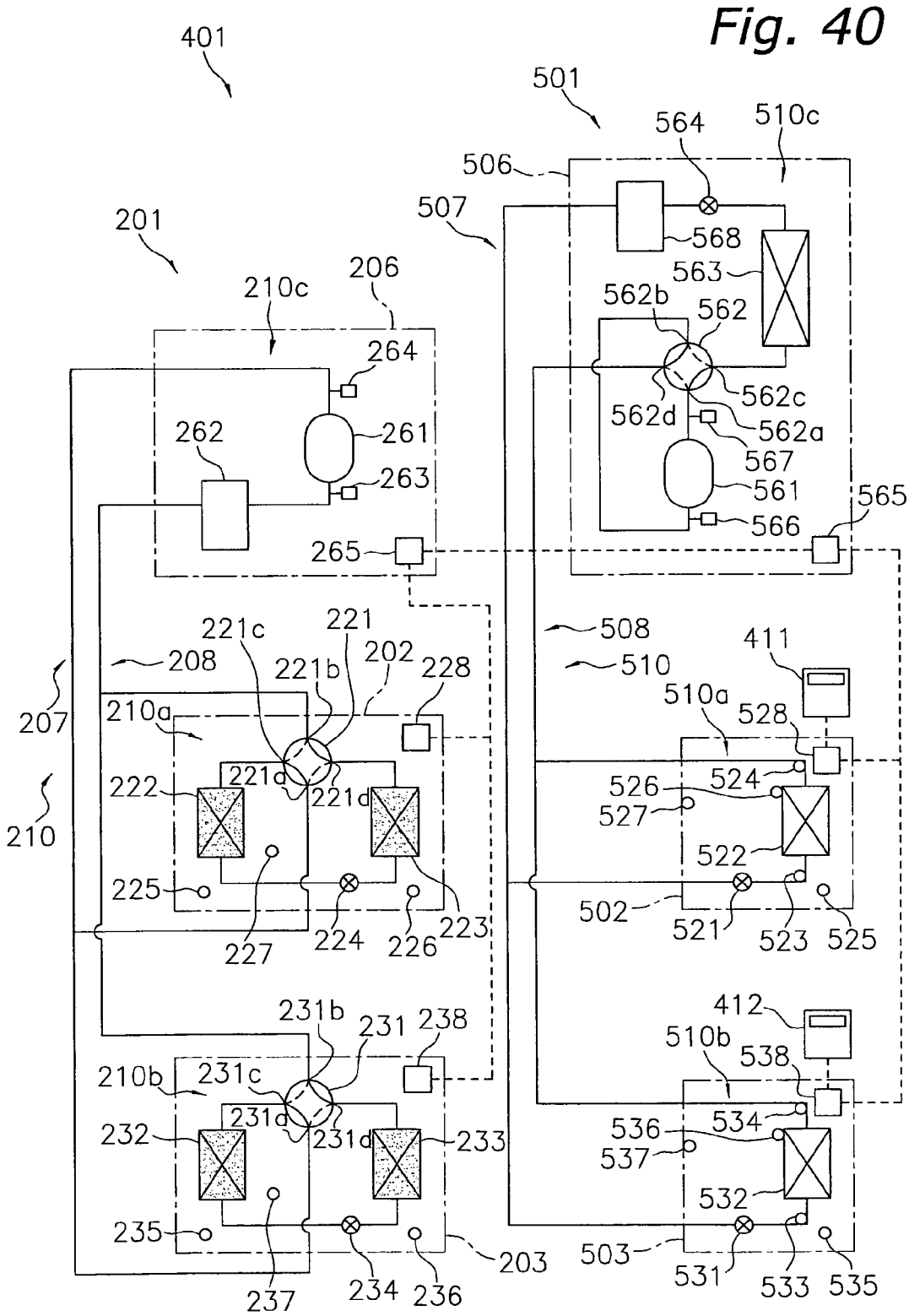
FIG. 40 is a schematic diagram of a refrigerant circuit of an air conditioning system according to a modified example 1 of the third embodiment.

In the above-described sensible heat load treatment system 501, the dew point temperature of the room air is calculated based on the temperature of the room air and the relative humidity which were detected by the RA inlet temperature/humidity sensors 525, 535, and the minimum evaporation temperature Te3 of the refrigerant in the air heat exchangers 522, 532 is calculated in order to use these calculated values for the system control. However, as shown in FIG. 40, dew point sensors 527, 537 may be provided in the sensible heat utilization units 502, 503 so as to use the dew point temperature detected by the dew point sensors 527, 537 for the system control.

(5) MODIFIED EXAMPLE 2

Figure 41:
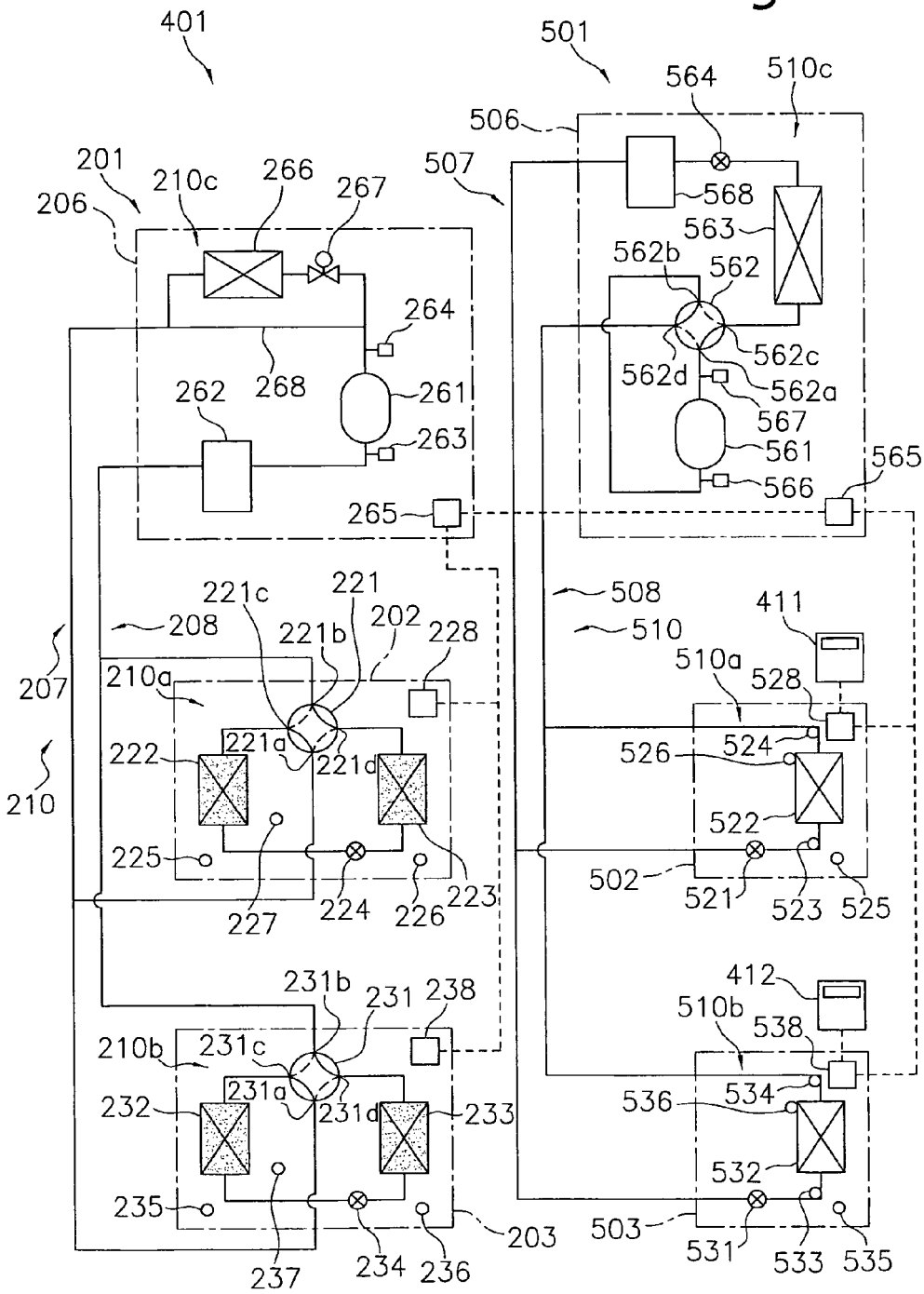
FIG. 41 is a schematic diagram of a refrigerant circuit of an air conditioning system according to a modified example 2 of the third embodiment.

As shown in FIG. 41, in the latent heat heat source unit 206 of the present embodiment, as with the heat source unit 6 of the first embodiment, the latent heat supplementary condenser 266 may be connected thereto so as to allow a portion of high-pressure gas refrigerant, which is discharged from the latent heat compression mechanism 261 and sent to the latent heat utilization units 202, 203, to be condensed.

Fourth Embodiment (1) Configuration of the Air Conditioning System

Figure 42:
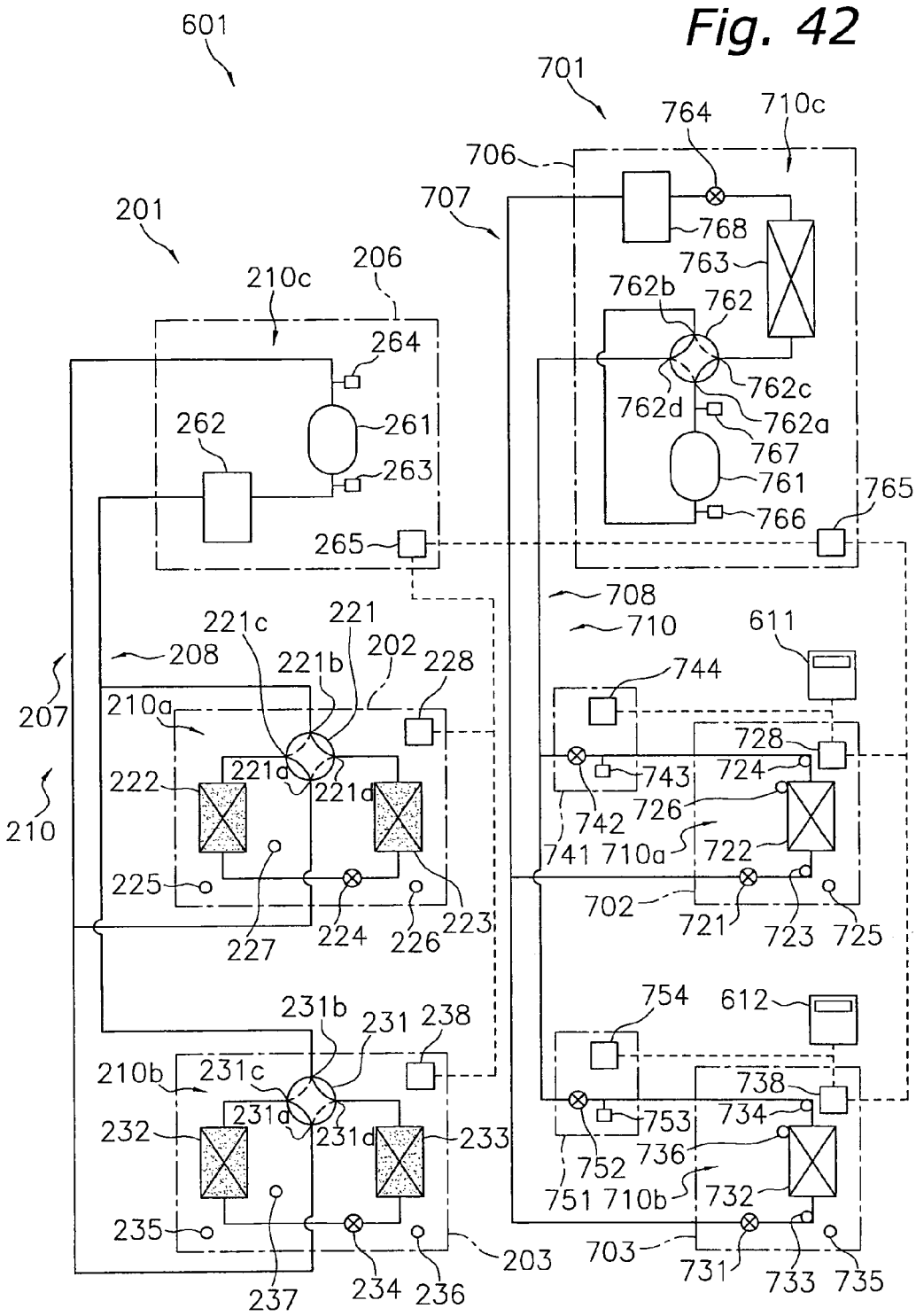
FIG. 42 is a schematic diagram of a refrigerant circuit of an air conditioning system of a fourth embodiment according to the present invention.

FIG. 42 is a schematic diagram of a refrigerant circuit of an air conditioning system 601 of the fourth embodiment according to the present invention. The air conditioning system 601 is an air conditioning system configured to treat the latent heat load and the sensible heat load in the room by operating a vapor compression type refrigeration cycle. The air conditioning system 601 is so-called separate type multi air conditioning system, and mainly comprises a latent heat load treatment system 201 that mainly treats the latent heat load in the room and a sensible heat load treatment system 701 that mainly treats the sensible heat load in the room.

The latent heat load treatment system 201 and the latent heat load treatment system 201 of the second and the third embodiments have the same configuration, so that a description of each component will be omitted.

The sensible heat load treatment system 701 and the sensible heat load treatment system 501 in the air conditioning system 401 of the third embodiment have the same configuration except for that the sensible heat load treatment system 701 includes connection units 741, 751 connected between sensible heat utilization units 702, 703 and a sensible heat gas connection pipe 708, so that all reference numerals representing each component will be simply changed to those in 700s, and a description of each component will be omitted.

The connection units 741, 751 mainly include evaporation pressure control valves 742, 752, and evaporation pressure sensors 743, 753. The evaporation pressure control valves 742, 752 are electric expansion valves that are provided to function as pressure control mechanisms that control the evaporation pressure of the refrigerant in the air heat exchangers 722, 732, when the air heat exchangers 722, 732 of the sensible heat utilization units 702, 703 are caused to function as evaporators that evaporate the refrigerant. The evaporation pressure sensors 743, 753 are pressure sensors that are provided to function as pressure detection mechanisms that detect the pressure of the refrigerant in the air heat exchangers 722, 732. In addition, the connection units 741, 751 comprise connection unit controllers 744, 754 including a microcomputer and a memory device for controlling the operation of the evaporating pressure control valves 742, 752. The connection unit controllers 744, 754 are capable of transmitting control signals to and from the sensible heat utilization side controllers 728, 738 of the sensible heat utilization units 702, 703.

(2) Operation of the Air Conditioning System

Next, the operation of the air conditioning system 601 of the present embodiment will be described. In the air conditioning system 601, it is possible to treat the latent heat load in the room by the latent heat load treatment system 201 and to treat only the sensible heat load in the room by the sensible heat load treatment system 701. Each type of operation will be described below.

<Drainless Dehumidifying and Cooling Operation>

Figure 43:
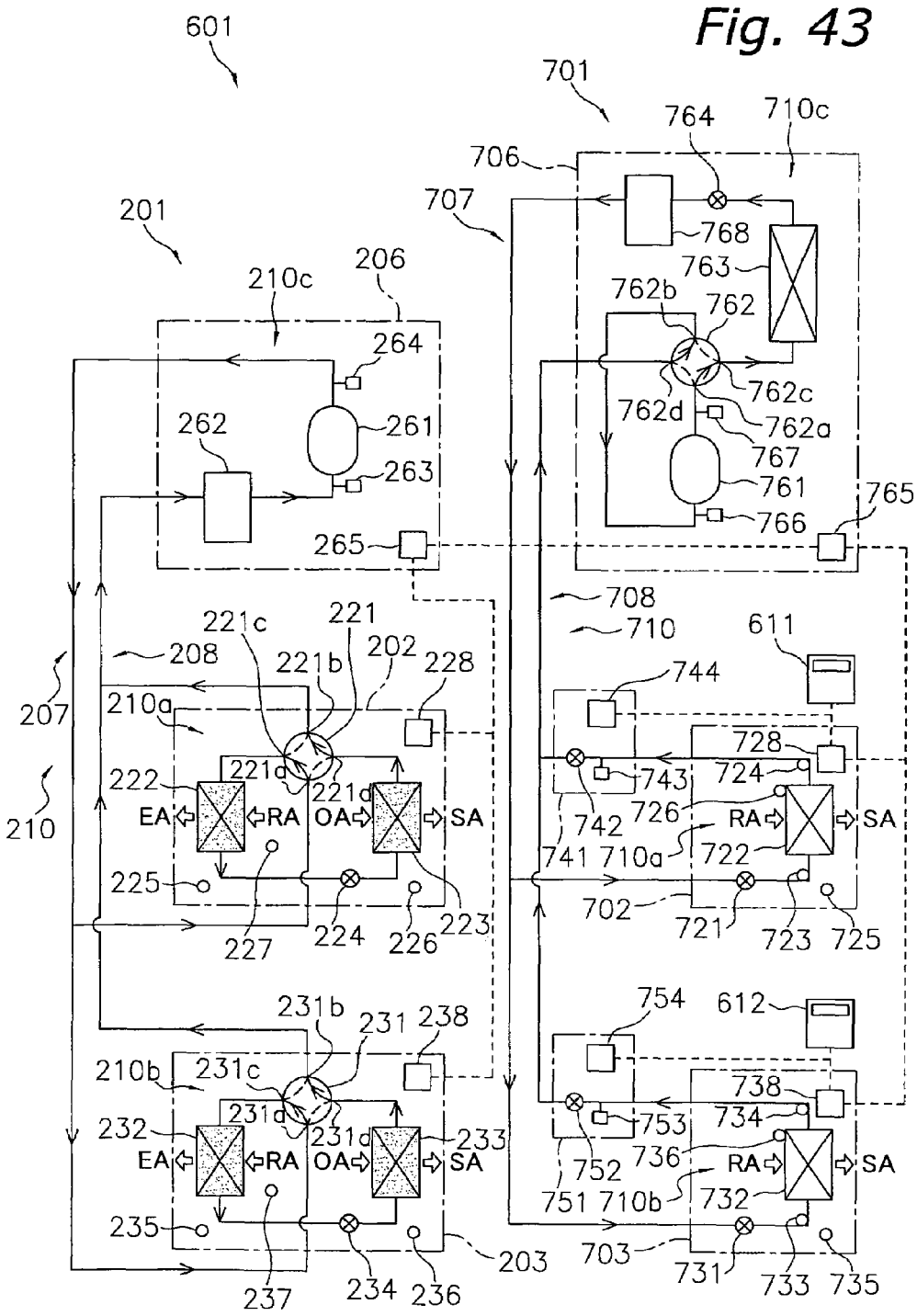
FIG. 43 is a schematic diagram of a refrigerant circuit showing the operation during the drainless dehumidifying and cooling operation in the full ventilation mode in the air conditioning system of the fourth embodiment.
Figure 44:
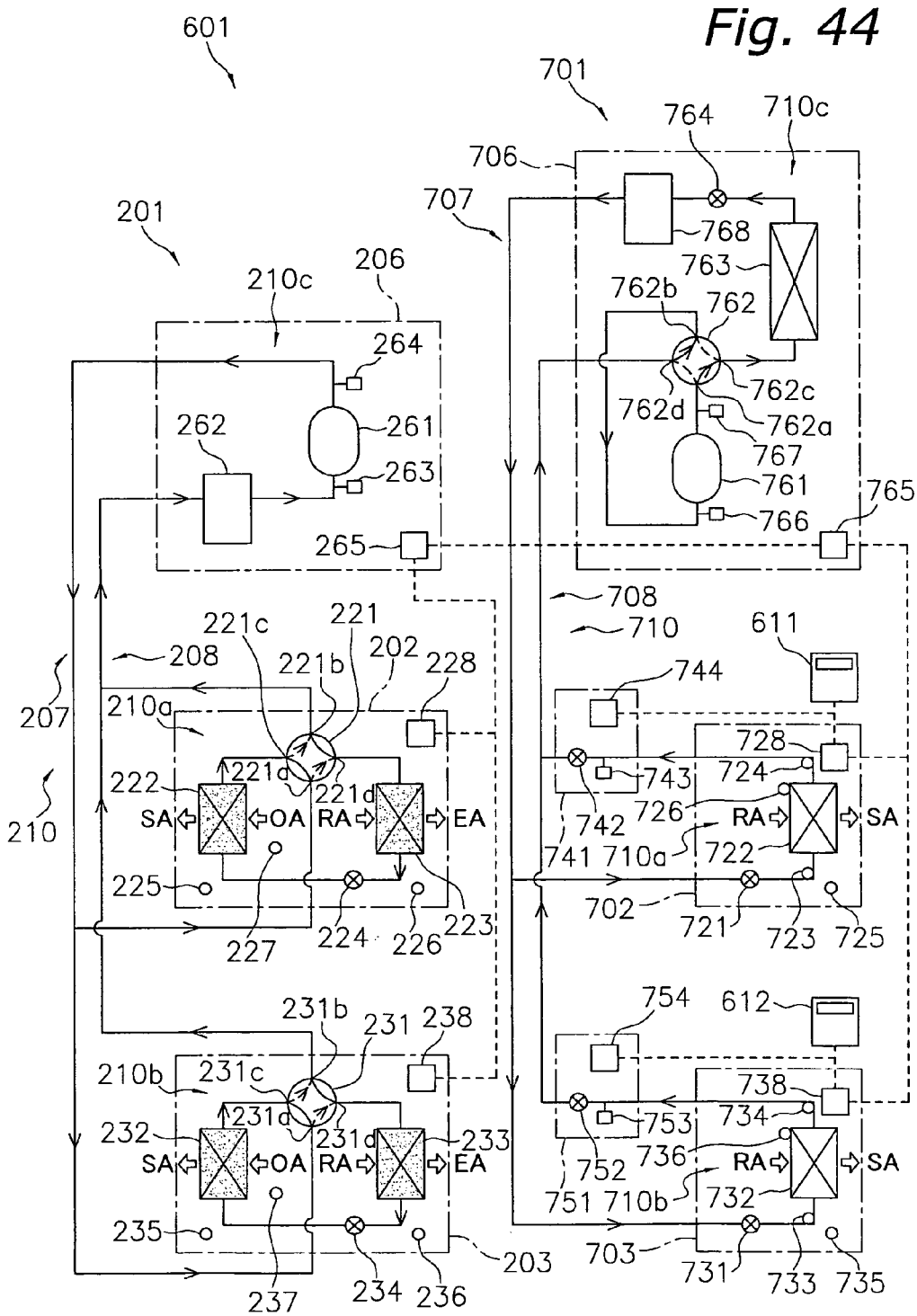
FIG. 44 is a schematic diagram of a refrigerant circuit showing the operation during the drainless dehumidifying and cooling operation in the full ventilation mode in the air conditioning system of the fourth embodiment.
Figure 45:
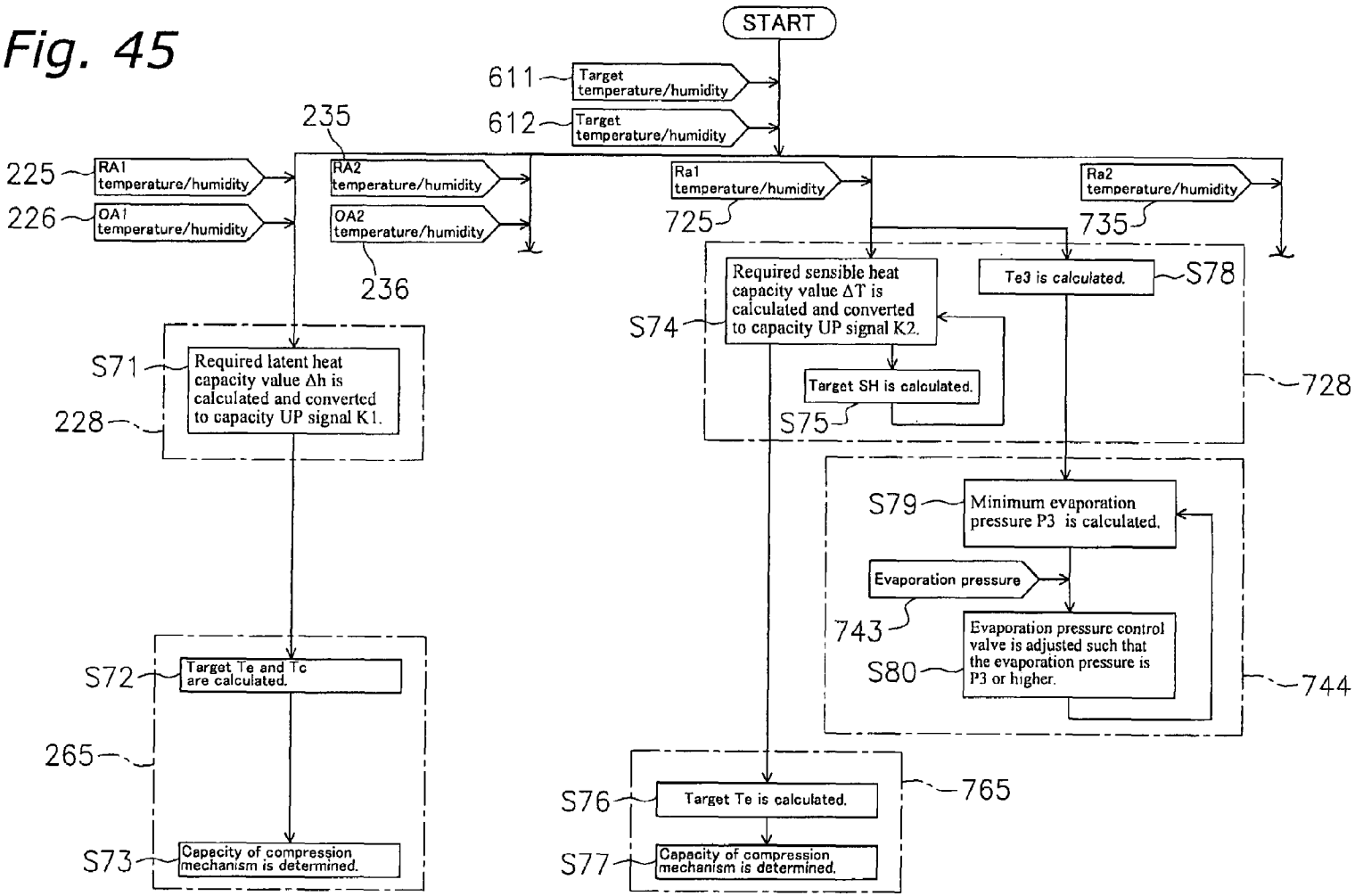
FIG. 45 is diagram of a control flow during the drainless dehumidifying and cooling operation in the air conditioning system according the fourth embodiment.
Figure 46:
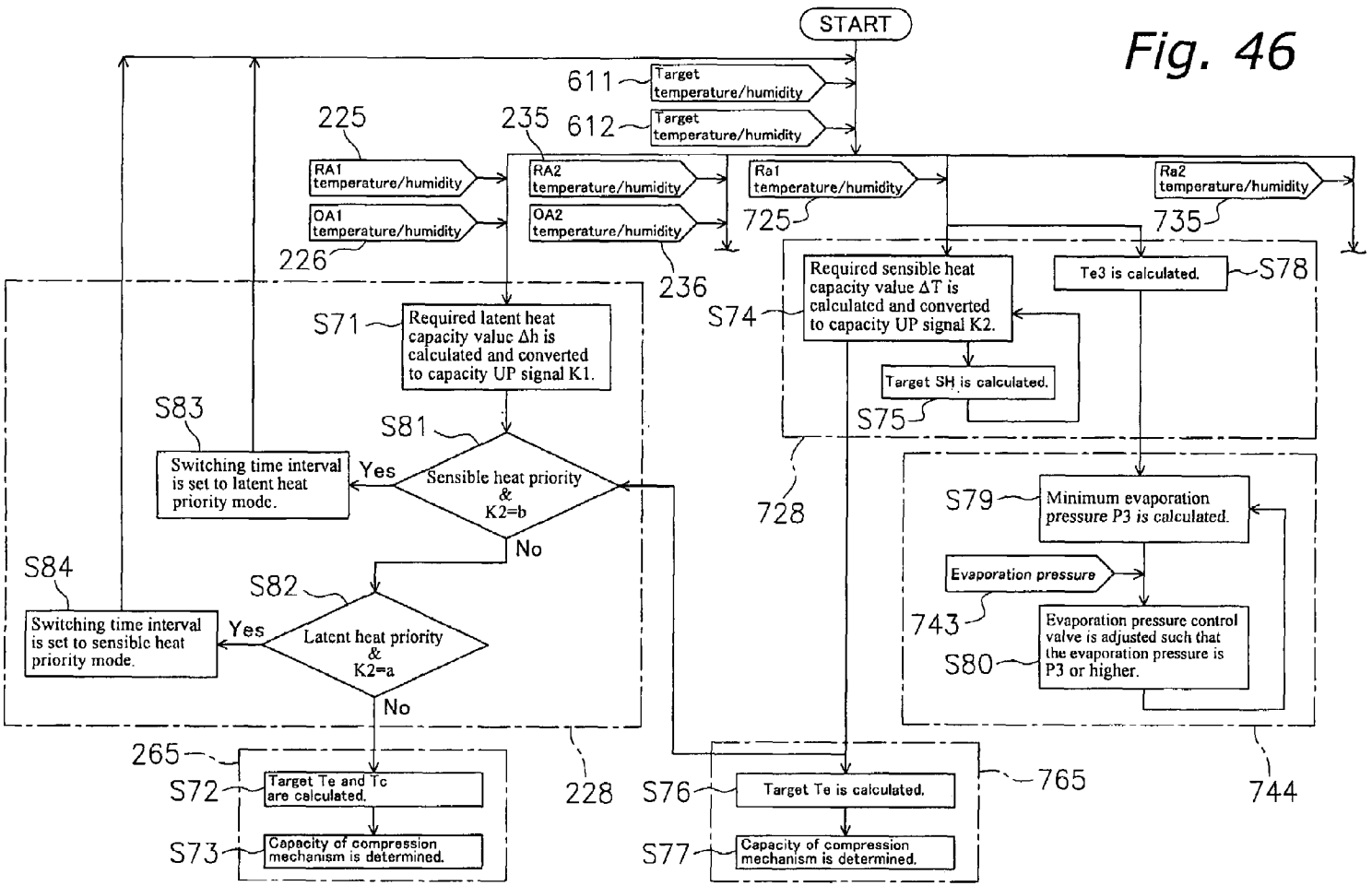
FIG. 46 is a diagram of control flow during the drainless dehumidifying and cooling operation in the air conditioning system according the fourth embodiment.

The operation of the drainless cooling operation in which the sensible heat cooling operation is operated in the sensible heat load treatment system 701, while the dehumidifying operation is performed in the full ventilation mode in the latent heat load treatment system 201, will be described with reference to FIGS. 43, 44, 45, and 46. Here, FIGS. 43 and 44 are schematic diagrams of a refrigerant circuit showing the operation during a drainless dehumidifying and cooling operation in the full ventilation mode in the air conditioning system 601. FIG. 45 is diagram of control flow during a first drainless dehumidifying and cooling operation in the air conditioning system 601. FIG. 46 is a diagram of control flow during a second drainless dehumidifying and cooling operation of the air conditioning system 601. Note that as for FIGS. 45 and 46, since a latent heat utilization unit 202 and the sensible heat utilization unit 702 as a pair have the same control flow as a latent heat utilization unit 203 and the sensible heat utilization unit 703 as a pair, so that the illustration of the control flow of the latent heat utilization unit 203 and the sensible heat utilization unit 703 as a pair is omitted.

There are two operation methods as described below, as the operation during the drainless dehumidifying and cooling operation in the air conditioning system 601. A first method of the drainless dehumidifying and cooling operation is a control method to use the evaporation pressure control valves 742, 743 of the connection units 741, 751 in order to control the evaporation pressure of the refrigerant in the air heat exchangers 722, 732 to be equal to or higher than the minimum evaporation temperature Te3 (same as the minimum evaporation temperature Te3 in the third embodiment). As with the first method of the drainless dehumidifying and cooling operation, a second method of the drainless dehumidifying and cooling operation is a control method in which the evaporation pressure control valves 742, 743 of the connection units 741, 751 is used to control the evaporation pressure of the refrigerant in the air heat exchangers 722, 732 to be equal to or higher than the minimum evaporation temperature Te3 (same as the minimum evaporation temperature Te3 in the third embodiment), and simultaneously the switching time interval between the adsorption process and the regeneration process in adsorbent heat exchangers 222, 232, 223, 233 of the latent heat utilization units 202, 203 that constitute the latent heat load treatment system 201 is changed.

First, the operation during a first drainless dehumidifying and cooling operation will be described with reference to FIGS. 43, 44, and 45.

First, the operation of the latent heat load treatment system 201 will be described. Note that, the control necessary to achieve the sensible heat cooling operation in the sensible heat load treatment system 701 will be described later; and the basic control of the latent heat load treatment system 201 will be described herein.

As in the dehumidifying and cooling operation of the air conditioning system 101 of the second embodiment, the latent heat utilization unit 202 of the latent heat load treatment system 201 alternately repeats the first operation in which a first adsorbent heat exchanger 222 functions as a condenser and a second adsorbent heat exchanger 223 functions as an evaporator, and the second operation in which that second adsorbent heat exchanger 223 functions as a condenser and the first adsorbent heat exchanger 222 functions as an evaporator. Likewise, the latent heat utilization unit 203 alternately repeats the first operation in which the first adsorbent heat exchanger 232 functions as a condenser and the second adsorbent heat exchanger 233 functions as an evaporator and, the second operation in which the second adsorbent heat exchanger 233 functions as a condenser and the first adsorbent heat exchanger 232 functions as an evaporator.

The operation of the two latent heat utilization units 202 and 203 will be described together below.

In the first operation, the regeneration process in the first adsorbent heat exchangers 222, 232 and the adsorption process in the second adsorbent heat exchangers 223, 233 are performed in parallel. During the first operation, as shown in FIG. 43, latent heat utilization side four-way directional control valves 221, 231 are set to a first state (see the solid lines in the latent heat utilization side four-way directional control valves 221, 231 in FIG. 43). In this state, high-pressure gas refrigerant discharged from the latent heat compression mechanism 261 flows into the first adsorbent heat exchangers 222, 232 through a latent heat discharge gas connection pipe 207 and the latent heat utilization side four-way directional control valves 221, 231, and is condensed while passing through the first adsorbent heat exchangers 222, 232. The condensed refrigerant is pressure-reduced by latent heat utilization side expansion valves 224, 234, and is subsequently evaporated while passing through second adsorbent heat exchangers 223, 233. Then, the refrigerant is again drawn into a latent heat compression mechanism 261 through the latent heat utilization side four-way directional control valves 221, 231, a latent heat inlet gas connection pipe 208, and a latent heat accumulator 262 (see the arrows shown on a latent heat refrigerant circuit 210 in FIG. 43).

During the first operation, in the first adsorbent heat exchangers 222, 232, moisture is desorbed from the refrigerant heated by condensation of the refrigerant, and this desorbed moisture is added to the room air RA that is drawn from the room air inlet. The moisture desorbed from the first adsorbent heat exchangers 222, 232 is carried with the room air RA and is exhausted as the exhaust air EA through the exhaust air outlet to the outside. In the second adsorbent heat exchangers 223, 233, the moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the second adsorbent heat exchangers 223, 233 passes through the supply air outlet and is supplied as the supply air SA to the room (see the arrows shown on the both sides of the adsorbent heat exchangers 222, 223, 232, 233 in FIG. 43).

In the second operation, the adsorption process in the first adsorbent heat exchangers 222, 232 and the regeneration process in the second adsorbent heat exchangers 223, 233 are performed in parallel. During the second operation, as shown in FIG. 44, the latent heat utilization side four-way directional control valves 221, 231 are set to a second state (see the broken lines in the latent heat utilization side four-way directional control valves 221, 231 in FIG. 44). In this state, high-pressure gas refrigerant discharged from the latent heat compression mechanism 261 flows into the second adsorbent heat exchangers 223, 233 through the latent heat discharge gas connection pipe 207 and the latent heat utilization side four-way directional control valves 221, 231, and is condensed while passing through the second adsorbent heat exchangers 223, 233. The condensed refrigerant is pressure-reduced by the latent heat utilization side expansion valve 224, 234, and is subsequently evaporated while passing through the first adsorbent heat exchangers 222, 232. Then, the refrigerant is again drawn into the latent heat compression mechanism 261 through the latent heat utilization side four-way directional control valves 221, 231, the latent heat inlet gas connection pipe 208, and the latent heat accumulator 262 (see the arrows shown on the latent heat refrigerant circuit 210 in FIG. 44).

During the second operation, in the second adsorbent heat exchangers 223, 233, moisture is desorbed from the refrigerant heated by condensation of the refrigerant, and this desorbed moisture is added to the room air RA that is drawn from the room air inlet. The moisture desorbed from the second adsorbent heat exchangers 223, 233 is carried with the room air RA and is exhausted as the exhaust air EA through the exhaust air outlet to the outside. In the first adsorbent heat exchangers 222, 232, moisture in the outdoor air OA is adsorbed onto the adsorbent, the outdoor air OA is dehumidified, the absorption heat thereby generated is transferred to the refrigerant, and the refrigerant evaporates. Then the outdoor air OA dehumidified in the first adsorbent heat exchangers 222, 232 passes through the supply air outlet and is supplied as the supply air SA to the room (see the arrows shown on the both sides of the adsorbent heat exchangers 222, 223, 232, 233 in FIG. 44).

Here, the system control being performed in the air conditioning system 601 will be described, focusing on the latent heat load treatment system 201.

First, when the target temperature and the target relative humidity are set by remote controls 611, 612, along with these target temperature and target relative humidity, the following information will be input into latent heat utilization side controllers 228, 238 of the latent heat utilization units 202, 203: the temperature and relative humidity of the room air to be drawn into the unit, which were detected by RA inlet temperature/humidity sensors 225, 235; and the temperature and relative humidity of outdoor air to be drawn into the unit, which were detected by OA inlet temperature/humidity sensors 226, 236.

Then, in step S71, the latent heat utilization side controllers 228, 238 calculate the target value of the enthalpy or the target value of the absolute humidity based on the target temperature and target relative humidity of the room air; calculate the current value of the enthalpy or the current value of the absolute humidity of the air to be drawn into the unit from the room based on the temperature and the relative humidity detected by RA inlet temperature/humidity sensors 225, 235; and then calculate the required latent heat capacity value Δh, which is the difference between the two calculated values. Then, this value Δh is converted to a capacity increase signal K1 that informs a latent heat heat source side controller 265 whether or not it is necessary to increase the treatment capacity of the latent heat utilization units 202, 203. For example, when the absolute value of Δh is lower than a predetermined value (in other words, when the humidity of the room air is close to the target humidity, and the treatment capacity does not need to be increased or decreased), the capacity increase signal K1 will be "0." When the absolute value of Δh is higher than a predetermined value in a way that the treatment capacity needs to be increased (in other words, the humidity of the room air is higher than the target humidity during the dehumidifying operation and the treatment capacity needs to be increased), the capacity increase signal K1 will be "A," and when the absolute value of Δh is higher than a predetermined value in a way that the treatment capacity needs to be decreased (in other words, the humidity of the room air is lower than the target humidity during the dehumidifying operation, and the treatment capacity needs to be decreased), the capacity increase signal K1 will be "B."

Next in step S72, the latent heat heat source side controller 265 uses the capacity UP signal K1 of the latent heat utilization units 202, 203, which was transmitted from the latent heat utilization side controllers 228, 238 to the latent heat heat source side controller 265 through steps S81 and S82 (to be described below), and calculates the target condensation temperature TcS1 and the target evaporation temperature TeS1. For example, the target condensation temperature TcS1 is calculated by adding the capacity UP signal K1 of the latent heat utilization units 202, 203 to the current target condensation temperature. In addition, the target evaporation temperature TeS1 is calculated by subtracting the capacity UP signal K1 of the latent heat utilization units 202, 203 from the current target evaporation temperature. Consequently, when a value of the capacity UP signal K1 is "A," the target condensation temperature TcS1 will be high, and the target evaporation temperature TeS1 will be low.

Next, in step S73, the system condensation temperature Tc1 and the system evaporation temperature Te1, which respectively correspond to measured values of the condensation temperature and evaporation temperature of the latent heat load treatment system 201 as a whole, are calculated. For example, the system condensation temperature Tc1 and the system evaporation temperature Te1 are calculated by converting the inlet pressure of the latent heat compression mechanism 261, which was detected by the latent heat inlet pressure sensor 263, and the discharge pressure of the latent heat compression mechanism 261, which was detected by a latent heat discharge pressure sensor 264, into saturation temperatures of the refrigerant at these pressures. Then, the temperature difference ΔTc1 between the system condensation temperature Tc1 and the target condensation temperature TcS1, and the temperature difference ΔTe1 between the system evaporation temperature Te1 and the target evaporation temperature TeS1 are calculated. Then based on the subtraction between these temperature differences, the necessity and amount of the increase or decrease in the operational capacity of the latent heat compression mechanism 261 will be determined.

By using thus determined operational capacity of the latent heat compression mechanism 261 to control the operational capacity of the latent heat compression mechanism 261, the system control to aim the target relative humidity of the room air is performed. The system control is performed such that, for example, when a value determined by subtracting the temperature difference ΔTe1 from the temperature difference ΔTc1 is a positive value, the operational capacity of the latent heat compression mechanism 261 is increased, whereas when a value determined by subtracting the temperature difference ΔTe1 from the temperature difference ΔTc1 is a negative value, the operational capacity of the latent heat compression mechanism 261 is decreased.

Next, the operation of the sensible heat load treatment system 701 will be described.

A sensible heat heat source side four-way directional control valve 762 of a sensible heat heat source unit 706 in the sensible heat load treatment system 701 is in a cooling operational state (a first port 762*a* is connected to a third port 762*c* are connected, and simultaneously a second port 762*b* is connected to a fourth port 762*d*). Further, the degree of opening of sensible heat utilization side expansion valves 721, 731 of the sensible heat utilization units 702, 703 is adjusted so as to reduce the pressure of the refrigerant. The sensible heat heat source side expansion valve 764 is opened.

When the sensible heat compression mechanism 761 of the sensible heat heat source unit 706 starts with a sensible heat refrigerant circuit 710 being in the above-described state, high-pressure gas refrigerant discharged from the sensible heat compression mechanism 761 passes through the sensible heat heat source side four-way directional control valve 762, and flows into a sensible heat heat source side heat exchanger 763, and is condensed into liquid refrigerant. This liquid refrigerant is sent to the sensible heat utilization units 702, 703 through a heat source side expansion valve 764, a sensible heat receiver 768, and a sensible heat liquid connection pipe 707. Then, liquid refrigerant sent to the sensible heat utilization units 702, 703 is pressure-reduced by the sensible heat utilization side expansion valves 721,731 and then, in the air heat exchangers 722, 732, this liquid refrigerant is evaporated into low-pressure gas refrigerant by heat exchange with the room air RA drawn into the unit. This gas refrigerant is again drawn into the sensible heat compression mechanism 761 of the sensible heat heat source unit 706 through a sensible heat gas connection pipe 708. On the other hand, the room air RA cooled by heat exchange with the refrigerant in the air heat exchangers 722, 732 is supplied as the supply air SA to the room. Note that, as described below, the degree of opening of the sensible heat utilization side expansion valves 721, 731 is adjusted such that the degree of super heat SH in the air heat exchangers 722, 732, i.e., the temperature difference between the refrigerant temperature on the liquid side of the air heat exchangers 722, 732 detected by the liquid side temperature sensors 723, 733 and the refrigerant temperature on the gas side of the air heat exchangers 722, 732 detected by gas side temperature sensors 724, 734, is equal to the target degree of superheat SHS.

Here, the system control being performed in the air conditioning system 601 will be described, focusing on the sensible heat load treatment system 701. Note that, the control necessary to achieve the sensible heat cooling operation in the sensible heat load treatment system 701 will be described later; and the basic control of the sensible heat load treatment system 701 will be described herein.

First, when the target temperature is set by the remote controls 611, 612, along with these target temperatures, the temperature and relative humidity of the room air to be drawn into the unit, which were detected by RA inlet temperature/humidity sensors 725, 735, will be input into sensible heat utilization side controllers 728, 738 of the sensible heat utilization units 702, 703.

Then, in step S46, the sensible heat utilization side controllers 728, 738 calculate the temperature difference between the target temperature of the room air and the temperature detected by the RA inlet temperature sensors 725, 735 (the difference will be hereinafter referred to as the required sensible heat capability value ΔT). Here, as described above, the required sensible heat capacity value ΔT is the difference between the target temperature of the room air and the current temperature of the room air, so that the required sensible heat capacity value ΔT corresponds to the sensible heat load that must be treated in the air conditioning system 601. Then, this required sensible heat capacity value ΔT is converted to a capacity UP signal K2 that informs a heat source side controller 765 whether or not it is necessary to increase the treatment capacity of the sensible heat utilization units 702, 703. For example, when the absolute value of ΔT is lower than a predetermined value (in other words, when the temperature of the room air is close to the target temperature, and the treatment capacity does not need to be increased or decreased), the capacity UP signal K2 will be "0." When the absolute value of ΔT is higher than a predetermined value in a way that the treatment capacity needs to be increased (in other words, the temperature of the room air is higher than the target temperature during the cooling operation, and the treatment capacity needs to be increased), the capacity UP signal K2 will be "a," and when the absolute value of ΔT is higher than a predetermined value in a way that the treatment capacity needs to be decreased (in other words, the temperature of the room air is lower than the target temperature during the cooling operation, and the treatment capacity needs to be decreased), the capacity UP signal K2 will be "b."

Next, in step S75, the sensible heat utilization side controllers 728, 738 change the target degree of superheat SHS according to the value of the required sensible heat capability value ΔT. For example, when the treatment capacity of sensible heat utilization units 502, 503 needs to be decreased (when the capacity UP signal K2 is "b"), the target degree of superheat SHS is increased and the degree of opening of the sensible heat utilization side expansion valves 721, 731 is controlled such that the amount of heat exchanged between the air and the refrigerant in the air heat exchangers 722, 732 is decreased.

In addition, in step S76, the sensible heat heat source side controller 765 calculates the target evaporation temperature TeS2, using the capacity UP signal K2 of the sensible heat utilization units 702, 703, which was transmitted from the sensible heat utilization side controllers 728, 738 to the sensible heat heat source side controller 765. For example, the target evaporation temperature TeS2 is calculated by subtracting the capacity UP signal K2 of the sensible heat utilization units 702, 703 from the current target evaporation temperature. Accordingly, when a value of the capacity UP signal K2 is "a," the target evaporation temperature TeS2 will be low.

Next in step S77, the sensible heat heat source controller 765 calculates the system evaporation temperature Te2, which corresponds to measured valus of the evaporation temperature of the sensible heat load treatment system 701 as a whole. For example, the system evaporation temperature Te2 is calculated by converting the inlet pressure of the sensible heat compression mechanism 761, which was detected by a sensible heat inlet pressure sensor 766 to the saturation temperatures of the refrigerant at the pressure. Then the temperature difference ΔTe2 between the system evaporation temperature Te2 and the target evaporation temperature TeS2 is calculated, and based on this temperature difference ΔTe2, the necessity and amount of the increase or decrease in the operational capacity of the sensible heat compression mechanism 761 will be determined.

By using thus determined operational capacity of the sensible heat compression mechanism 761 to control the operational capacity of the sensible heat compression mechanism 761, the system control to aim the target temperature of the sensible heat utilization units 702, 703 is performed. The system control is performed such that, for example, when the temperature difference ΔTe2 is a positive value, the operational capacity of the sensible heat compression mechanism 761 is decreased, whereas when the temperature difference ΔTe2 is a negative value, the operational capacity of the sensible heat compression mechanism 761 is increased.

Incidentally, in this air conditioning system 601, as described above, the latent heat treatment that mainly treats the latent heat load in the room is performed in the latent heat load treatment system 201, and the sensible heat cooling operation that only treats the sensible heat load in the room is performed in the sensible heat load treatment system 701. This air conditioning system 601 uses the evaporation pressure control valves 742, 752 of the connection units 741, 751 so as to perform the system control as described below in order to achieve the sensible heat cooling operation of the sensible heat load treatment system 701.

First, in step S78, the sensible heat utilization side controllers 728, 738 calculate the dew point temperature based on the temperature and relative humidity of the room air that is to be drawn to the unit, which were detected by the RA inlet temperature/humidity sensors 725, 735, and then calculate the minimum evaporation temperature Te3 of the refrigerant that flows in the air heat exchangers 722, 732 such that condensation of air in the air heat exchangers 722, 732 is prevented, specifically, so that air in the air heat exchangers 722, 732 will be at least equal to or higher than this dew point temperature.

Next, in step S79, the minimum evaporation temperature Te3 transmitted from the sensible heat utilization side controllers 728, 738 to the connection unit controllers 742, 744 is converted to the minimum evaporation pressure value P3 that is the saturation pressure that corresponds to this temperature Te3. Then in step S80, this minimum evaporation pressure value P3 is compared with the pressure of the refrigerant in the air heat exchangers 722, 732, which was detected by the evaporation pressure sensors 743, 753. The degree of opening of the evaporation pressure control valves 742, 752 is adjusted such that the pressure of the refrigerant in the air heat exchangers 722, 732, which was detected by the evaporation pressure sensors 743, 753, is equal to or higher than the minimum evaporation pressure value P3.

Accordingly, even when the operational capacity of the sensible heat compression mechanism 761 is changed according to the required sensible heat treatment capacity value, the degree of opening of the evaporation pressure control valves 742, 752 is adjusted such that the pressure of the refrigerant in the air heat exchangers 722, 732, which was detected by the evaporation pressure sensors 743, 753, is equal to or higher than the minimum evaporation pressure value P3. As a result, it is possible to achieve the sensible heat cooling operation.

Note that during the above-described drainless dehumidifying and cooling operation, when the evaporation temperature of the air heat exchangers 722, 732 is equal to or below the dew point temperature (in other words, equal to or below the minimum evaporation temperature Te3), and when condensation is detected by condensation sensors 726, 736, the following actions are taken in order to reliably prevent condensation in the air heat exchangers 722, 732: the connection unit controllers 744, 754 correct the value of the minimum evaporation pressure P3 such that a minimum evaporation pressure P3 is higher than the that the minimum evaporation pressure P3 at the time of detection of condensation; the sensible heat utilization side controllers 728, 738 close the sensible heat utilization side expansion valves 721, 731; and the sensible heat utilization side controllers 728, 738 transmit a signal that informs that condensation is detected to the heat source side controller 765, then the heat source side controller 765 stops the sensible heat compression mechanism 761.

Next the operation during a second drainless dehumidifying and cooling operation will be described with reference to FIGS. 43, 44, and 46.

With the above-described first method of the drainless dehumidifying and cooling operation, the latent heat load in the room is treated in the latent heat load treatment system 201, and the sensible heat cooling operation that treats only the sensible heat load in the room by using the evaporation pressure control valves 742, 752 is performed in the sensible heat load treatment system 701. Specifically, the latent heat load (required latent heat treatment capacity, which corresponds to Δh), which must be treated in the latent heat load treatment system 201 and the sensible heat load treatment system 701, and the sensible heat load (required sensible heat treatment capacity, which corresponds to ΔT), which must be treated in a latent heat load treatment system 801 and the sensible heat load treatment system 701, are treated by using the latent heat load treatment system 201 and the sensible heat load treatment system 701. Here, the treatment capacity of the latent heat load treatment system 201 is increased or decreased mainly through the control of the operational capacity of the latent heat compression mechanism 261. In addition, the treatment capacity of the sensible heat load treatment system 701 is increased or decreased mainly through the control of the operational capacity of the sensible heat compression mechanism 761.

As shown in FIG. 5, in the latent heat load treatment in the latent heat load treatment system 201, the sensible heat is also treated along with the latent heat through the adsorption process or the regeneration process in the first adsorbent heat exchangers 222, 232 and the second adsorbent heat exchangers 223, 233 which constitute the latent heat load treatment system 201. As a result, both the latent heat treatment and the sensible heat treatment are performed. Here, given that the capacity of the sensible heat treatment that is performed along with the latent heat treatment in the latent heat load treatment system 201 is the generated sensible heat treatment capacity, the sensible heat load that must be treated in the sensible heat load treatment system is equal to the amount remaining after subtracting the generated sensible heat treatment capacity from the required latent heat treatment capacity.

Accordingly, with the second method of the drainless dehumidifying and cooling operation, the following system control is performed, in view of that the sensible heat load that is treated in the latent heat load treatment system of the air conditioning system 201. Note that in regard to this drainless dehumidifying and cooling operation method, the steps excluding steps S81 to S84 particular to this operation method (in other words, steps S71 to S80) are the same as those in the control flow of the first operation, so that the description thereof will be omitted.

In the latent heat utilization side controllers 228, 238, in step S81, when the switching time interval between the adsorption process and the regeneration process in the adsorbent heat exchangers 222, 223 and the adsorbent heat exchangers 232, 233 is set to the sensible heat priority mode (for example, time D in FIG. 5), and also when the capacity UP signal K2 is "b" (when the required sensible heat treatment capacity in the sensible heat utilization side units 702, 703 is small), in step S83, the switching time interval is changed and set to the latent heat priority mode (for example, time C in FIG. 5). When a condition is different than described above, the system control proceeds to step S82.

Then, in step S82, when the switching time interval between the adsorption process and the regeneration process in the adsorbent heat exchangers 222, 223 and the adsorbent heat exchangers 322, 233 is set to the latent heat priority mode (for example, time C in FIG. 5), and also when the capacity UP signal K2 is "a" (when the required sensible heat treatment capacity in the sensible heat utilization side units 702, 703 is large), in step S84, the switching time interval is changed and set to the sensible heat priority mode (for example, time D in FIG. 5) so as to increase the sensible heat treatment capacity in the latent heat load treatment system 201.

In this way, with the second operation method, when the required sensible heat treatment capacity value ΔT is high and the sensible heat treatment capacity in the sensible heat load treatment system 701 needs to be increased, the switching time interval between the adsorption process and the regeneration process in the adsorbent heat exchangers 222, 232, 223, 233 of the latent heat utilization units 202, 203 is made longer so as to decrease the latent heat treatment capacity and to increase the sensible heat treatment capacity in the adsorbent heat exchangers 222, 232, 223, 233, in order to increase the sensible heat treatment capacity in the latent heat load treatment system, in other words, the sensible heat treatment capacity ratio can be increased. Consequently, even when the required sensible heat treatment capacity value ΔT is high, it will be possible to follow a change in the sensible heat treatment capacity while preventing condensation of moisture in the air in the air heat exchangers 722, 732 in the sensible heat load treatment system 701 and treating only the sensible heat load in the room.

Note that, as with the first operation method, during the above-described drainless dehumidifying and cooling operation, when the evaporation temperature of the air heat exchangers 722, 732 in the sensible heat load treatment system 701 is equal to or below the dew point temperature (in other words, equal to or below the minimum evaporation temperature Te3), and when condensation is detected by the condensation sensors 726, 736, the following actions are taken in order to reliably prevent condensation in the air heat exchangers 722, 732: the connection unit controllers 744, 754 correct the value of the minimum evaporation pressure P3 such that the minimum evaporation pressure P3 is higher than the minimum evaporation pressure P3 at the time of detection of condensation; the sensible heat utilization side controllers 728, 738 close the sensible heat utilization side expansion valves 721, 731; and the sensible heat utilization side controllers 728, 738 transmit a signal that informs the detection of condensation to the sensible heat heat source side controller 765, and the sensible heat heat source side controller 765 stops the sensible heat compression mechanism 761.

In addition, in this operation method, both the evaporating pressure control valves 742, 752 are used together. Accordingly, even when the operational capacity of the sensible heat compression mechanism 761 is minimized and the temperature of gas refrigerant on the inlet side of the sensible heat compression mechanism 761 is equal to or below the dew point temperature of the room air, the opening degree of the evaporating pressure control valves 742, 752 is reduced, and thereby condensation in the air heat exchangers 722, 732 is prevented and the dehumidifying and cooling operation can be continued at the same time.

<Control of the Drainless System startup>

Since the drainless system startup operation of the air conditioning system 601 is the same as the drainless system startup operation of the air conditioning system 401 of the third embodiment, a description thereof will be omitted.

(3) Characteristics of the Air Conditioning System

The air conditioning system 601 of the present embodiment has the following characteristics.

(A)

In the air conditioning system 601 of the present embodiment, the latent heat load treatment system 201 has the same configuration as that in the air conditioning system 1 of the first embodiment, so that the air conditioning system 601 have the same characteristics as in the air conditioning system 1.

The air conditioning system 601 of the present embodiment further comprises: the sensible heat load treatment system 701 comprising the sensible heat heat source unit 706 including a sensible heat heat source side refrigerant circuit 710*c*, and the sensible heat utilization units 702, 703 including sensible heat utilization side refrigerant circuits 710*a*, 710*b* having the air heat exchangers 722, 732; in addition to the latent heat load treatment system 201 comprising the latent heat heat source unit 206 including a latent heat heat source side refrigerant circuit 210*c*, and the latent heat utilization units 202, 203 including latent heat utilization side refrigerant circuits 210*a*, 210*b* having the adsorbent heat exchangers 222, 223, 232, 233. Consequently, it is possible to treat the latent heat load and sensible heat load in the room separately by the two treatment systems 201, 701.

(B)

As with the air conditioning system 401 of the third embodiment, in the air conditioning system 601 of the present embodiment, when the required sensible heat treatment capacity increases and the sensible heat treatment capacity in the sensible heat load treatment system 701 needs to be increased, the switching time interval between the adsorption process and the regeneration process in the adsorbent heat exchangers 222, 232, 223, 233 that constitute the latent heat load treatment system 201 is made longer so as to decrease the latent heat treatment capacity and to increase the sensible heat treatment capacity in the adsorbent heat exchangers 222, 232, 223, 233, in order to increase the sensible heat treatment capacity in the latent heat load treatment system 201, in other words, the sensible heat treatment capacity ratio of the latent heat load treatment system 201 is increased, in order to increase the sensible heat treatment capacity in the latent heat load treatment system 201. Consequently, it is possible to follow a change in the sensible heat treatment capacity while preventing condensation of moisture in the air in the sensible heat load treatment system 701 and treating only the sensible heat load in the room.

(C)

This air conditioning system 601 controls the evaporation pressure control valves 742, 752 based on the dew point temperature of the room air such that, for example, the evaporation temperature of the refrigerant in the air heat exchangers 722, 732 does not drop below the dew point temperature of the room air. In this way, moisture in the air is prevented from being condensed on the surface of the air heat exchangers 722, 732, and drain water is prevented from being generated in the air heat exchangers 722, 732. Accordingly, a drain pipe will not be needed in the unit having second utilization side refrigerant circuits 710*a*, 710*b*, and thus laborsaving installation of the unit having the second utilization side refrigerant circuits 710*a*, 710*b* can be achieved.

In addition, in this air conditioning system 601, instead of the dew point temperature, the evaporation pressure of the refrigerant in the air heat exchangers 722, 732, which are measured by the evaporation pressure sensors 743, 753, is used as a control value for the evaporation pressure control valves 742, 752 for controlling the evaporation pressure of the refrigerant in the air heat exchangers 722, 732. Therefore, the control responsiveness is improved, compared to a case where the evaporation pressure of the refrigerant is controlled by using the dew point temperature.

(D)

In the air conditioning system 601 of the present embodiment, condensation in the air heat exchangers 722, 732 is reliably prevented because condensation in the air heat exchangers 722, 732 can be reliably detected by the condensation sensors 726, 736, and when condensation is detected, the following actions are taken: the minimum evaporation pressure value P3 calculated based on the dew point temperature can be changed so as to change the evaporation pressure of the refrigerant in the air heat exchangers 722, 732; the sensible heat compression mechanism 761 that constitutes the sensible heat heat source side 706 is stopped; and the sensible heat utilization side expansion valves 721, 731 of the sensible heat utilization units 702, 703 are closed, respectively.

(4) MODIFIED EXAMPLE 1

Figure 47:
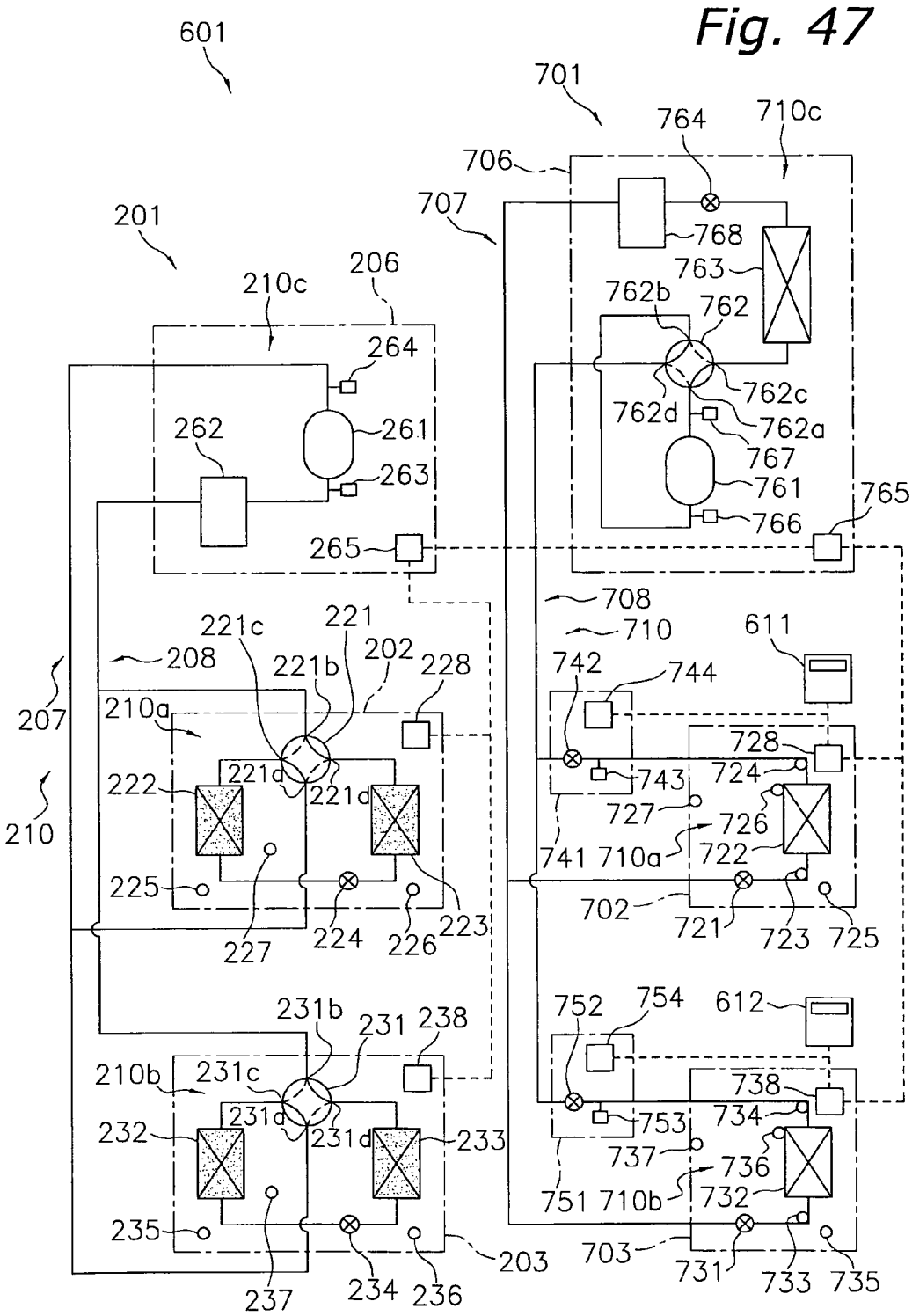
FIG. 47 is a schematic diagram of a refrigerant circuit of an air conditioning system according to a modified example 1 of the fourth embodiment.

In the air conditioning system 601 in the above-described embodiment, the dew point temperature of the room air is calculated based on the temperature and the relative humidity of the room air, which were detected by the RA inlet temperature/humidity sensors 725, 735, and the minimum evaporation temperature Te3 of the refrigerant in the air heat exchangers 722, 732 is calculated in order to use these calculated values for the system control. However, as shown in FIG. 47, dew point sensors 727, 737 may be provided in the sensible heat utilization units 702, 703 so as to use the dew point temperature detected by the dew point sensors 727, 737 for the system control.

(5) MODIFIED EXAMPLE 2

Figure 48:
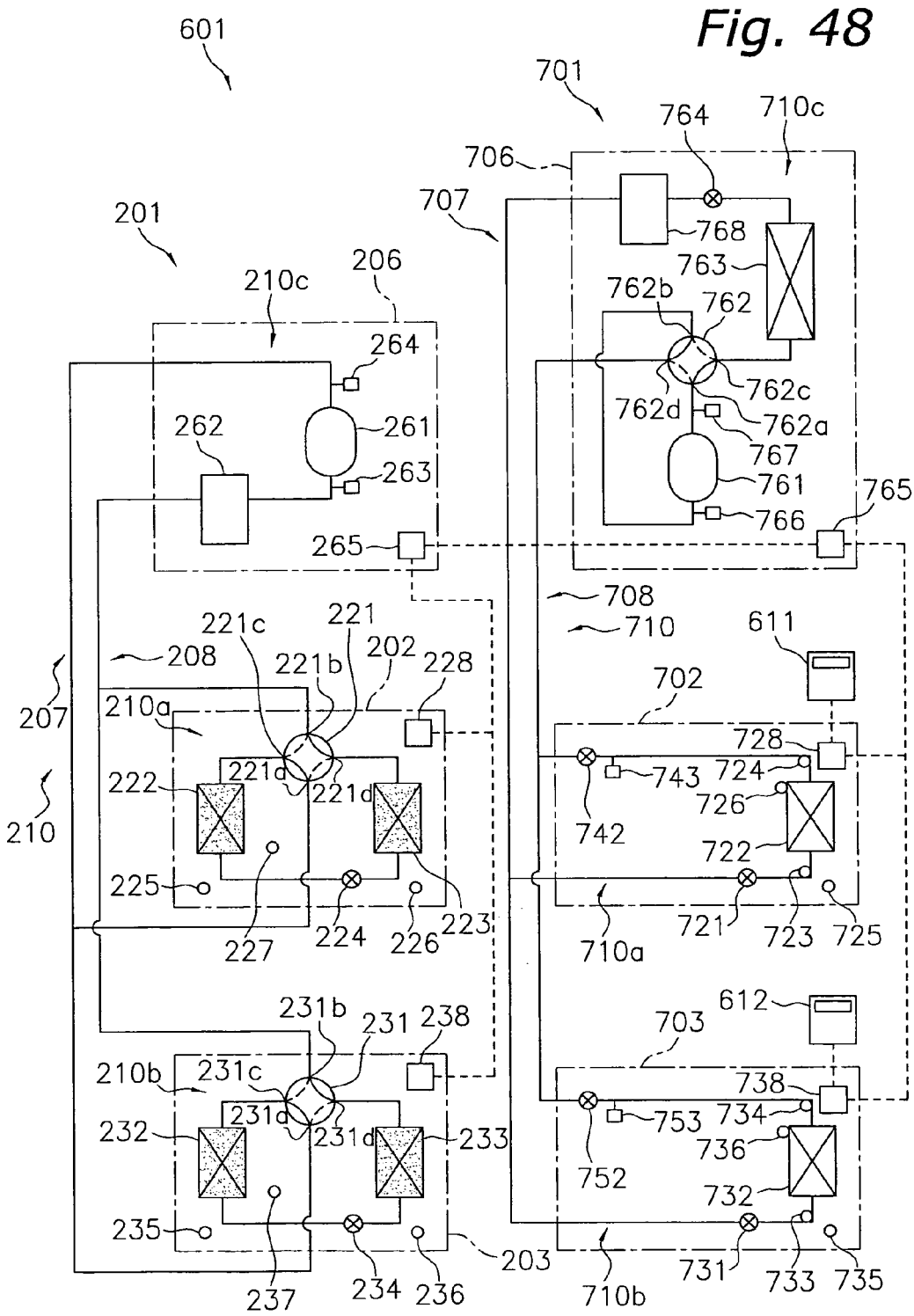
FIG. 48 is a schematic diagram of a refrigerant circuit of an air conditioning system according to a modified example 2 of the fourth embodiment.

In the above-described sensible heat load treatment system 601, the evaporating pressure control valves 742, 752 and the evaporating pressure sensors 743, 753 are built into the connection units 741, 751, which are different units from the sensible heat utilization units 702, 703. However, as shown in FIG. 48, the evaporating pressure control valves 742, 752 and the evaporating pressure sensors 743, 753 may be built into the sensible heat utilization units 702, 703, respectively.

In this case, the sensible heat utilization side controllers 728, 738 will incorporate the functions of the connection unit controllers 744, 754, respectively.

(6) MODIFIED EXAMPLE 3

Figure 49:
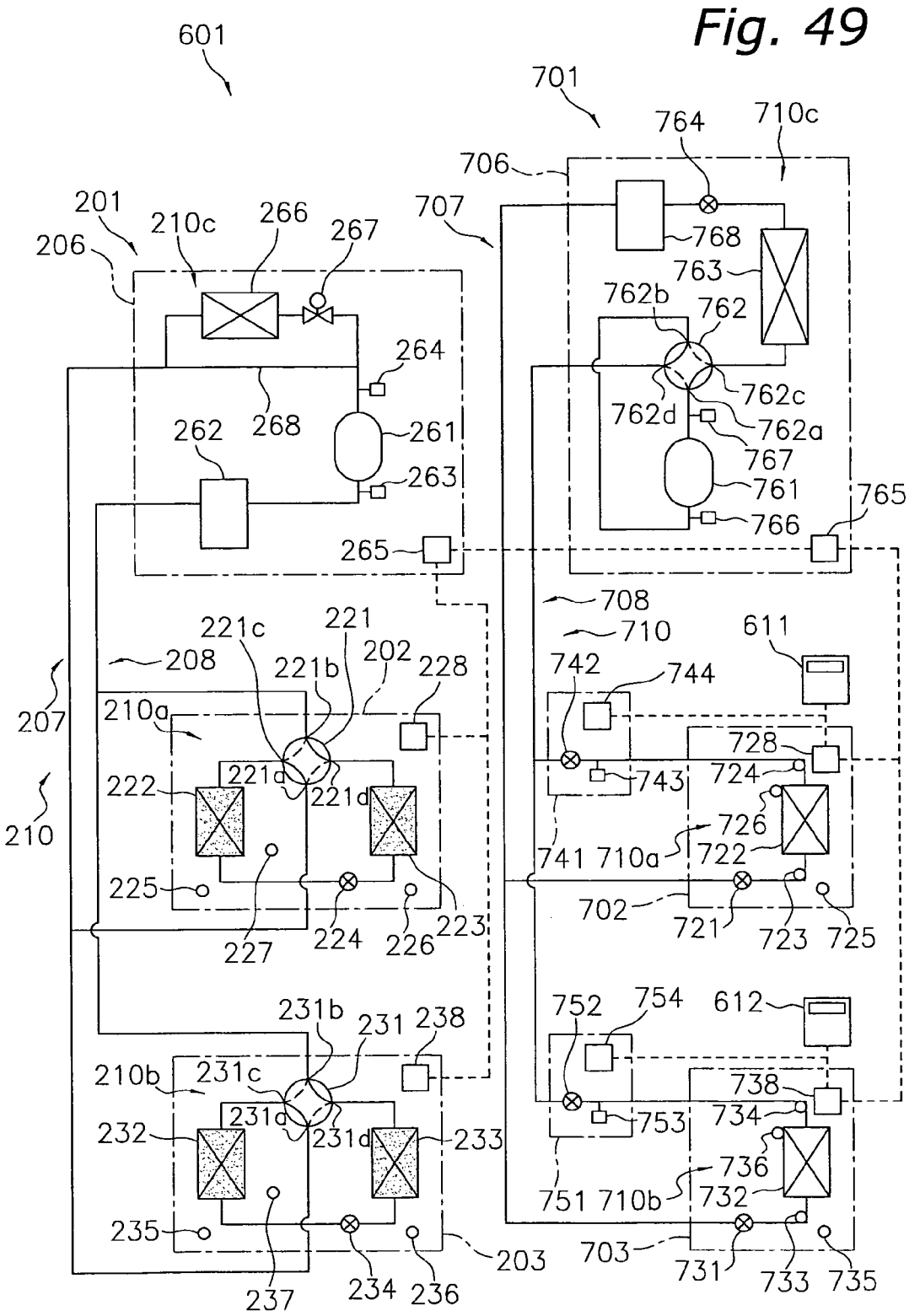
FIG. 49 is a schematic diagram of a refrigerant circuit of an air conditioning system according to a modified example 3 of the fourth embodiment.

As shown in FIG. 49, in a latent heat heat source unit 206 of the present embodiment, as with the heat source unit 6 of the first embodiment, a latent heat supplementary condenser 266 may be connected thereto so as to allow a portion of high-pressure gas refrigerant, which is discharged from the latent heat compression mechanism 261 and sent to the latent heat utilization units 202, 203, to be condensed.

Other Embodiments

While preferred embodiments have been described in connection with the present invention, the scope of the present invention is not limited to the above embodiments, and the various changes and modifications may be made without departing from the scope of the present invention.

(A)

In each of the air conditioning systems of the above-described second, third, and fourth embodiments, a multi air conditioning system capable of switching between the cooling operation and the heating operation is used as the sensible heat load treatment system. However, it is not limited thereto, and a multi air conditioning system exclusively used for cooling, and a multi air conditioning system capable of simultaneously performing the cooling operation and the heating operation may be used.

(B)

In the air conditioning system of the above-described third and fourth embodiments, the condensation sensors are provided in the sensible heat utilization units; however, when the sensible heat cooling operation of the sensible heat load treatment system can be reliably performed, the condensation sensors may not necessarily be provided.

INDUSTRIAL APPLICABILITY

By the application of the present invention, it is possible to prevent problems such as an increase in cost and an increase in the size of a unit that houses adsorbent heat exchangers, which arise when a plurality of air conditioners that use the adsorbent heat exchangers are installed.

What is claimed is:

1. An air conditioning system configured to treat a latent heat load and a sensible heat load in a room by performing a vapor compression refrigeration cycle operation, comprising:

a plurality of first utilization side refrigerant circuits each having an adsorbent heat exchanger provided with an adsorbent on a surface thereof, and configured for dehumidifying or humidifying air by alternating between an adsorption process in which moisture in air is adsorbed onto the adsorbent by causing the adsorbent heat exchanger to function as an evaporator that evaporates refrigerant and a regeneration process in which moisture is desorbed from the adsorbent by causing the adsorbent heat exchanger to function as a condenser that condenses the refrigerant;

a heat source side refrigerant circuit having a compression mechanism and a liquid container connected to an inlet side of the compression mechanism;

an exhaust gas connection pipe connected to a discharge side of the compression mechanism and configured to connect the utilization side refrigerant circuits to the heat source side refrigerant circuit; and an inlet gas connection pipe connected to the inlet side of the compression mechanism, the utilization side refrigerant circuits being configured to supply a room with air that passed through the adsorbent heat exchanger.

2. The air conditioning system according to claim 1, wherein the heat source side refrigerant circuit includes a supplementary condenser connected to the discharge side of the compression mechanism.

3. The air conditioning system according to claim 1, further comprising a plurality of second utilization side refrigerant circuits each having an air heat exchanger and configured to exchange heat between refrigerant and air; and a second heat source side refrigerant circuit connected to the second utilization side refrigerant circuits and including a second compression mechanism and a heat source side heat exchanger, the second utilization side refrigerant circuits being configured to supply a room with air that passed through the air heat exchanger.

4. The air conditioning system according to claim 3, wherein the air conditioning system is configured to calculate a generated sensible heat treatment capacity value that corresponds to the capacity of the sensible heat treatment that is performed along with the latent heat load treatment in a room in the first utilization side refrigerant circuits through an adsorption process or a regeneration process in the adsorbent heat exchanger, and then controls the operational capacity of the second compression mechanism in view of the generated sensible heat treatment capacity value.

5. The air conditioning system according to claim 4, further comprising a supply air temperature detection mechanism configured to detect the temperature of air to be supplied to a room after the air passed through the adsorbent heat exchanger, the air conditioning system being configured to calculate the generated sensible heat treatment capacity value based on the supply air temperature and the temperature of the room air detected by the supply air temperature detection mechanism.

6. The air conditioning system according to claim 4, wherein at system startup, air that passed through the air heat exchanger is supplied to a room, and outdoor air is prevented from passing through the adsorbent heat exchanger.

7. The air conditioning system according to claim 4, wherein at system startup, in a state in which switching between the adsorption process and the regeneration process in the plurality of adsorbent heat exchangers is stopped, outdoor air is passed through one of the adsorbent heat exchangers and then is exhausted to the outside, and room air is passed through another one of the adsorbent heat exchangers, besides the one through which the outdoor air passed, and then is supplied to a room again.

8. The air conditioning system according to claim 4, wherein at system startup, a switching time interval between the adsorption process and the regeneration process in the adsorbent heat exchanger is made longer than that during normal operation.

9. The air conditioning system according to claim 6, wherein a system startup operation is terminated after a predetermined period of time elapsed since system startup.

10. The air conditioning system according to claim 6, wherein a system startup operation is terminated after a temperature difference between a target temperature of room air and a temperature of room air is equal to or below a predetermined temperature difference.

11. The air conditioning system according to claim 6, wherein before a system startup operation starts, a temperature difference between a target temperature of room air and a temperature of room air is determined, and when the temperature difference between the target temperature of room air and the temperature of room air is equal to or below a predetermined temperature, the system startup operation is prevented from being performed.

12. The air conditioning system according to claim 3, further comprising a pressure control mechanism connected to a gas side of the air heat exchanger and configured to control an evaporation pressure of refrigerant in the air heat exchanger when the air heat exchanger is caused to function as an evaporator that evaporates refrigerant.

13. The air conditioning system according to claim 12, wherein the evaporation pressure of refrigerant is controlled by the pressure control mechanism based on a dew point temperature of room air when the air heat exchanger is caused to function as an evaporator that evaporates refrigerant.

14. The air conditioning system according to claim 13, further comprising a pressure detection mechanism configured to detect a refrigerant pressure in the air heat exchanger and the evaporation pressure of refrigerant, the air conditioning system being configured to calculate a target evaporation pressure value based on the dew point temperature of room air and use the pressure control mechanism to control the evaporation pressure of refrigerant to be equal to or higher than the target evaporation pressure.

15. The air conditioning system according to claim 14, further comprising a condensation detection mechanism configured to detect a presence of condensation in the air heat exchanger, the air conditioning system being configured to change the target evaporation pressure value when condensation is detected by the condensation detection mechanism.

16. The air conditioning system according to claim 3, further comprising a condensation detection mechanism configured to detect a presence of condensation in the air heat exchanger, wherein, when condensation is detected by the condensation detection mechanism, the second compression mechanism is stopped.

17. The air conditioning system according claim 3, further comprising a condensation detection mechanism configured to detect a presence of condensation in the air heat exchanger, the second utilization side refrigerant circuit including an utilization side expansion valve connected to a liquid side of the air heat exchanger, and the air conditioning system being configured to close the utilization side expansion valve when condensation is detected by the condensation detection mechanism.

18. The air conditioning system according to claim 1, wherein a switching time interval between the adsorption process and the regeneration process in the adsorbent heat exchanger is changeable.

19. The air conditioning system according to claim 12, wherein at system startup, treatment of the latent heat load in a room by the first utilization side refrigerant circuits is given priority over treatment of the sensible heat load in a room by the second utilization side refrigerant circuits.

20. The air conditioning system according to claim 19, wherein at system startup, treatment of the sensible heat load in a room by the second utilization side refrigerant circuits is stopped until a dew point temperature of room air is equal to or below a target dew point temperature.

21. The air conditioning system according to claim 19, wherein at system startup, treatment of the sensible heat load in a room by the second utilization side refrigerant circuits is stopped until an absolute humidity of room air is equal to or below a target absolute humidity.

22. The air conditioning system according to claim 19, wherein at system startup, outdoor air is passed through one of the adsorbent heat exchangers that is performing a regeneration process, and then is exhausted to the outside, and then, room air is passed through one of the adsorbent heat exchangers that is performing the adsorption process and is supplied to a room.

23. The air conditioning system according to claim 19, wherein before starting a system startup operation, a dew point temperature difference between a target dew point temperature of room air and a dew point temperature of the room air is determined, and when the dew point temperature difference between the target dew point temperature of room air and the dew point temperature of room air is equal to or below a predetermined dew point temperature difference, the startup operation is prevented from being performed.

24. The air conditioning system according to claim 19, wherein before starting a system startup operation, an absolute humidity difference between a target absolute humidity of room air and an absolute humidity of the room air is determined, and when the absolute humidity difference between the target absolute humidity of room air and the absolute humidity of room air is equal to or below a predetermined absolute humidity difference, the system startup operation is prevented from being performed.

* * * * *